US012747883B2

(12) United States Patent
Gyeong et al.

(10) Patent No.: US 12,747,883 B2
(45) Date of Patent: Sep. 29, 2026

(54) AIR CONDITIONER

(71) Applicant: LG ELECTRONICS INC., Seoul (KR)

(72) Inventors: Giyeong Gyeong, Seoul (KR); Jungwon Lee, Seoul (KR); Byeongjin Choi, Seoul (KR); Mingu Kwon, Seoul (KR); Kangyoung Kim, Seoul (KR); Seongkuk Mun, Seoul (KR); Junseok Bae, Seoul (KR); Kyuyeol Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 244 days.

(21) Appl. No.: 18/770,813

(22) Filed: Jul. 12, 2024

(65) Prior Publication Data

US 2025/0012468 A1 Jan. 9, 2025

Related U.S. Application Data

(63) Continuation of application No. 16/978,126, filed as application No. PCT/KR2019/002674 on Mar. 7, 2019, now Pat. No. 12,055,308.

(30) Foreign Application Priority Data

| | | |
|---|---|---|
| Mar. 7, 2018 | (KR) | 10-2018-0026990 |
| Mar. 7, 2018 | (KR) | 10-2018-0026994 |
| Feb. 28, 2019 | (KR) | 10-2019-0024361 |

(51) Int. Cl.
*F24F 13/12* (2006.01)
*F24F 1/005* (2019.01)
(Continued)

(52) U.S. Cl.
CPC ..... *F24F 11/38* (2018.01); *F24F 1/005* (2019.02); *F24F 1/0087* (2019.02); *F24F 6/00* (2013.01);
(Continued)

(58) Field of Classification Search
CPC ..... F24F 11/38; F24F 1/005; F24F 1/0087; F24F 6/00; F24F 11/52; F24F 13/12; F24F 13/20; F24F 2120/12
See application file for complete search history.

(56) References Cited

U.S. PATENT DOCUMENTS

| | | | | |
|---|---|---|---|---|
| 4,697,383 A | 10/1987 | Hagiwara | E05F 15/73 | 49/31 |
| 5,807,170 A | 9/1998 | Lee | F24F 1/005 | 454/324 |

(Continued)

FOREIGN PATENT DOCUMENTS

| | | |
|---|---|---|
| CN | 2119604 U | 10/1992 |
| CN | 1158402 A | 9/1997 |

(Continued)

*Primary Examiner* — Michael W Choi
(74) *Attorney, Agent, or Firm* — Bryan Cave Leighton Paisner LLP

(57) ABSTRACT

An air conditioner including a sliding door, which forms a front surface part thereof and moves in a lateral direction to be opened and closed; a sliding door motor for enabling movement of the sliding door; a sliding door position sensor which may include a first position sensor and second position sensor for detecting the position of the sliding door, and a control part for controlling an opening/closing operation of the sliding door based on sensing data of the sliding door position sensor and a rotational speed of the sliding door motor.

12 Claims, 34 Drawing Sheets

(51) Int. Cl.

| | |
|---|---|
| ***F24F 1/0087*** | (2019.01) |
| ***F24F 6/00*** | (2006.01) |
| ***F24F 11/38*** | (2018.01) |
| ***F24F 11/52*** | (2018.01) |
| ***F24F 13/20*** | (2006.01) |
| *F24F 120/12* | (2018.01) |

(52) U.S. Cl.
CPC ..... *F24F 11/52* (2018.01); *F24F 13/12* (2013.01); *F24F 13/20* (2013.01); *F24F 2120/12* (2018.01)

(56) References Cited

U.S. PATENT DOCUMENTS

| | | | | |
|---|---|---|---|---|
| 6,225,904 | B1 | 5/2001 | Jaffe | F25D 23/021 340/545.6 |
| 2003/0097762 | A1 | 5/2003 | Hsu | |
| 2005/0017667 | A1 | 1/2005 | Yamamoto | H02H 7/0851 318/469 |
| 2013/0067816 | A1 | 3/2013 | Chang | H03K 17/955 222/52 |
| 2014/0109478 | A1 | 4/2014 | Mori | B60J 5/00 49/26 |
| 2016/0343185 | A1 | 11/2016 | Dumas | G07C 9/00309 |
| 2017/0254548 | A1* | 9/2017 | Song | F24F 13/08 |
| 2017/0356672 | A1 | 12/2017 | Kim | F24F 11/30 |
| 2019/0041071 | A1 | 2/2019 | Cho et al. | |

FOREIGN PATENT DOCUMENTS

| | | | |
|---|---|---|---|
| CN | 101158851 | A | 4/2008 |
| CN | 101782260 | | 7/2010 |
| CN | 202392959 | U | 8/2012 |
| CN | 204115155 | U | 1/2015 |
| CN | 104864497 | B | 8/2015 |
| CN | 106352495 | A | 1/2017 |
| CN | 106408864 | A | 2/2017 |
| CN | 107676950 | A | 2/2018 |
| DE | 102008021689 | A1 | 11/2009 |
| JP | H10-231660 | A | 9/1998 |
| JP | 2000-274827 | A | 10/2000 |
| JP | 2018-138865 | A | 9/2018 |
| KR | 10-2001-0037821 | A | 5/2001 |
| KR | 10-2006-0134542 | A | 12/2006 |
| KR | 10-0749765 | B | 8/2007 |
| KR | 100805365 | B1 | 2/2008 |
| KR | 10-1396406 | B1 | 12/2008 |
| KR | 20-2009-0000506 | U | 1/2009 |
| KR | 20-2009-0003473 | U | 4/2009 |
| KR | 10-2009-0129536 | A | 12/2009 |
| KR | 10-2012-0064492 | A | 6/2012 |
| KR | 10-1727915 | B1 | 6/2012 |
| KR | 10-2014-0047324 | A | 4/2014 |
| KR | 10-2015-0017431 | A | 2/2015 |
| KR | 101599634 | B1 | 3/2016 |
| KR | 10-2016-0071141 | A | 6/2016 |
| KR | 10-2017-0032626 | A | 3/2017 |
| KR | 10-2017-0061137 | A | 6/2017 |
| KR | 10-2017-0140585 | A | 12/2017 |

* cited by examiner

【FIG. 1】
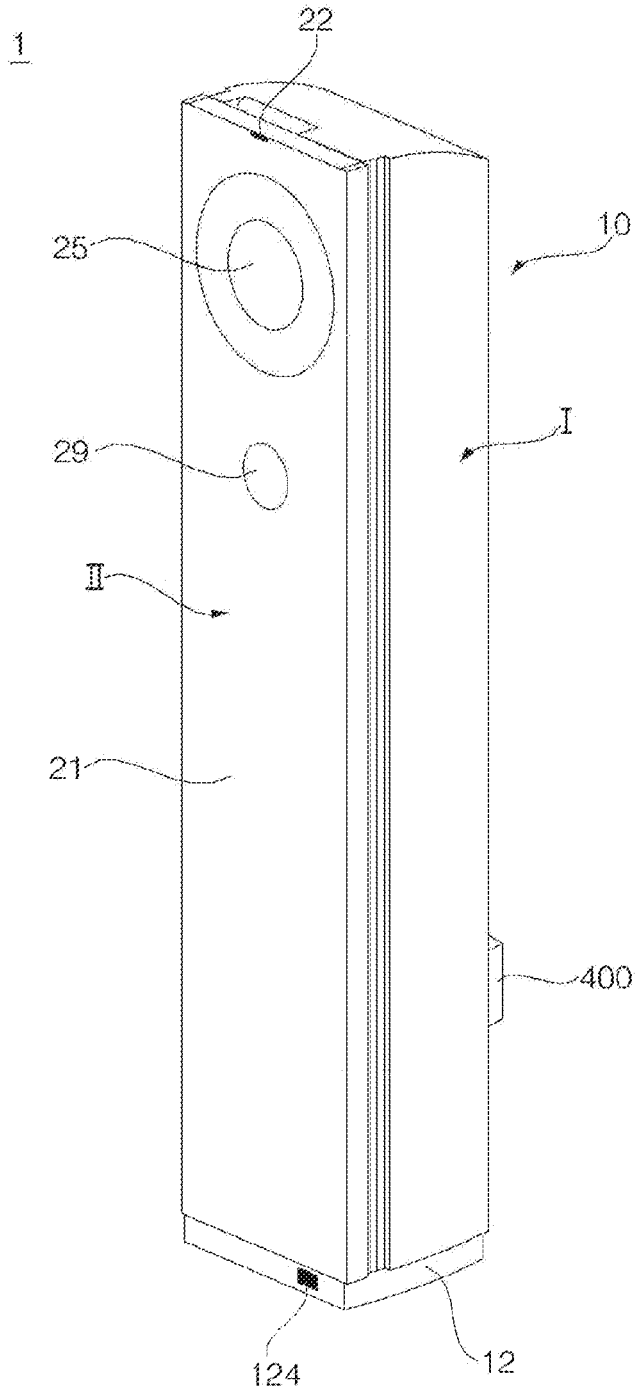

【FIG. 2】
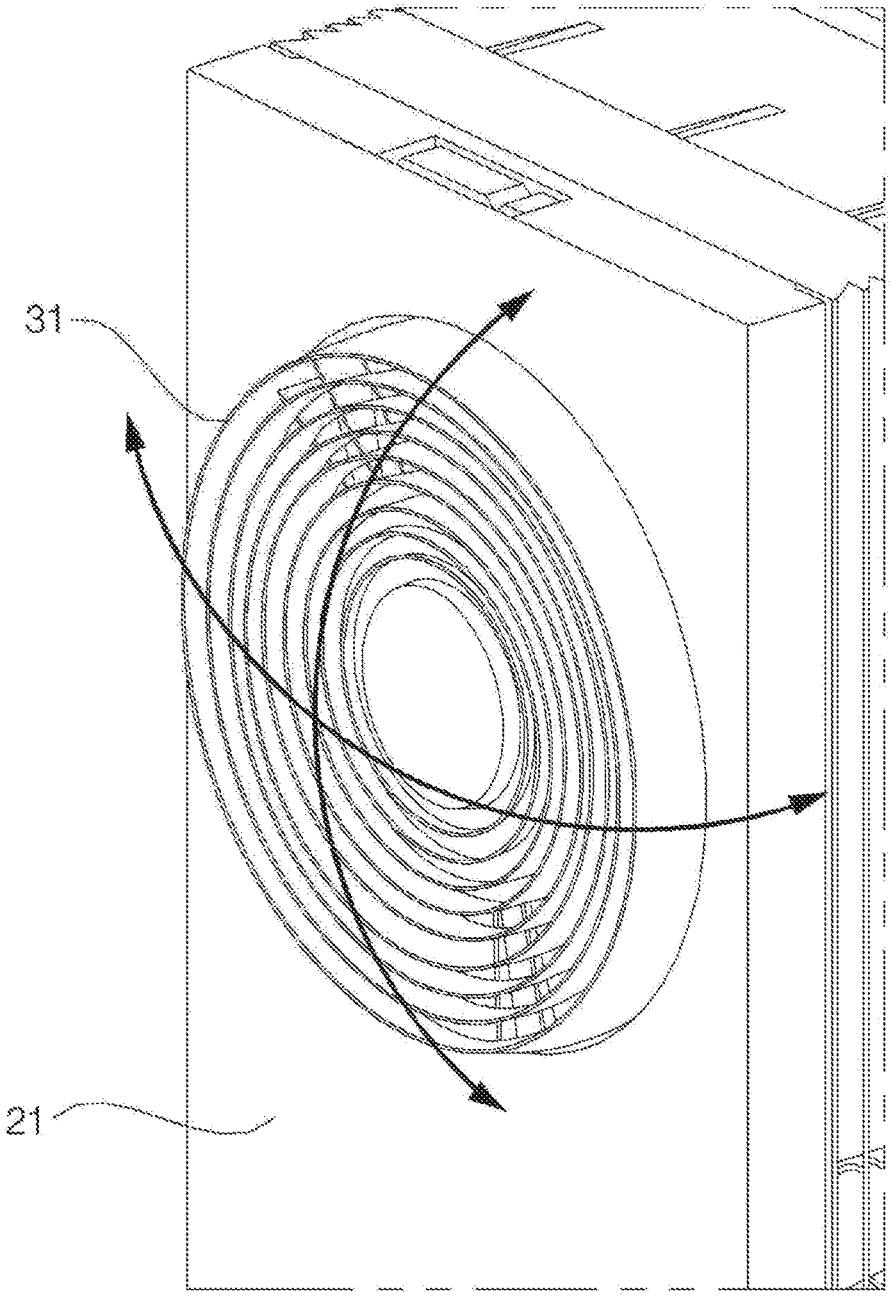

【FIG. 3】
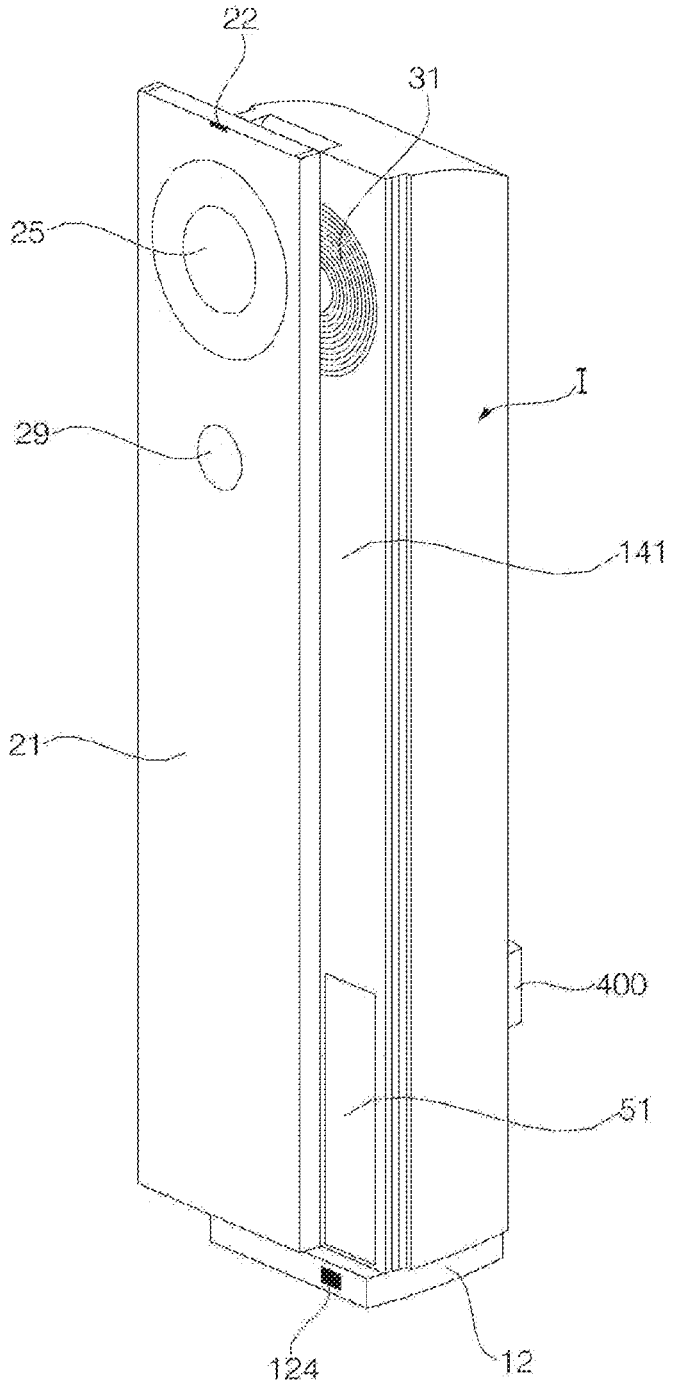

【FIG. 4】
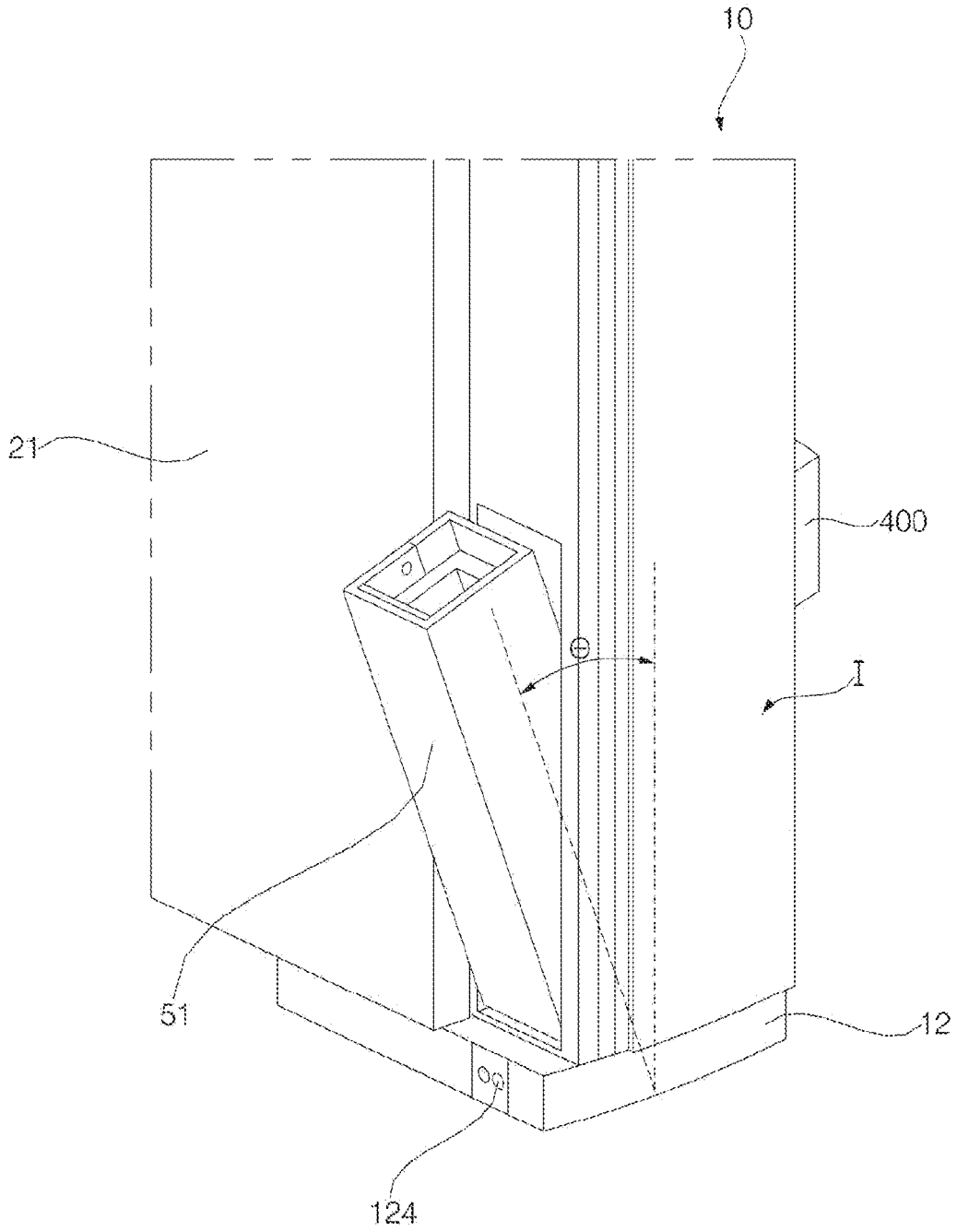

【FIG. 5】
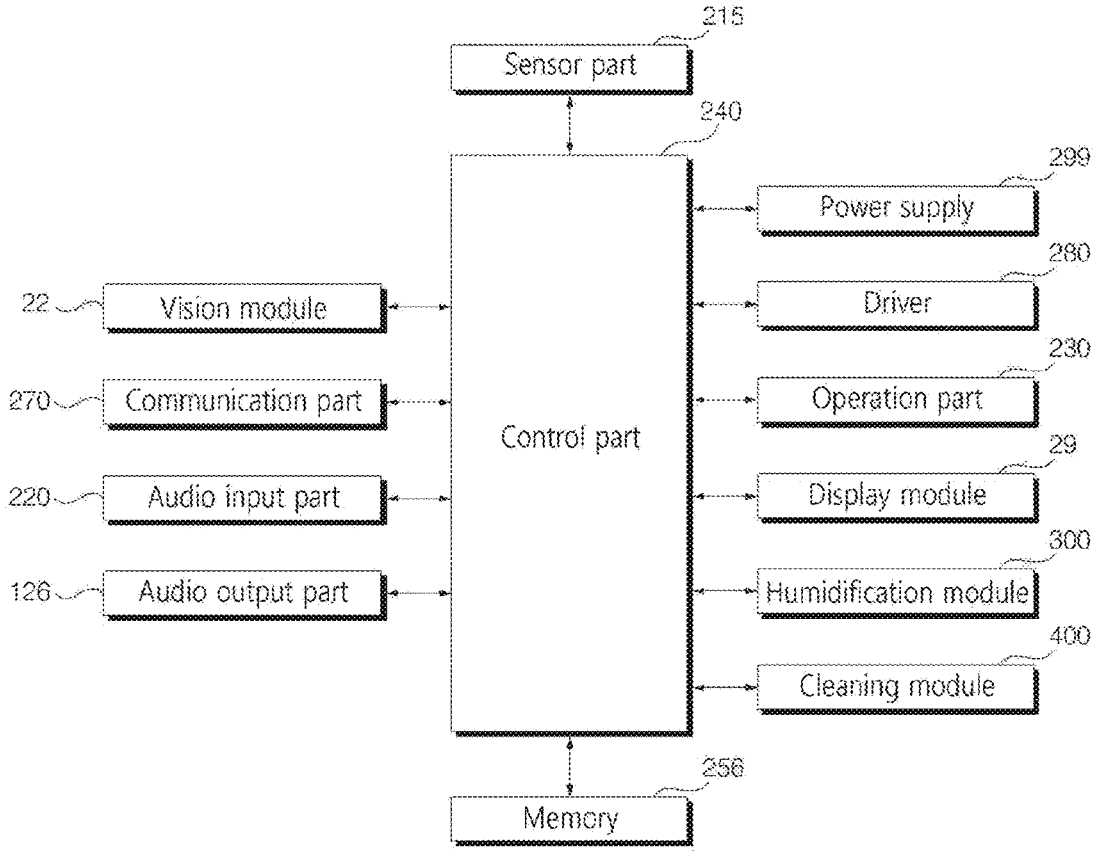
【FIG. 6】
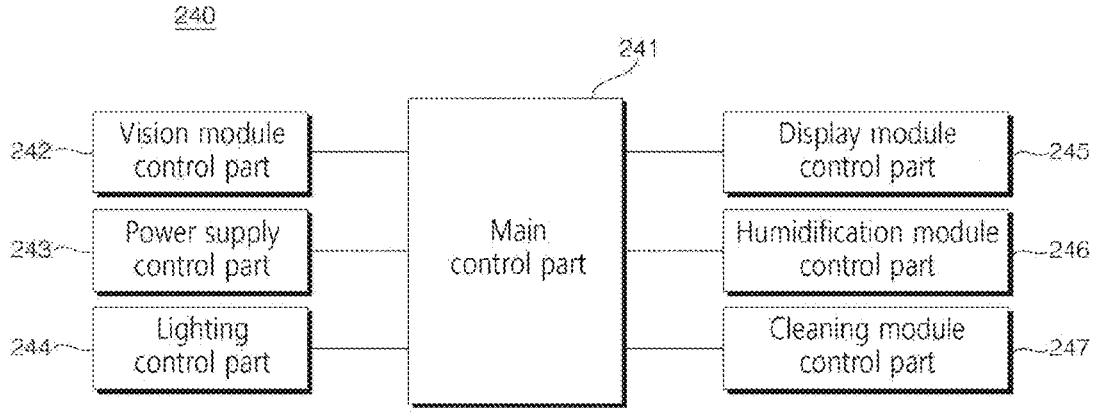

[FIG. 7]
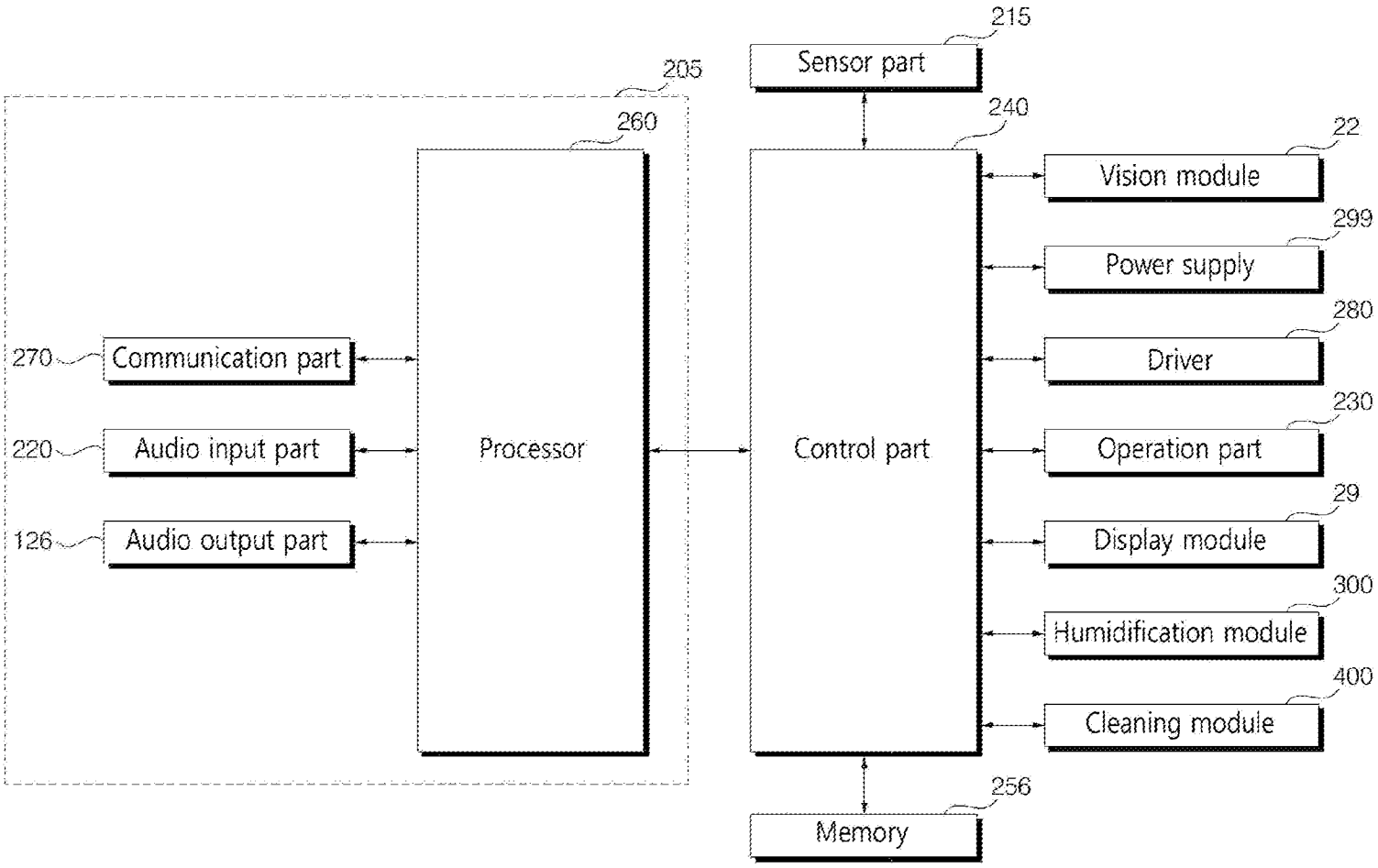

【FIG. 8】
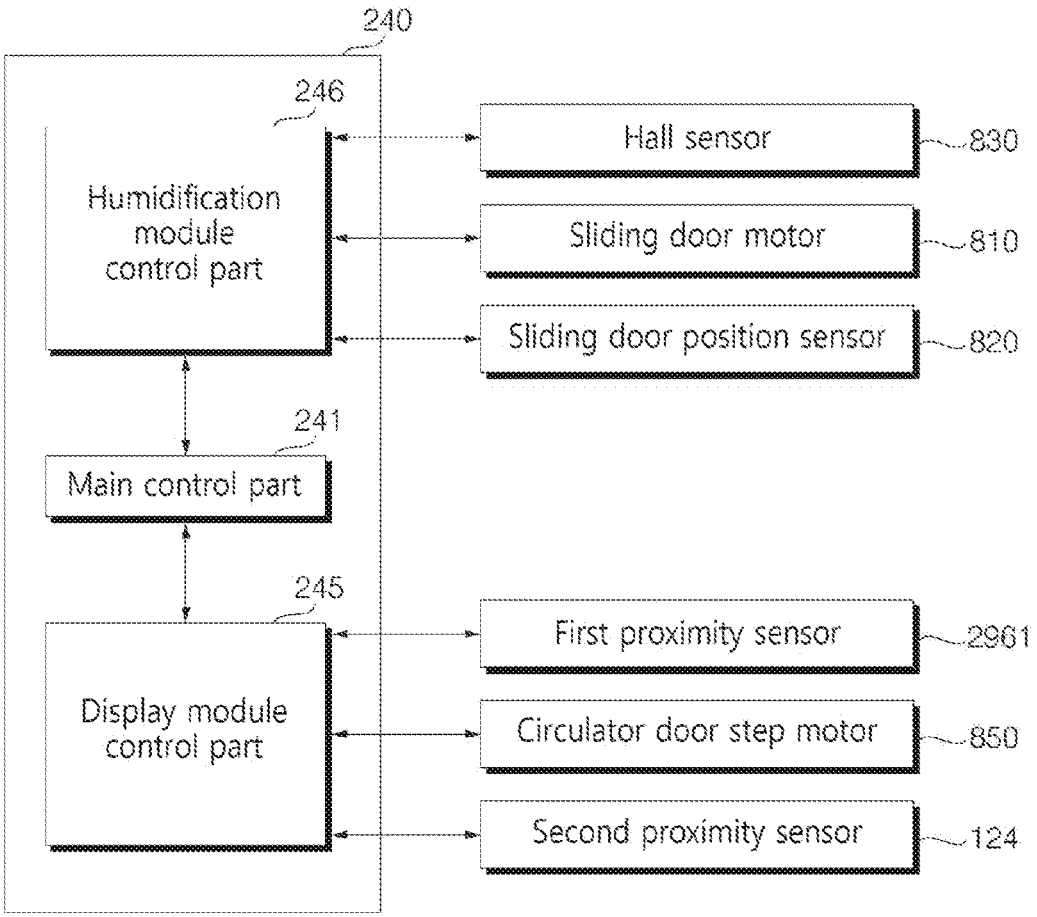

【FIG. 9】
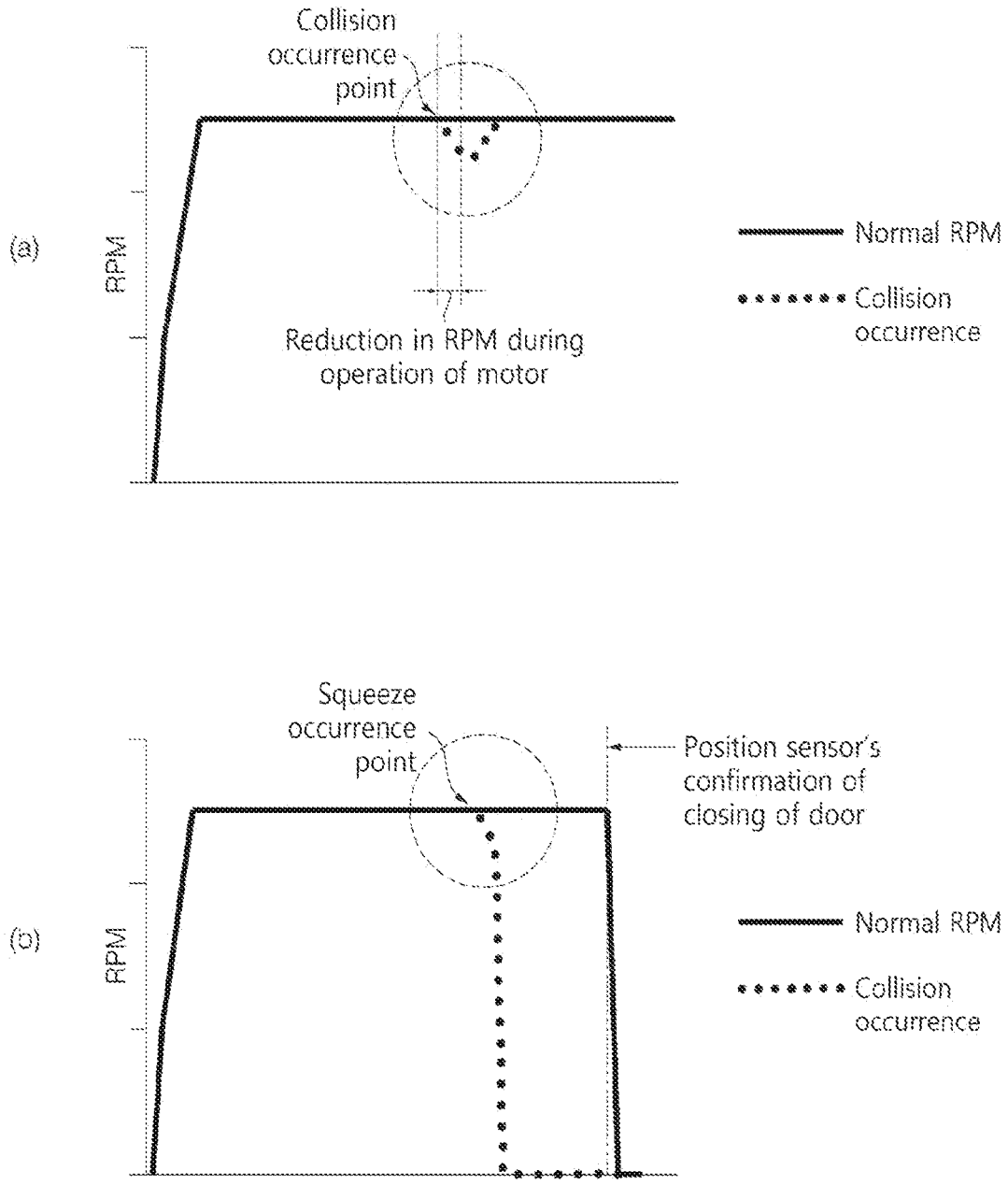

【FIG. 10】
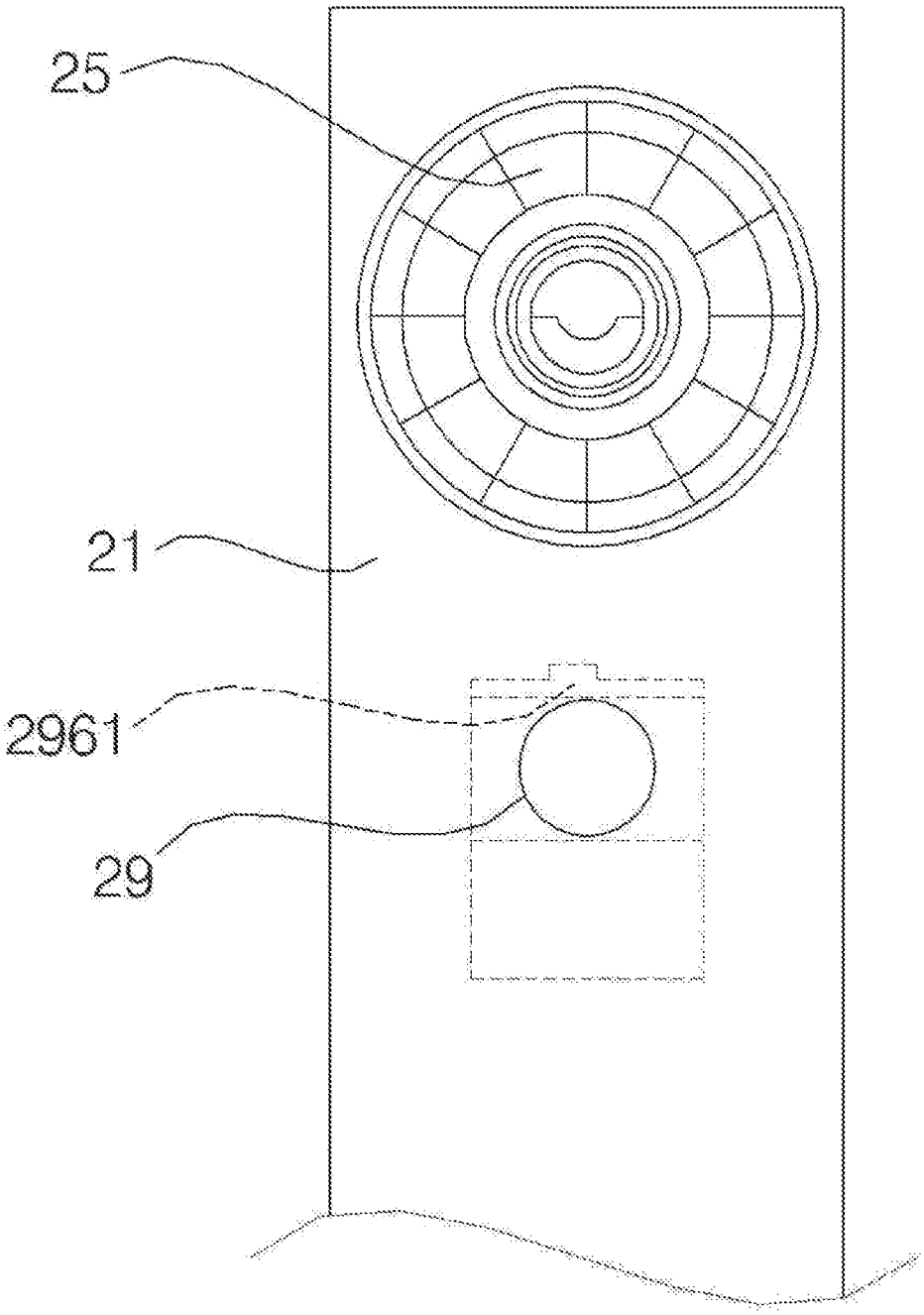

【FIG. 11】
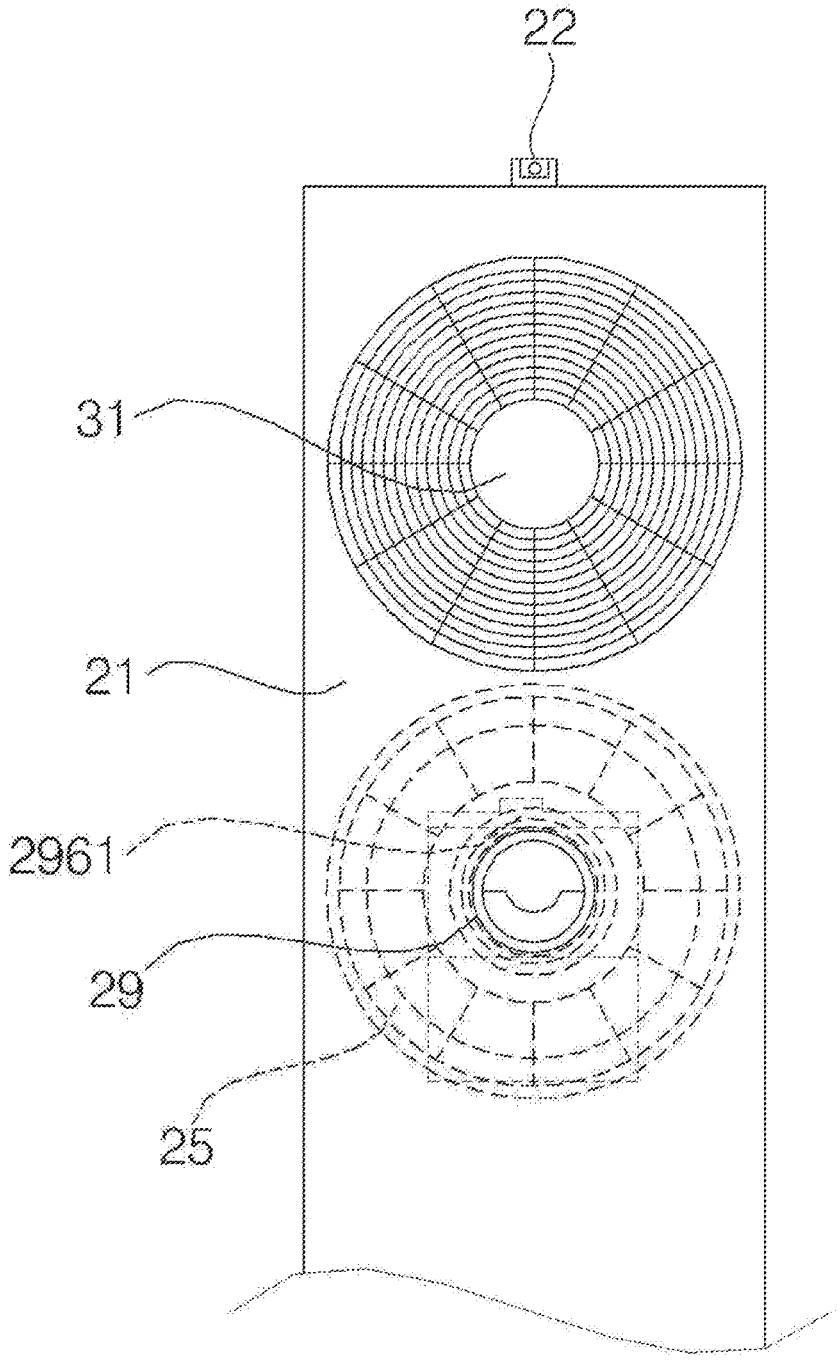

【FIG. 12】
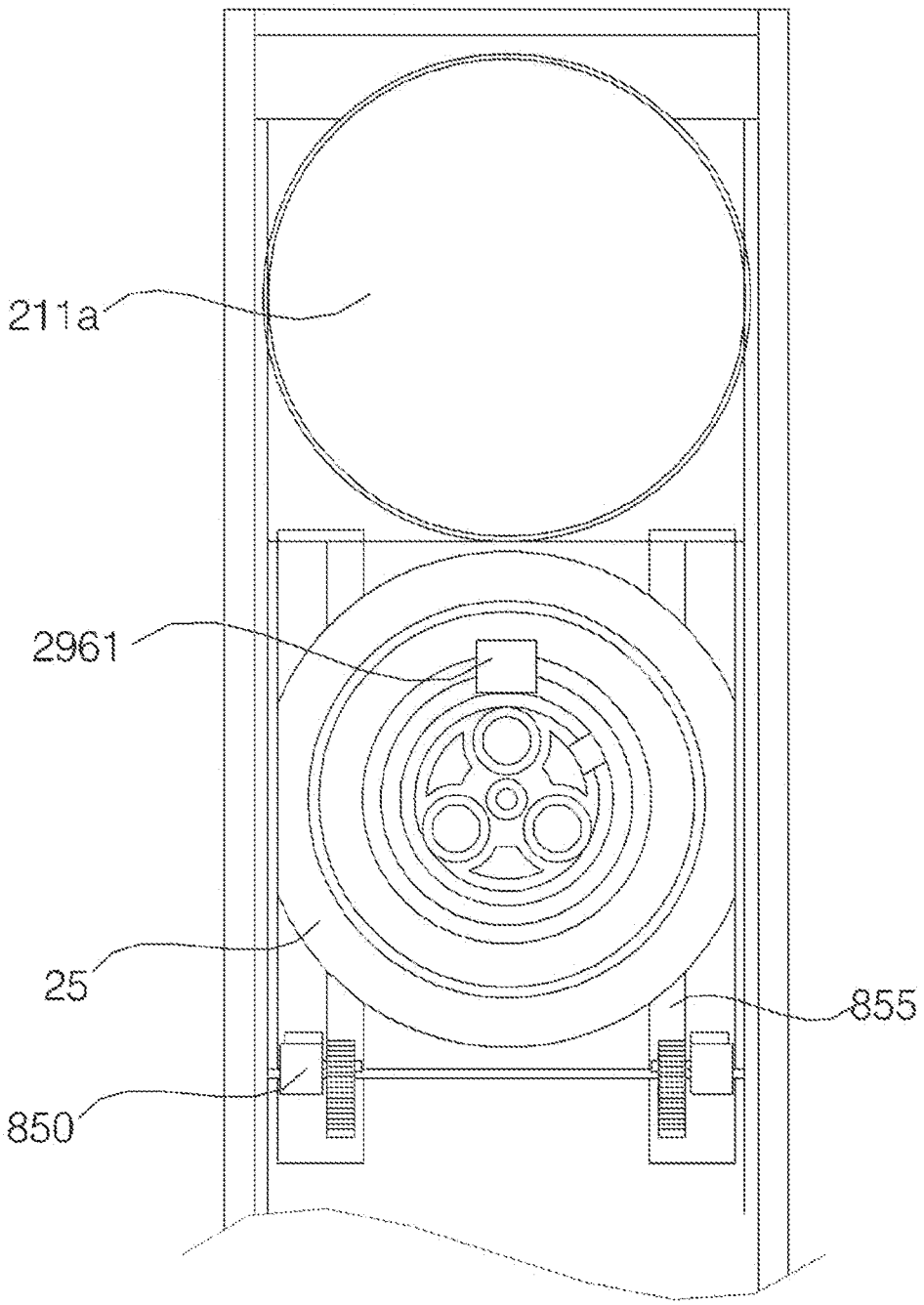

【FIG. 13】
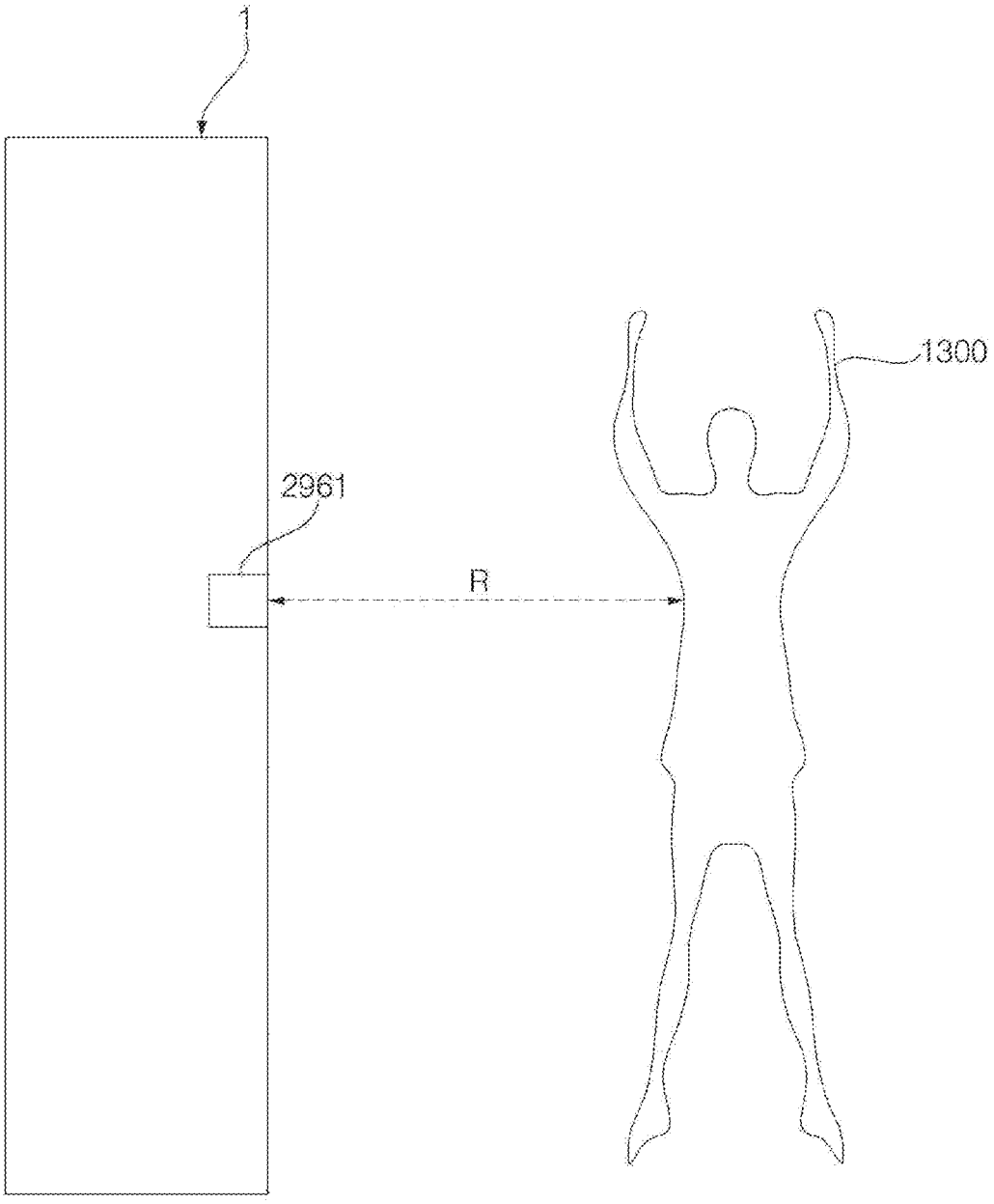

【FIG. 14】
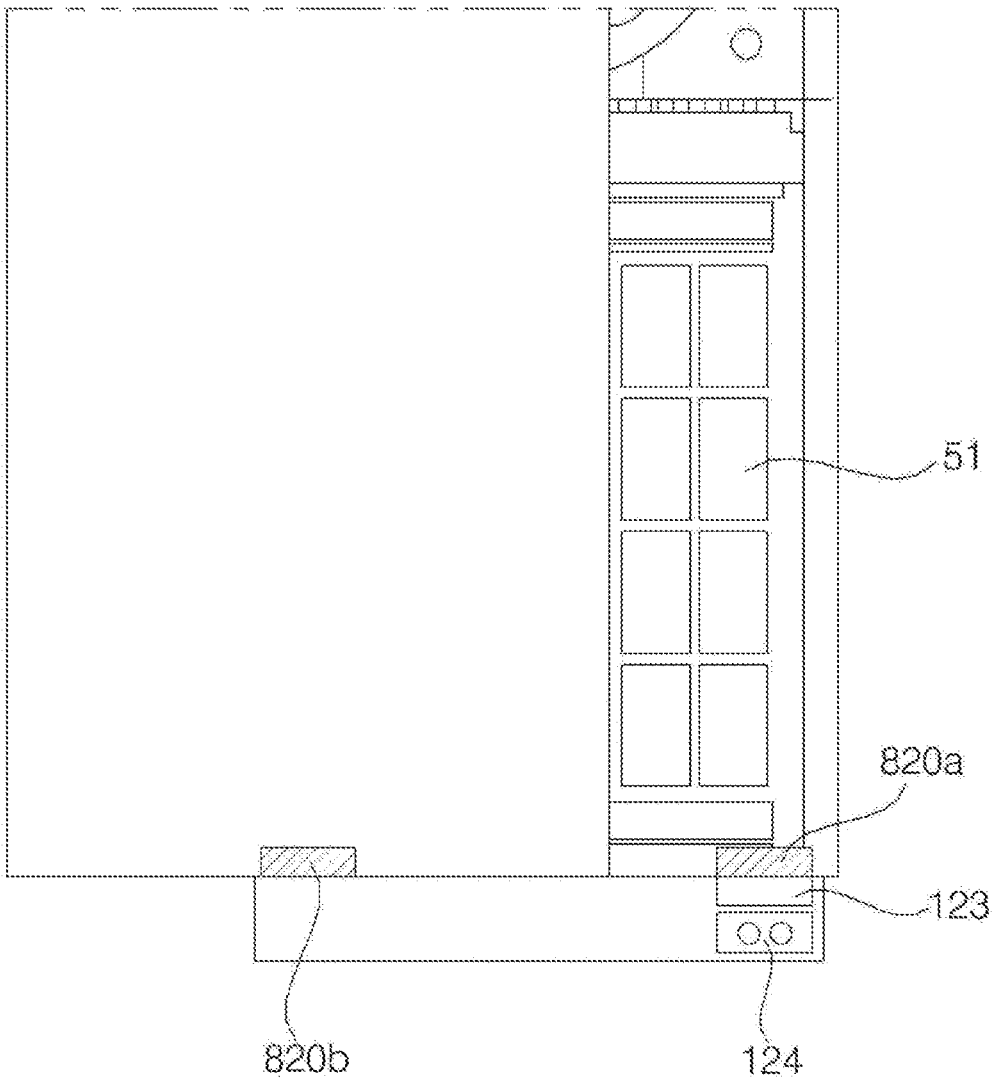

【FIG. 15】
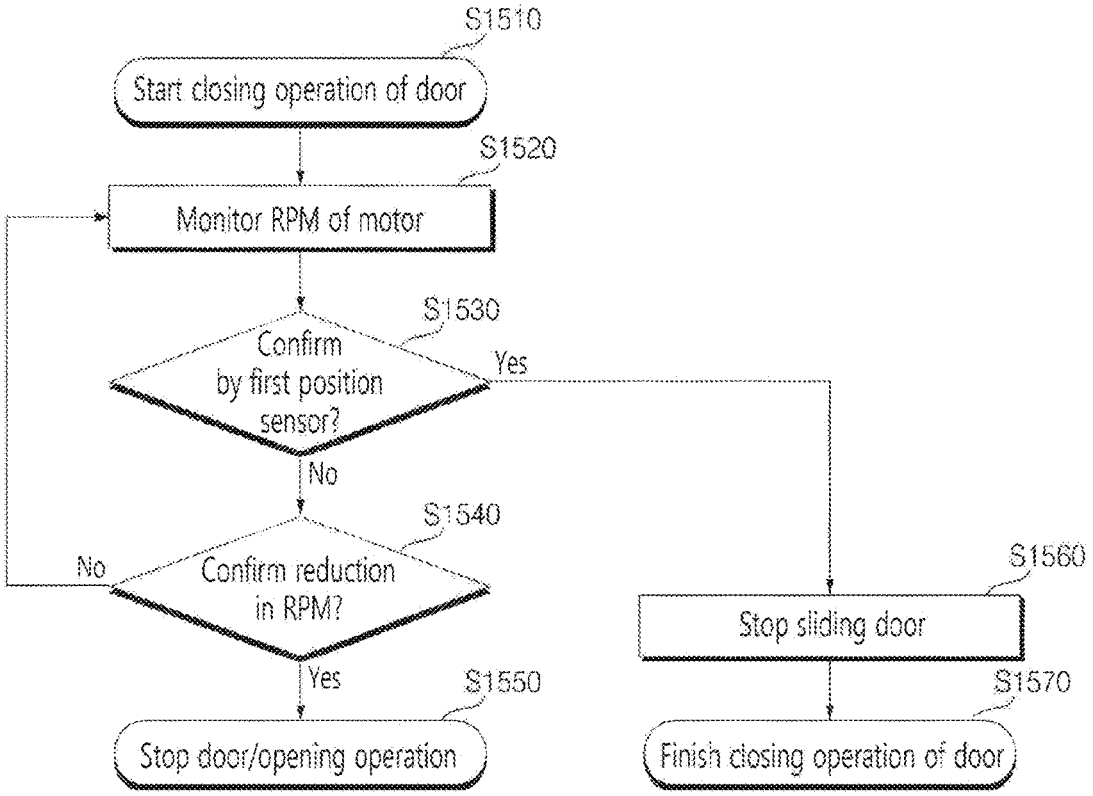

【FIG. 16】
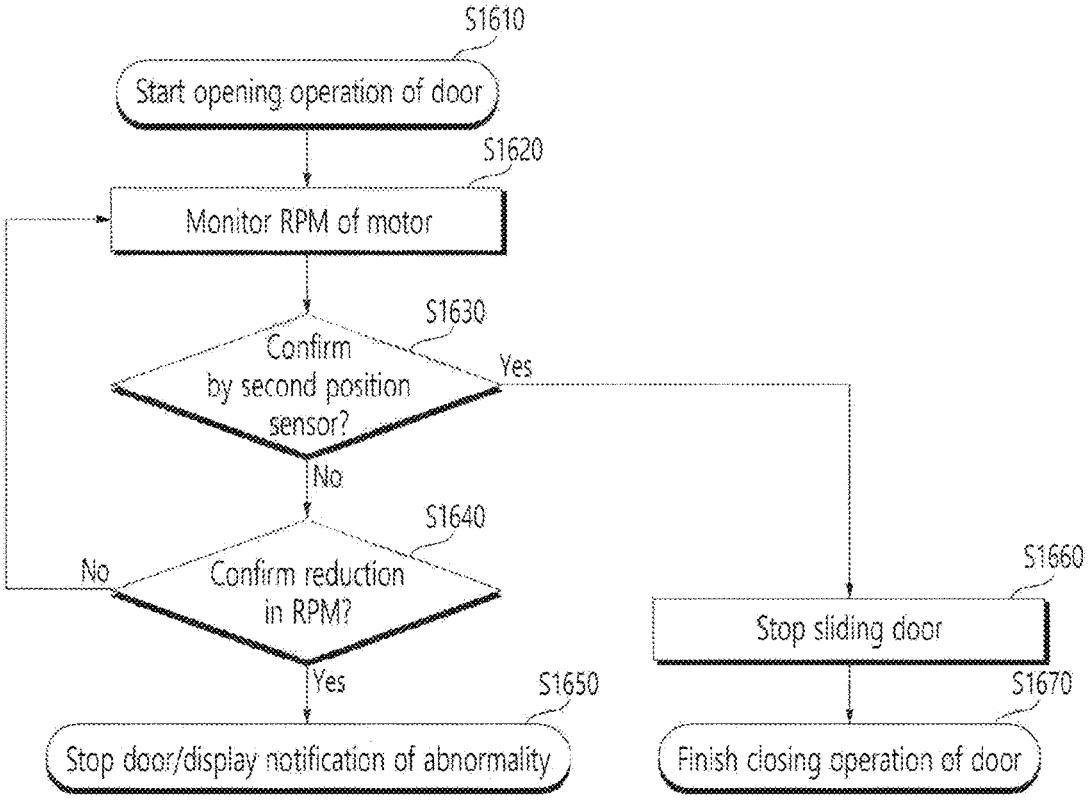

【FIG. 17】
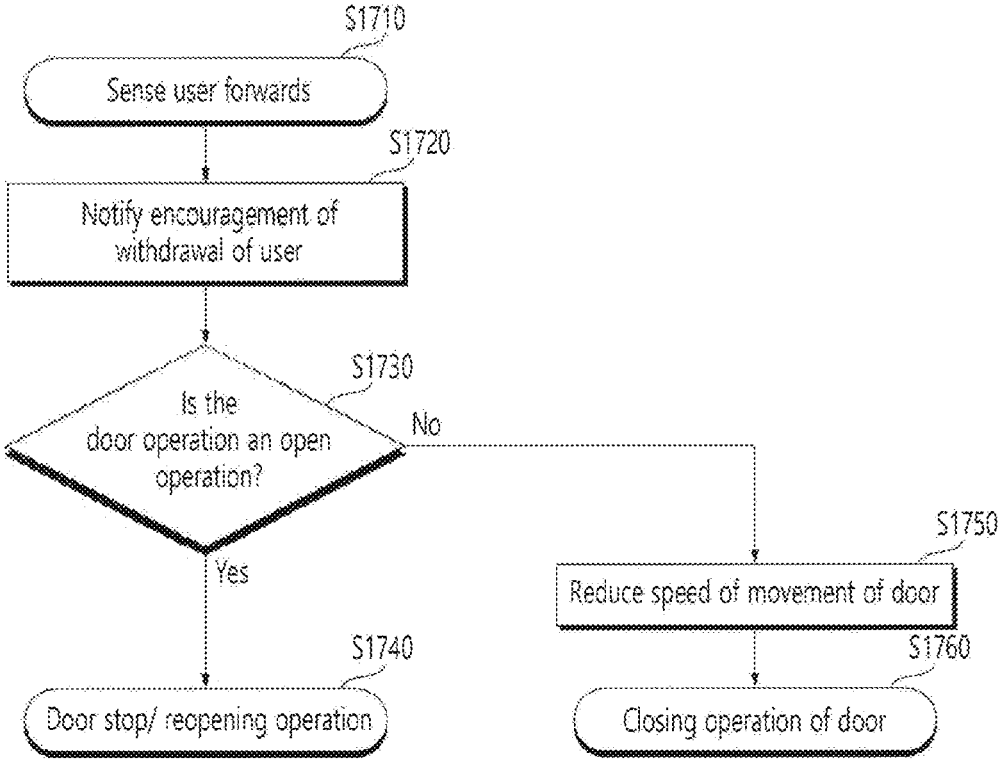

【FIG. 18】
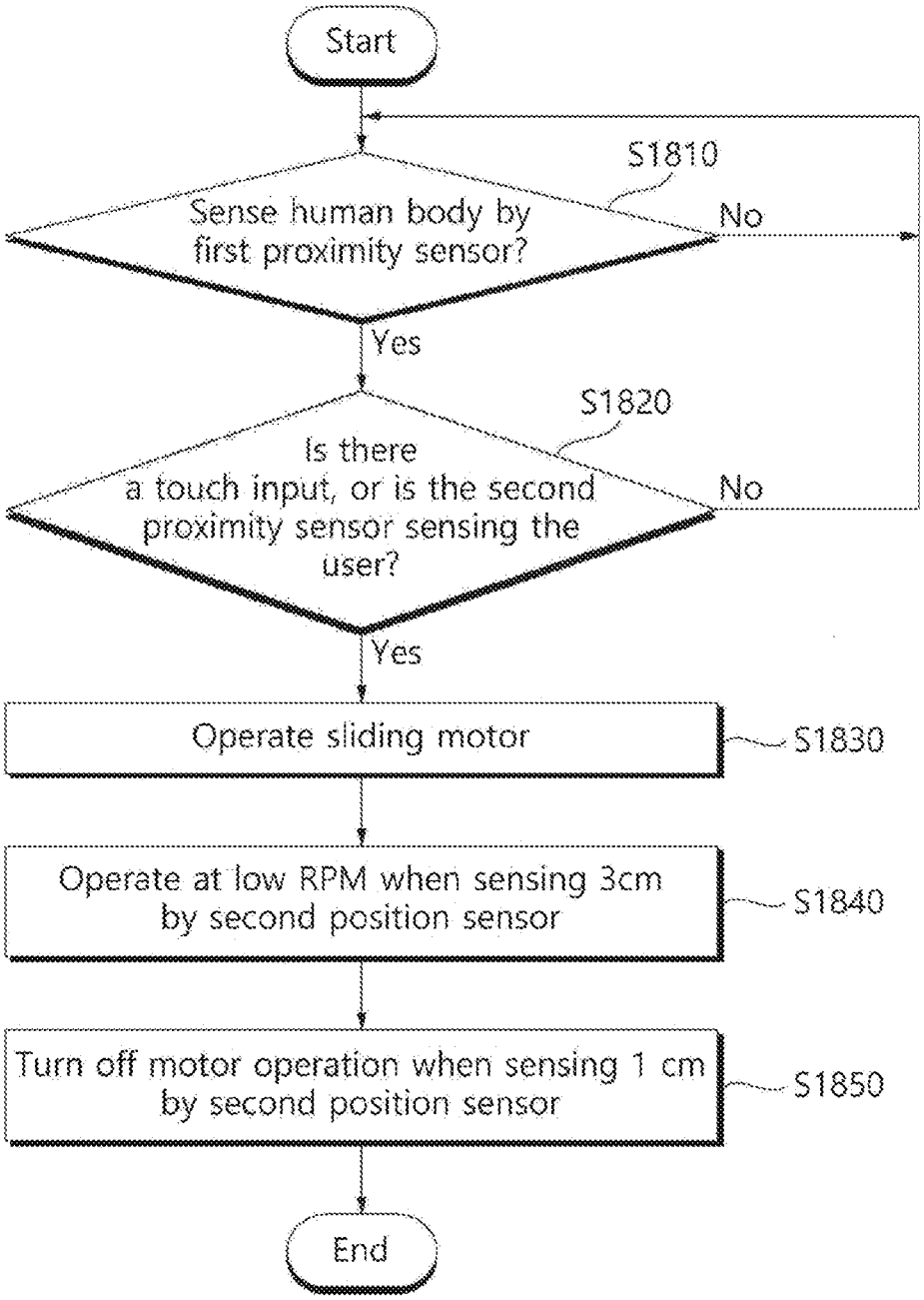

【FIG. 19】
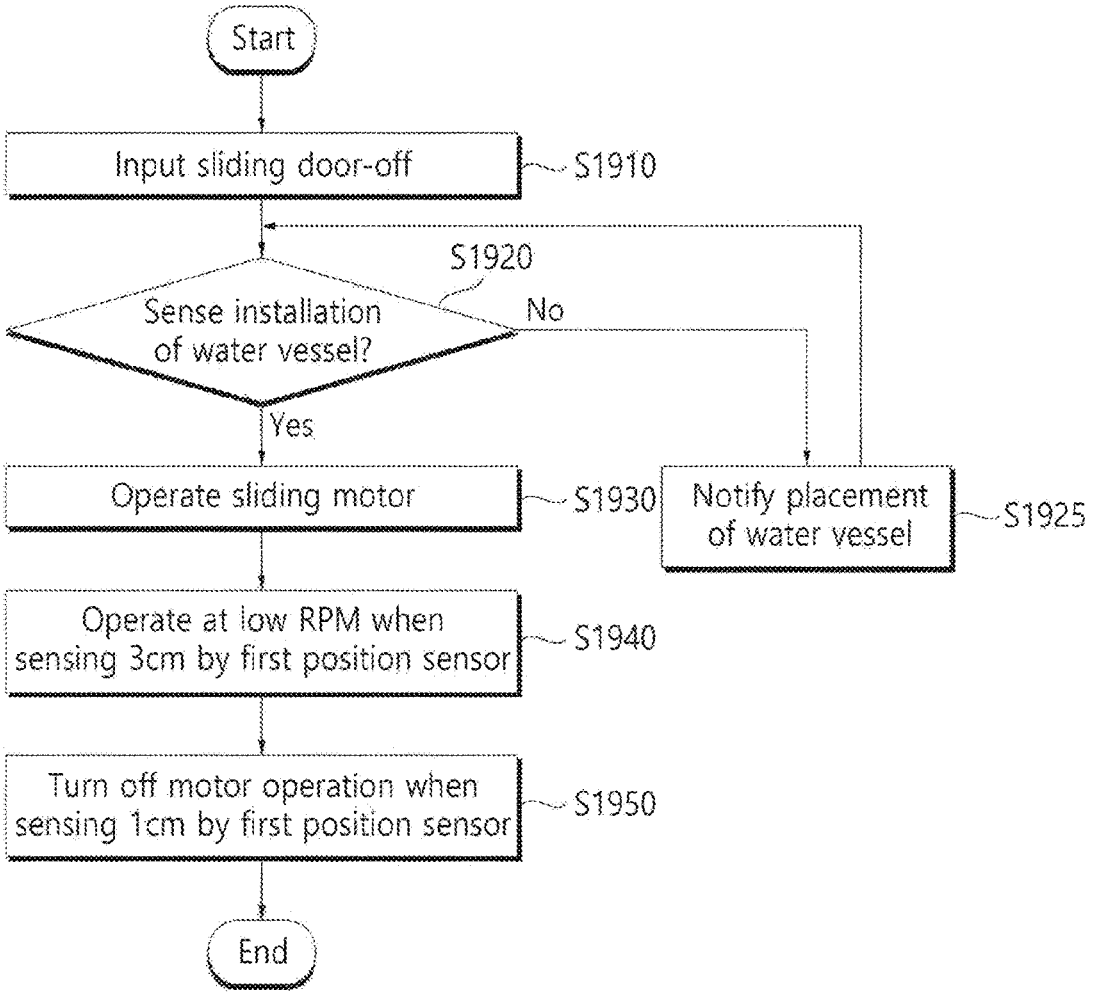

【FIG. 20】
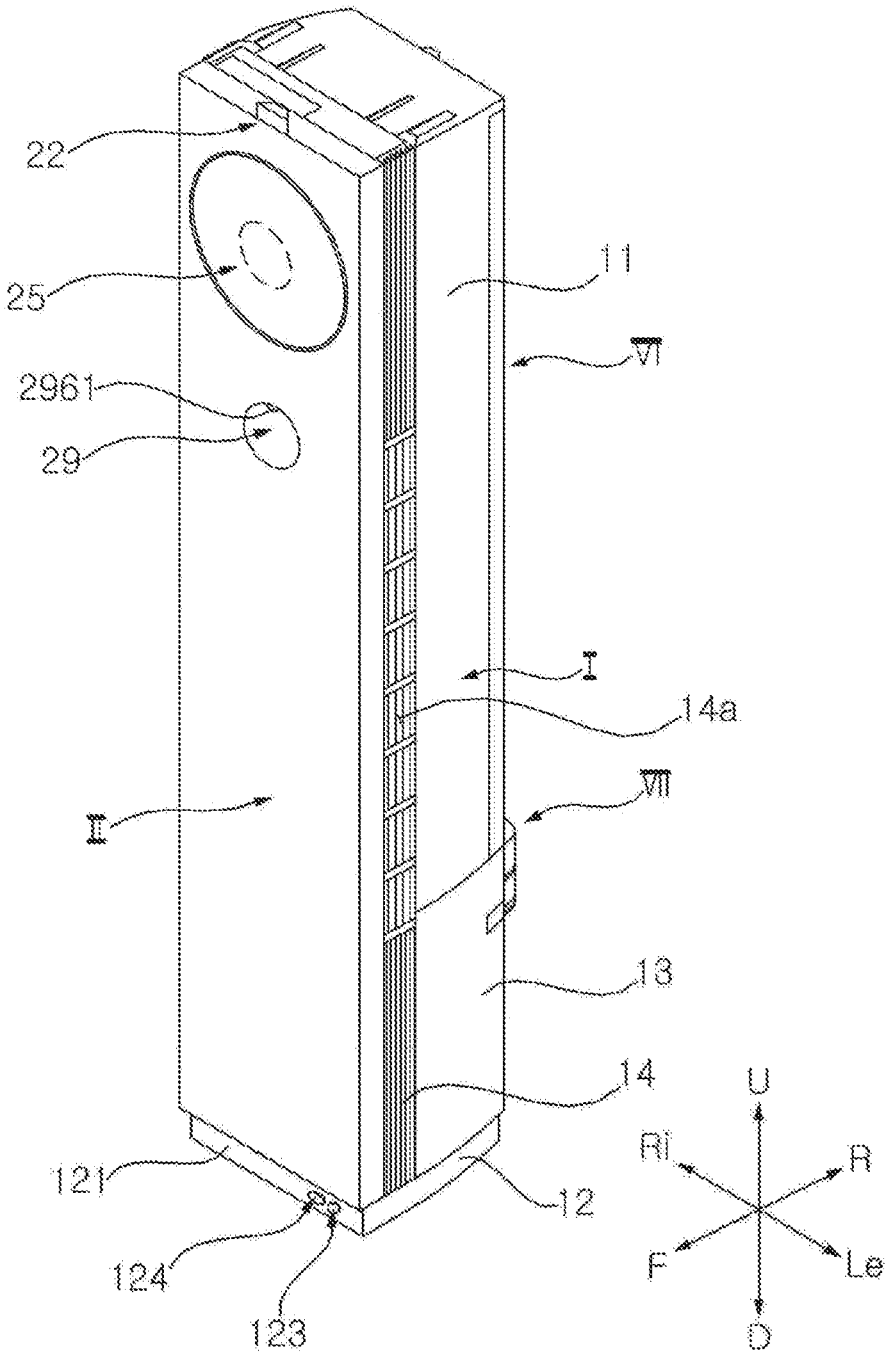

【FIG. 21】
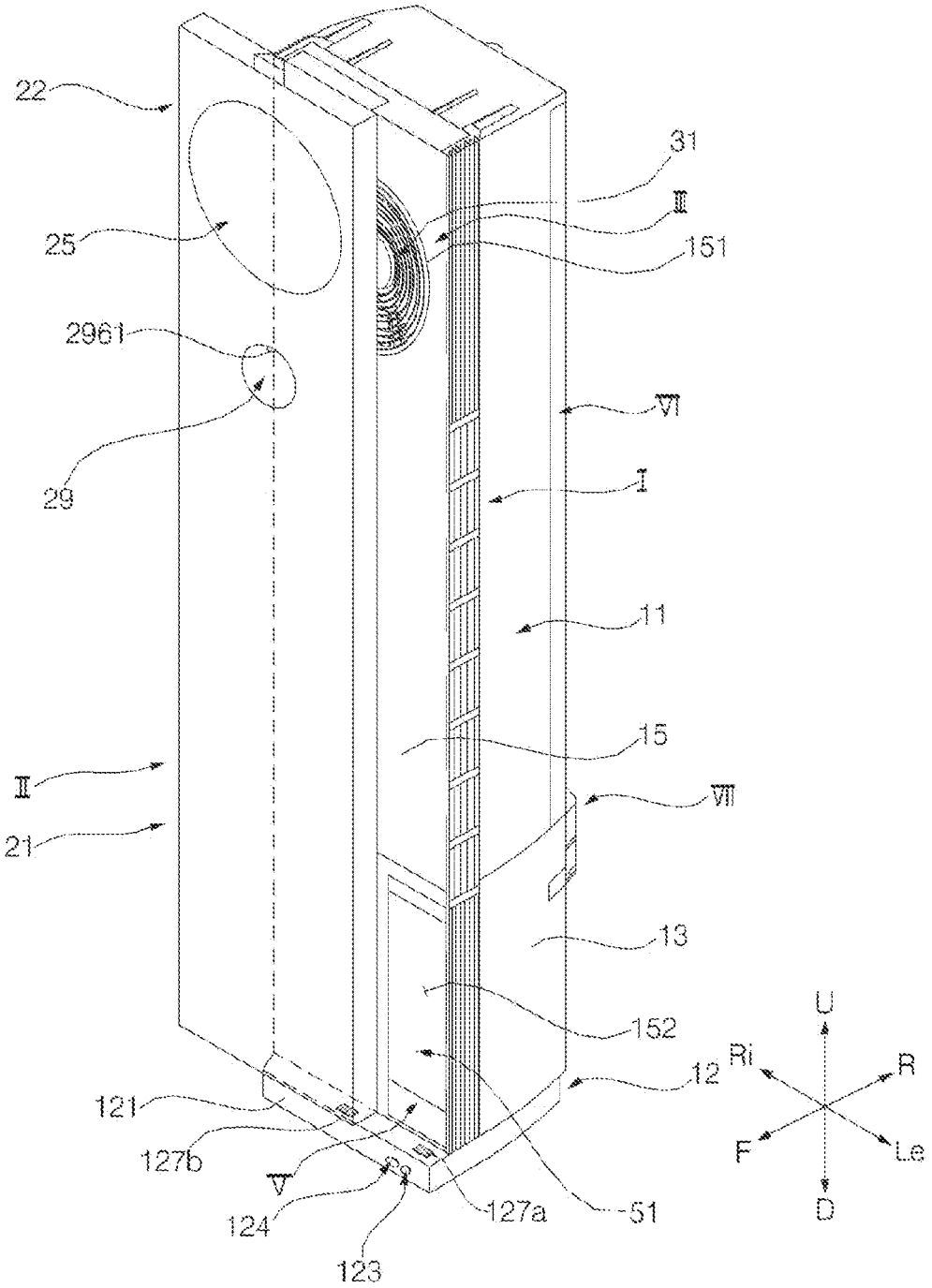

【FIG. 22】
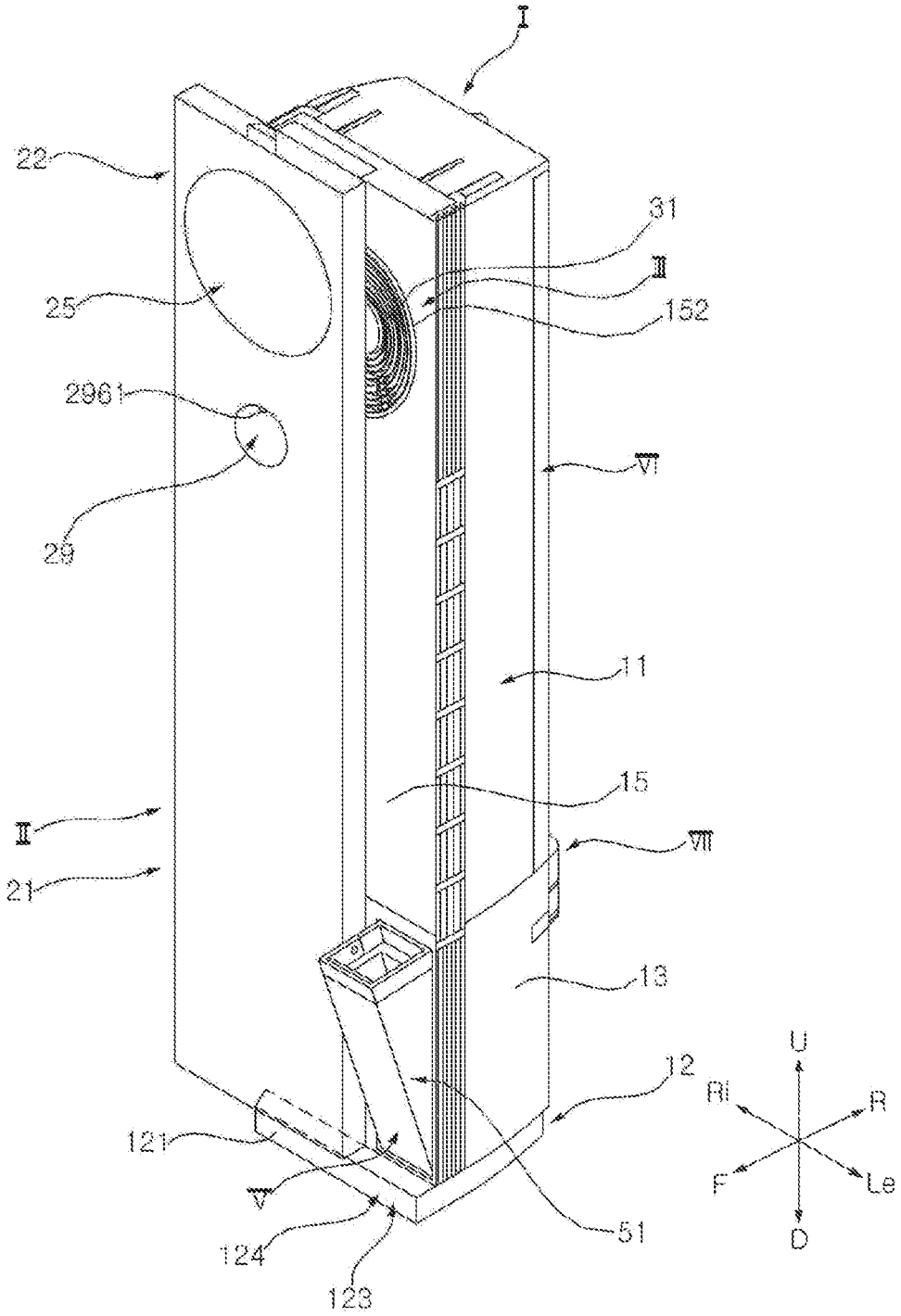

【FIG. 23】
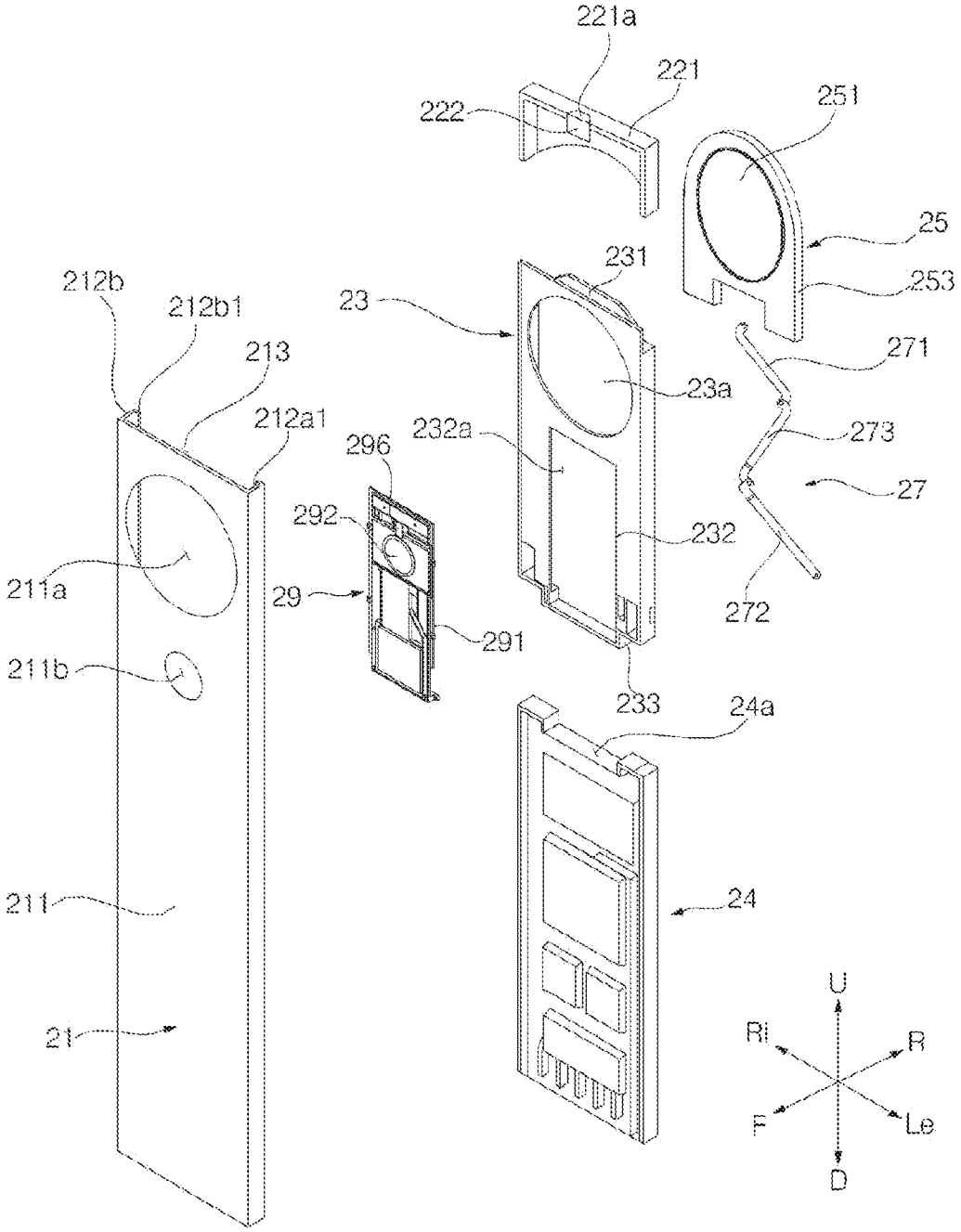

【FIG. 24】
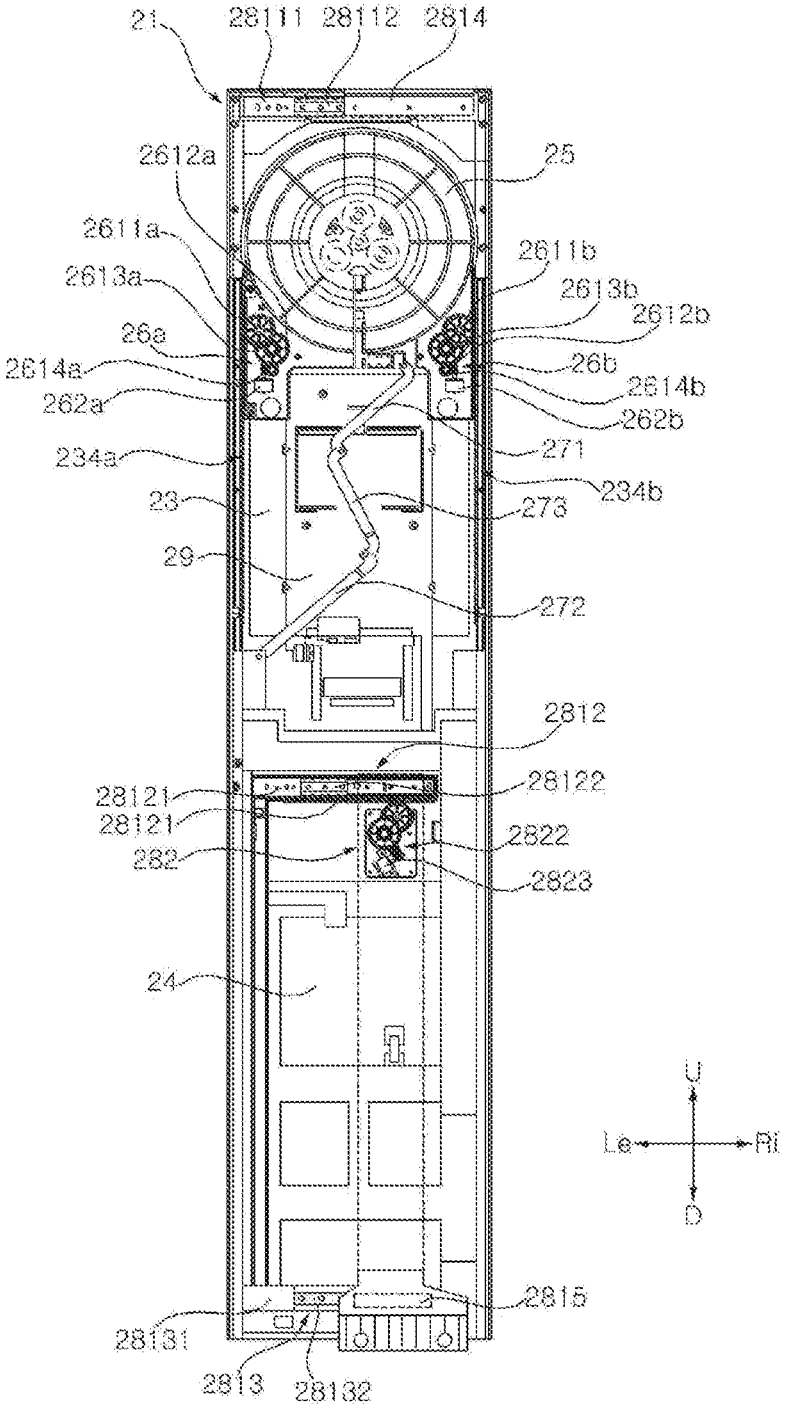

[FIG. 25]
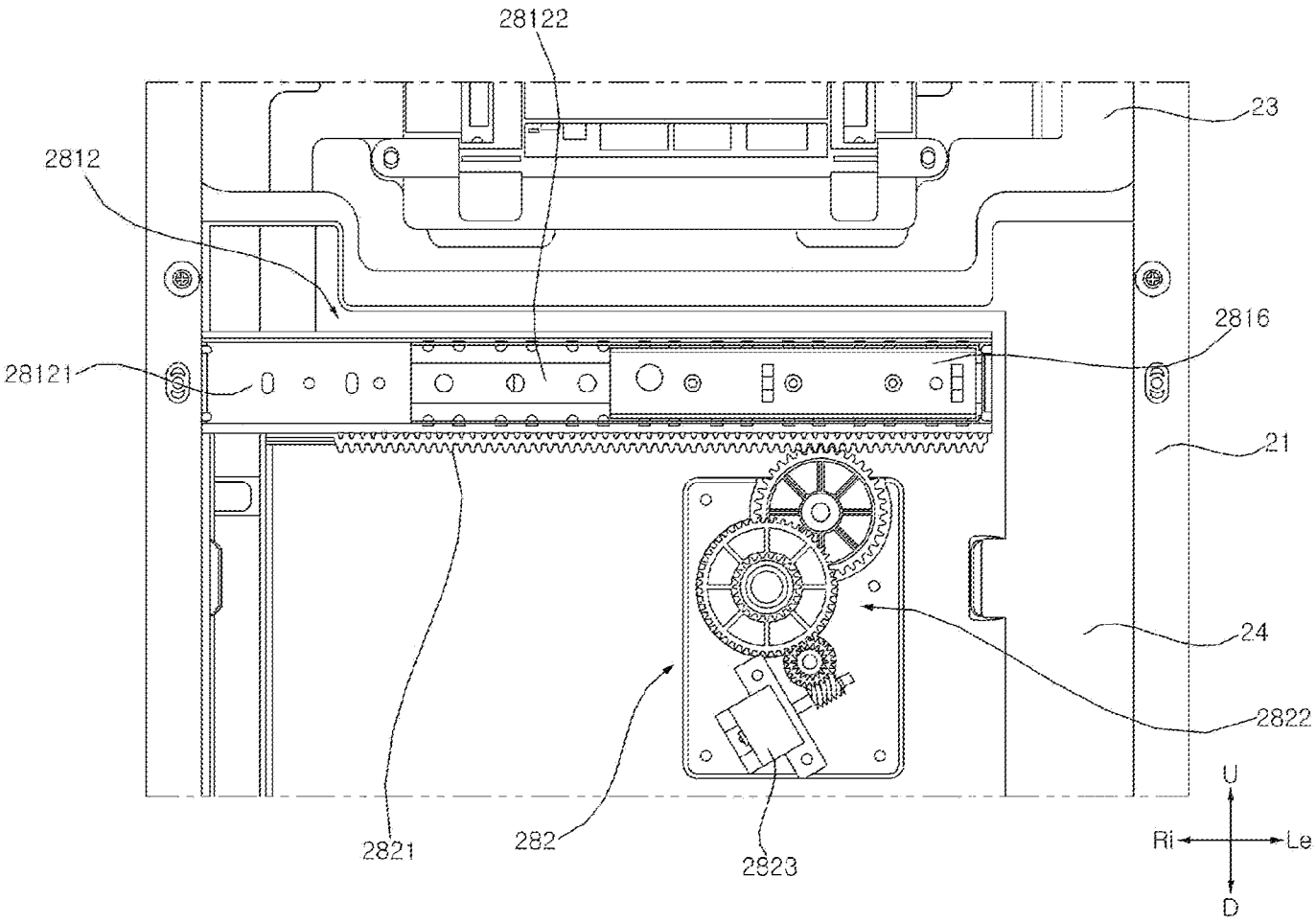

【FIG. 26】
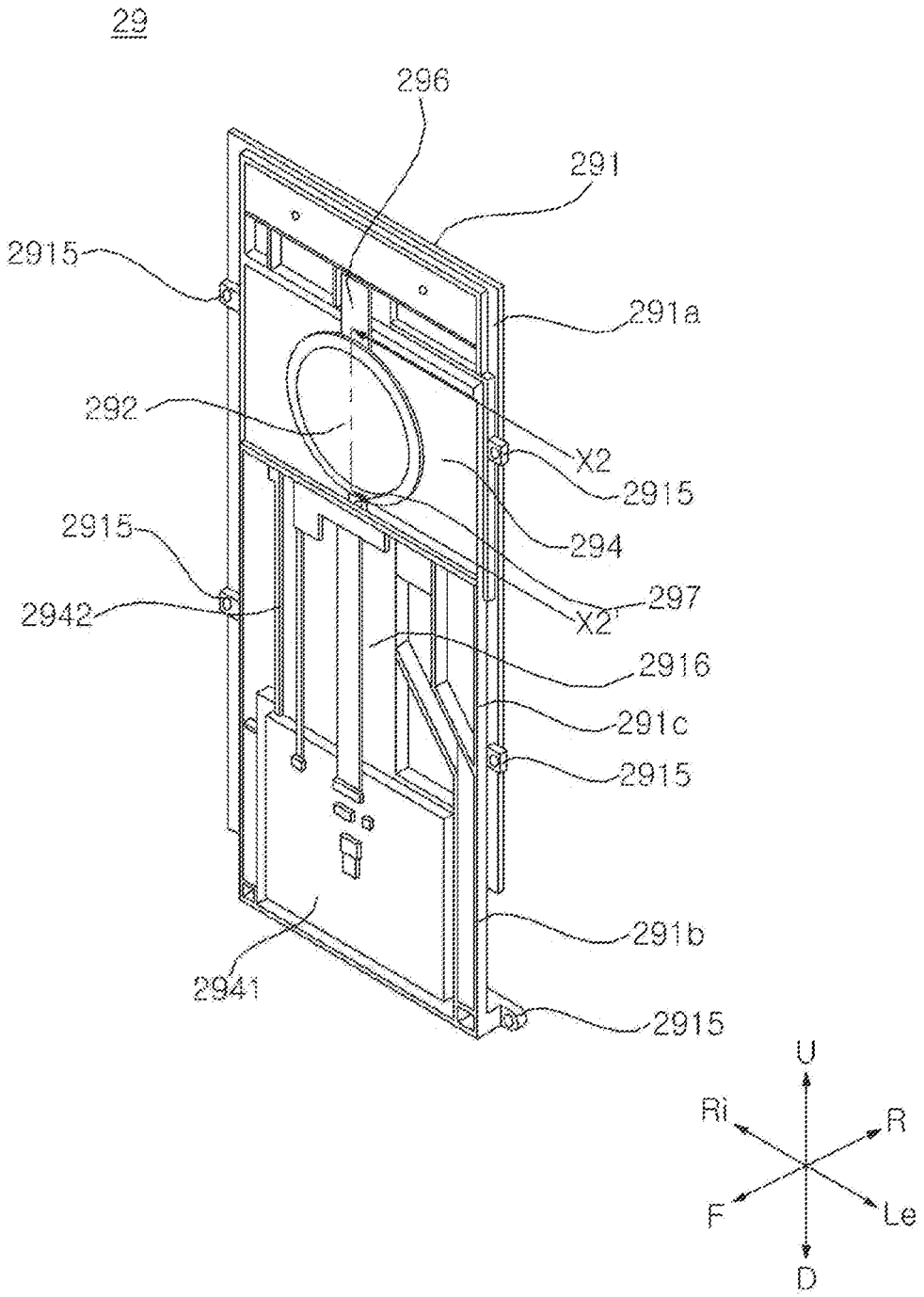

【FIG. 27】
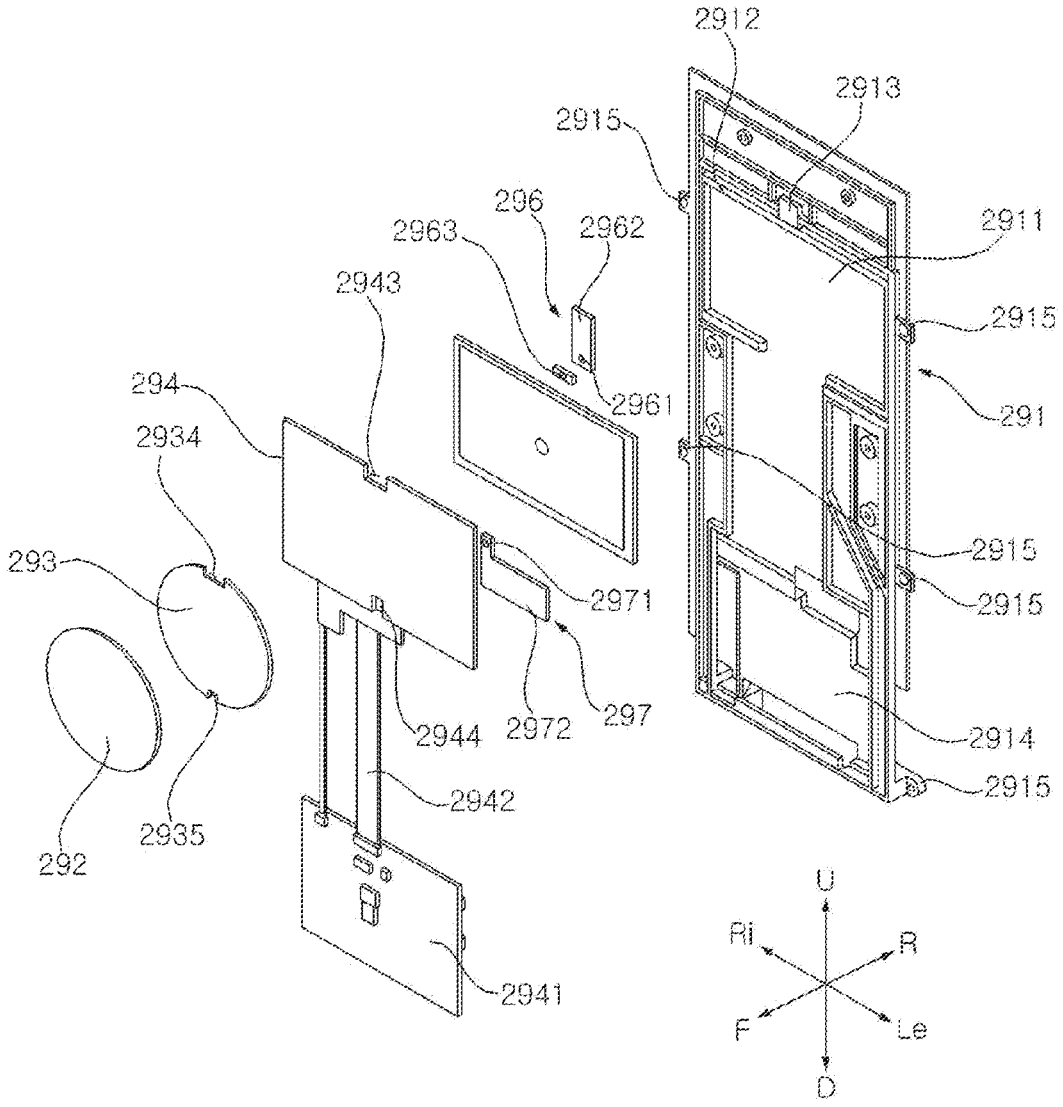

【FIG. 28】
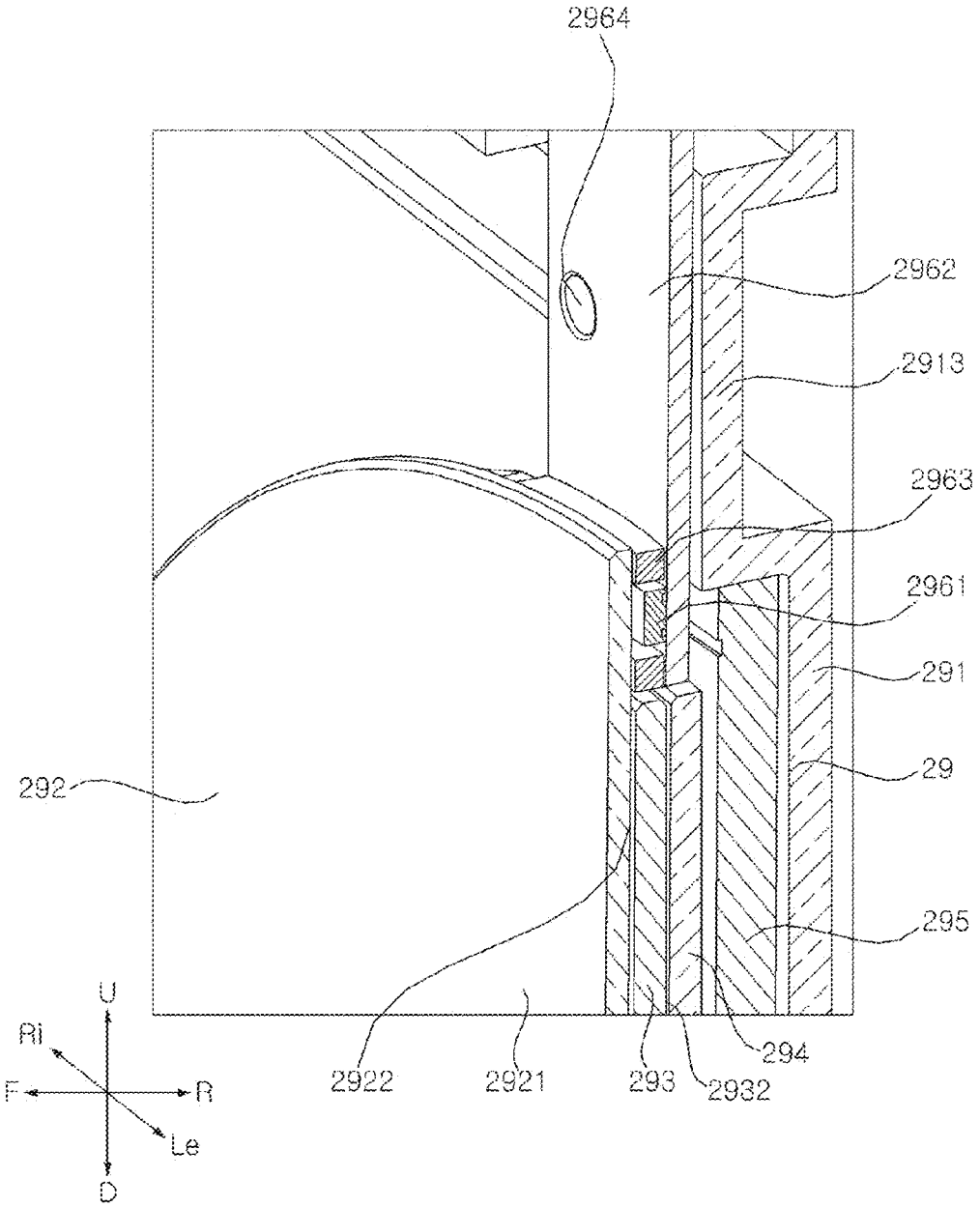

【FIG. 29】
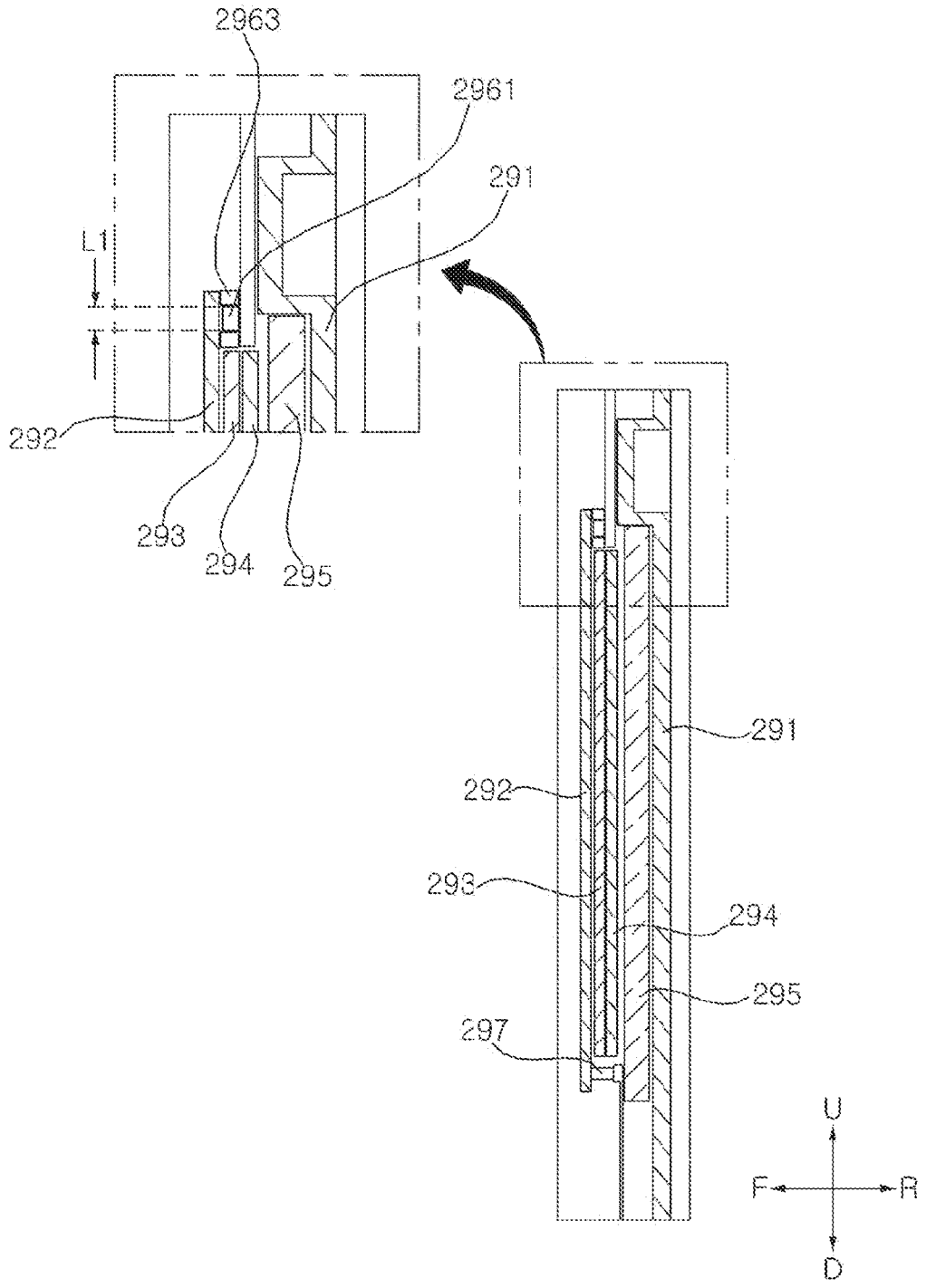

【FIG. 30】
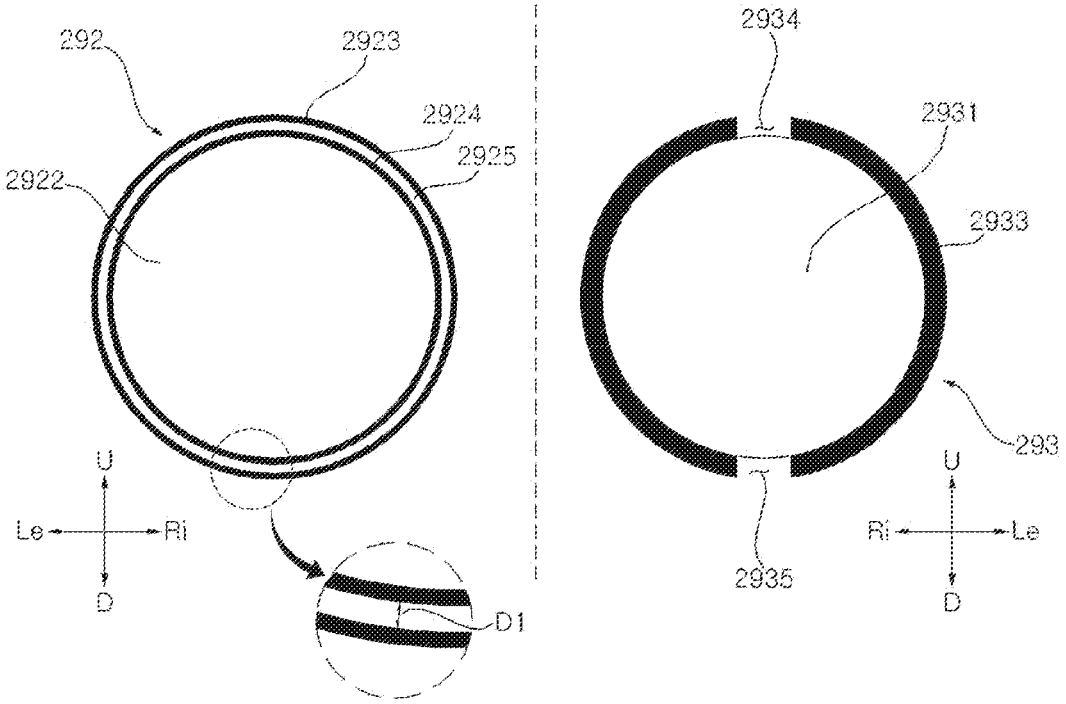

【FIG. 31】
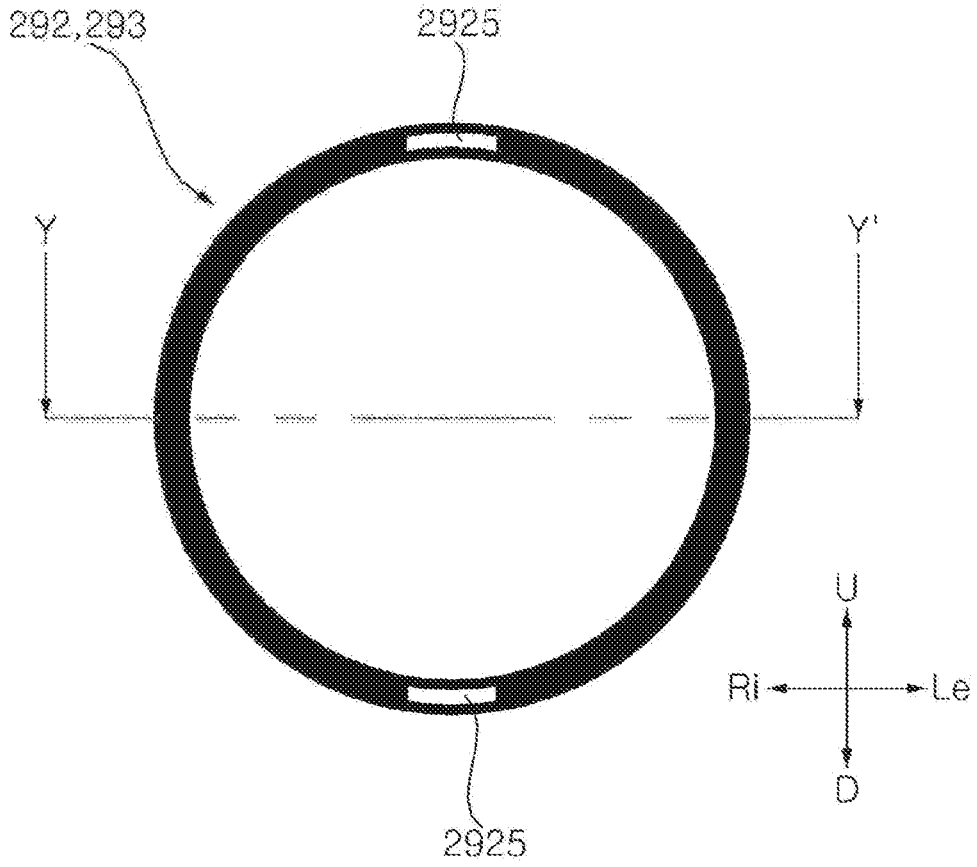

【FIG. 32】
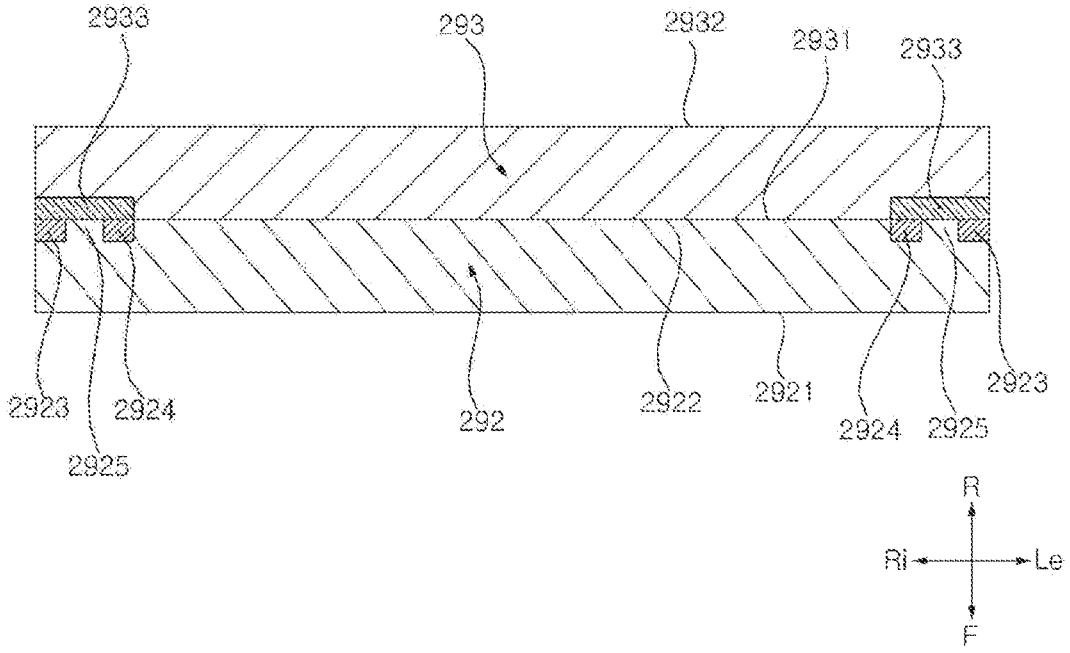

【FIG. 33】
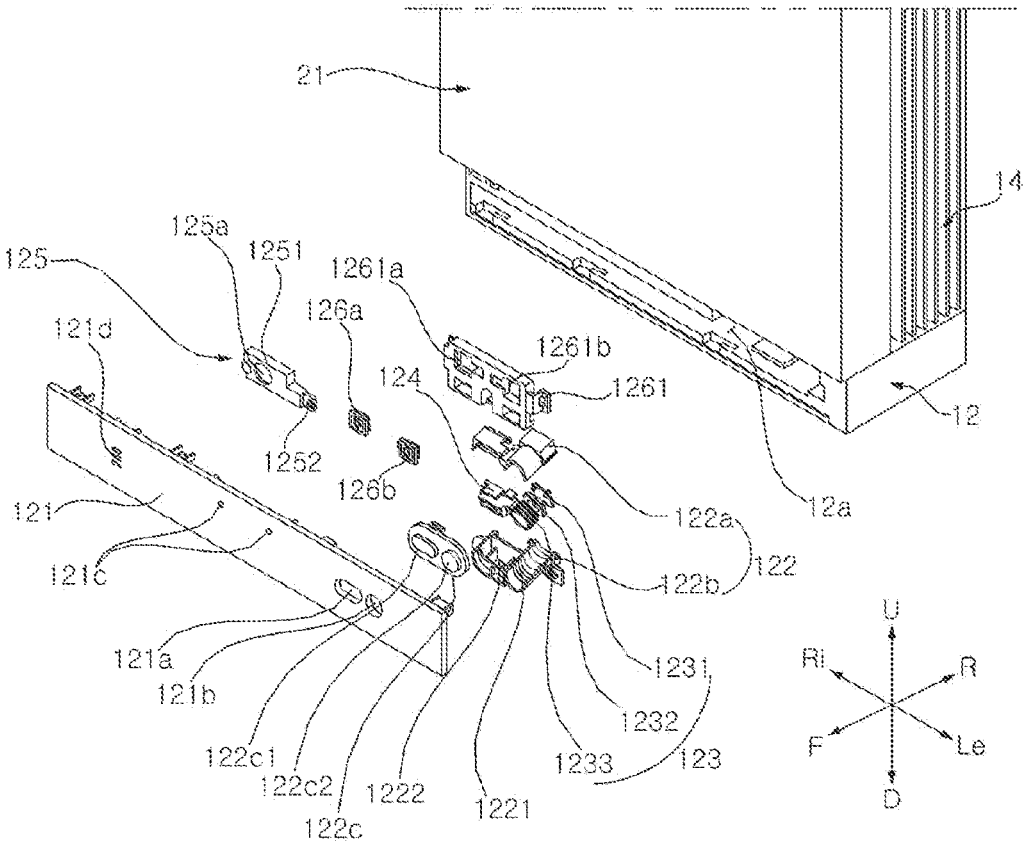
【FIG. 34】
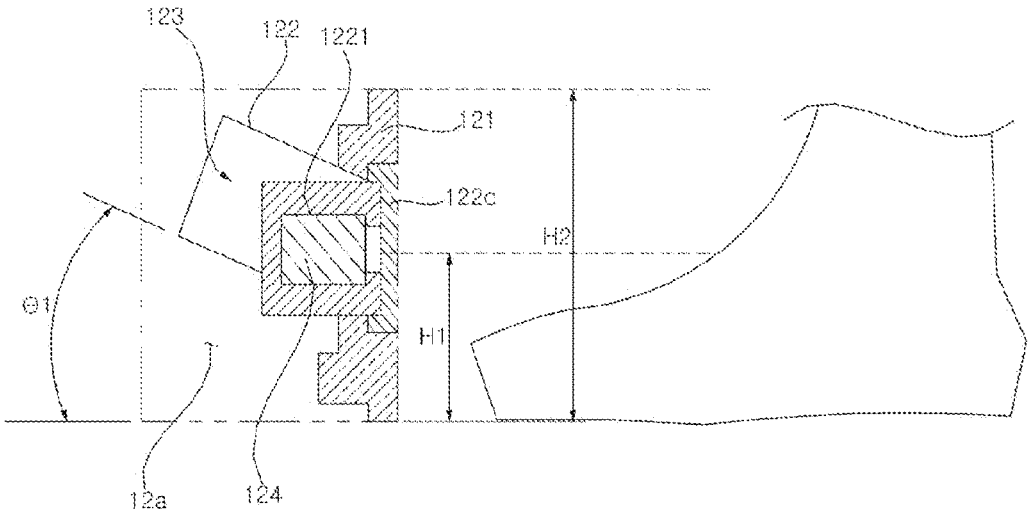

【FIG. 35】
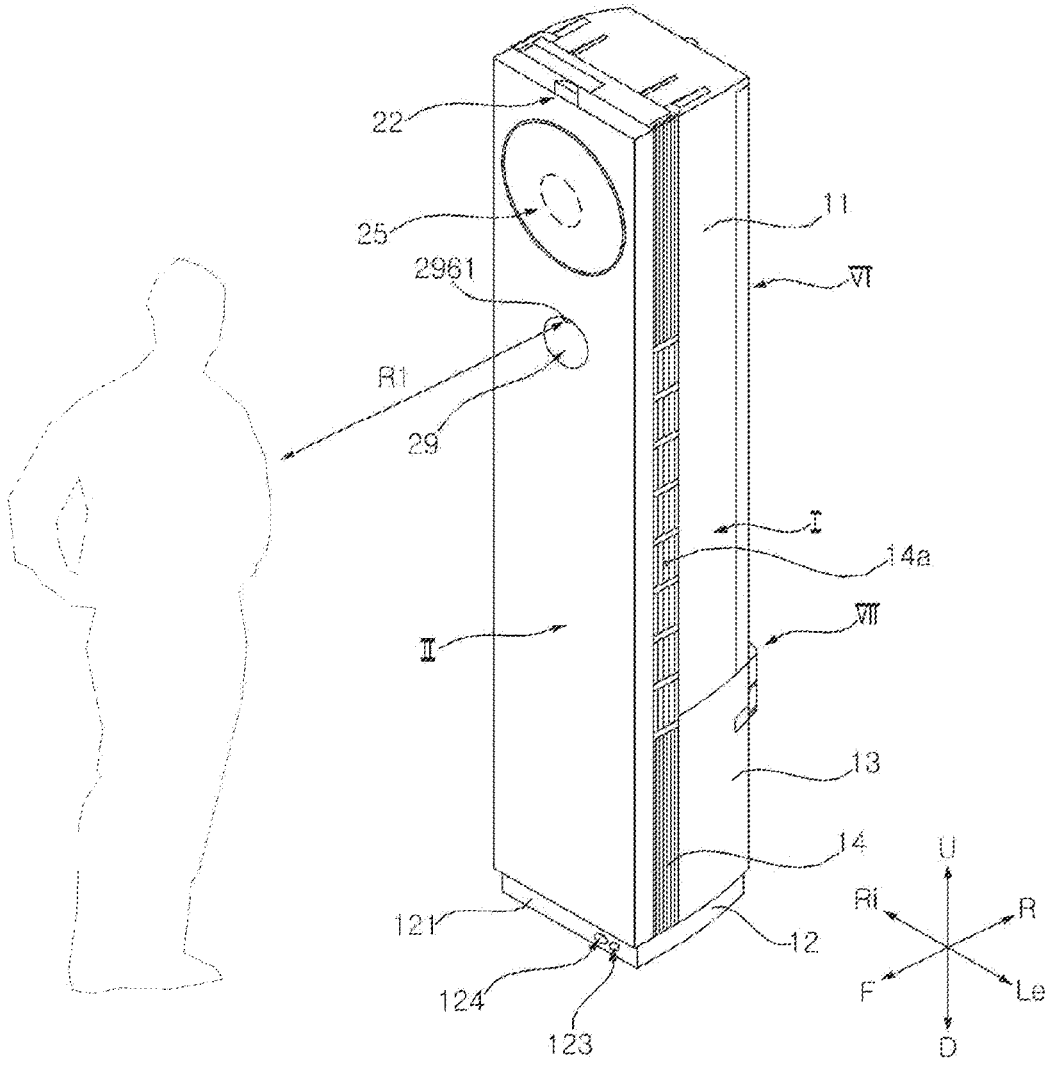

【FIG. 36】
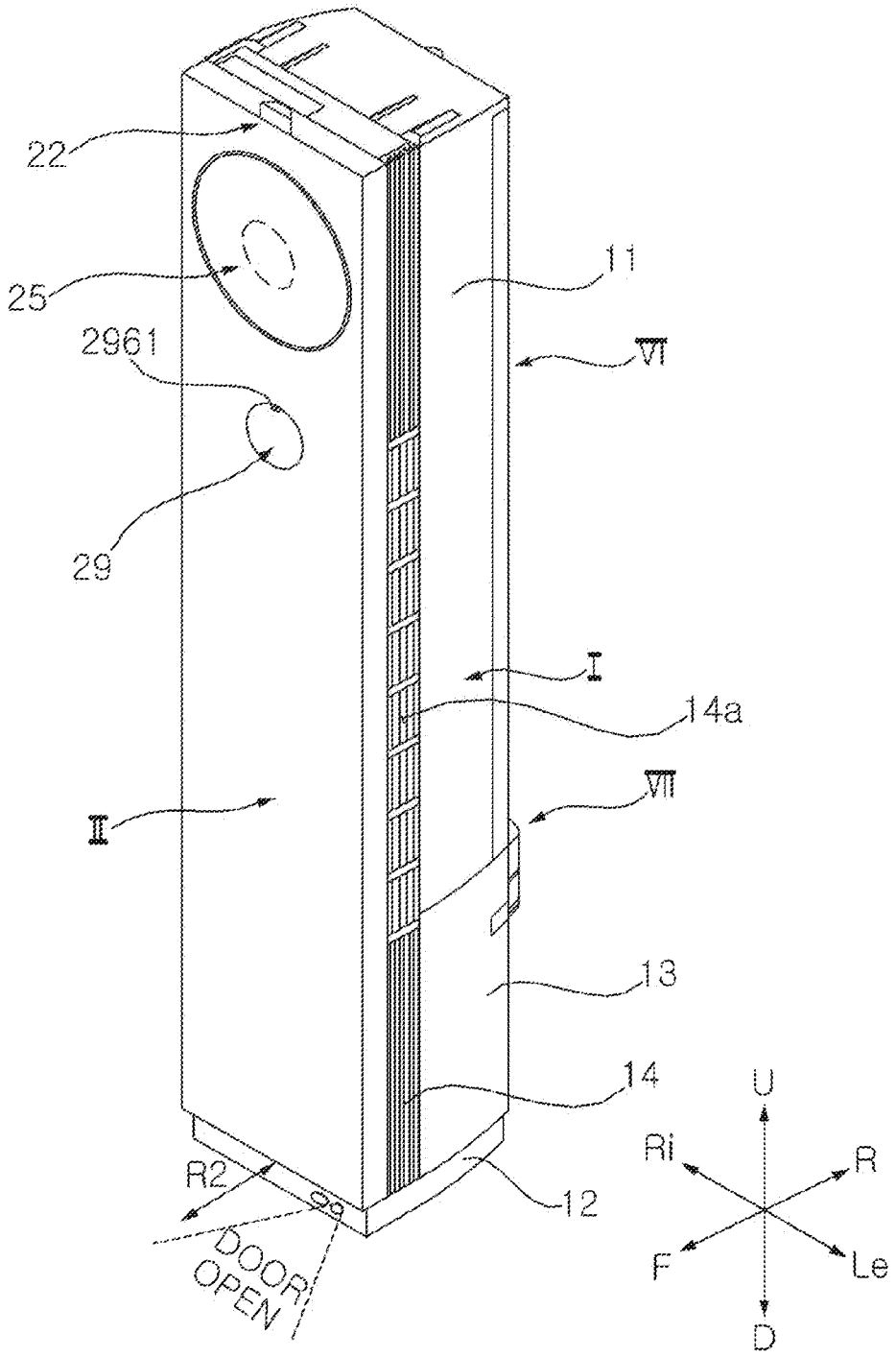

AIR CONDITIONER

CROSS-REFERENCE TO RELATED APPLICATION

This application is a Continuation of U.S. patent application Ser. No. 16/978,126, filed Sep. 3, 2020, which is a National Stage Application of International Application No. PCT/KR2019/002674, filed on Mar. 7, 2019, which claims benefit of and priority to Korean Patent Application Nos.: KR10-2018-0026994, filed on Mar. 7, 2018, KR10-2018-0026990, filed on Mar. 7, 2018, and KR10-2019-0024361, filed on Feb. 28, 2019, all of which are hereby incorporated by reference in their entirety for all purposes as if fully set forth herein.

TECHNICAL FIELD

Disclosed herein is an air conditioner and a control method thereof, and more particularly, an air conditioner and a control method thereof capable of efficiently controlling air current.

BACKGROUND

Air conditioners are devices that may discharge cool-temperature air to an indoor space, adjust indoor temperature, and purify indoor air to provide a clean and pleasant environment for people.

In general, they include an indoor unit, which is comprised of a heat exchanger and is placed indoors, and an outdoor unit, which is comprised of a compressor, a heat exchanger and the like, and supplies refrigerants to the indoor unit.

The air conditioner may include the indoor unit including a heat exchanger, and the outdoor unit including a compressor, a heat exchanger, which may be individually controlled. The air conditioner may operate by controlling power supplied to the compressor or the heat exchanger. Additionally, for the air conditioner, at least one indoor unit connects to the outdoor unit, and depending on an operation mode, refrigerants are supplied to the indoor unit such that the air conditioner operates in a cooling mode or a heating mode.

The air conditioner is provided with a means of adjusting a wind direction at a discharge opening to adjust a direction of wind discharged to an indoor space. The direction of wind can be changed by manipulating a wind setting button provided at a remote controller and the like.

With a wind direction adjusting means of the related art such as a perpendicular vane, a horizontal vane and the like, air current cannot be freely controlled as the vanes move one-dimensionally. Accordingly, there is a growing need for a method of controlling air current more efficiently.

Additionally, when an air conditioner includes one or more opening and closing structures such as a door and the like, noise and/or safety concerns, such as a body part being squeezed in the opening and closing structure, may be caused during opening and closing operations. Thus, a method is needed by which noise and safety concerns can be prevented while an air conditioner operates efficiently.

SUMMARY

The present disclosure is directed to an indoor unit of an air conditioner, which does not cause unnecessary labor to a user in relation to an operation of an indoor unit, thereby ensuring improvement in convenience.

The present disclosure is directed to an indoor unit of an air conditioner, where a user's movement is sensed under a plurality of conditions, thereby ensuring improvement in precision of an automatic operation of the indoor unit.

The present disclosure is directed to an air conditioner and a control method thereof that may prevent noise, an incorrect operation, and a safety concern/accident.

The present disclosure is directed to an air conditioner and a control method thereof that may control air current efficiently.

The present disclosure is directed to an air conditioner and a control method thereof that may provide a voice recognition function, a humidification function and the like.

The present disclosure is directed to an air conditioner and a control method thereof in which the inner modules may be stored and managed in a clean and safe manner while not in use.

To achieve the above-described or other objectives, an air conditioner according to an embodiment of the present disclosure may include a sliding door forming an exterior of a front surface part and configured to move leftwards and rightwards to be opened and closed, a sliding door motor configured to supply power to the sliding door, a sliding door position sensor including a first position sensor and a second position sensor configured to detect a position of the sliding door, and a control part configured to control opening and closing operations of the sliding door on the basis of sensing data of the sliding door position sensor and on the basis of rotational speed of the sliding door motor, thereby preventing a safety accident.

To achieve the above-described or other objectives, an air conditioner according to an embodiment of the present disclosure may operate based on position information of a sensed user, thereby ensuring improved safety and usability.

To achieve the above-described or other objectives, an air conditioner according to an embodiment of the present disclosure may include a sliding door forming an exterior of a front surface part and configured to move leftwards and rightwards to be opened and closed, a first proximity sensor disposed at the sliding door and configured to sense whether a user approaches, a second proximity sensor disposed further downwards than the first proximity sensor, a sliding door motor configured to supply power to the sliding door, and a control part configured to control the sliding door motor such that the sliding door is opened when the first proximity sensor and the second proximity sensor sense a user, thereby preventing an incorrect operation and a safety accident.

To achieve the above-described objectives, an indoor unit of the air conditioner according to an embodiment of the present disclosure may include a cabinet assembly including an upper cabinet provided with a suction opening at a rear thereof and a base disposed at a lower side of the upper cabinet to support the upper cabinet; a door panel disposed at a front of the cabinet assembly to cover the upper cabinet and a part of a front surface of the base and disposed to move leftwards and rightwards at the cabinet assembly; a first proximity sensor mounted onto the door panel and configured to sense an object within a first predetermined distance range from the door panel; and a second proximity sensor disposed inside the base disposed further downwards than the door panel and configured to sense an object within a second predetermined distance range from the door panel, wherein the first predetermined distance range may include distances farther than distances within the second predetermined distance range. And when the first proximity sensor and the second proximity sensor all sense an object, the door panel moves. Therefore, when a user approaches, a door may operate, and when conditions of a plurality of sensors are all satisfied, the door may operate.

Advantageous Effects

According to at least one of the embodiments, provided is a structure where a door panel moves such that a user does not need to move a door additionally, thereby ensuring improved convenience.

According to at least one of the embodiments, when the door panel moves, a water vessel may be tilted forwards, providing convenience to the user who takes out the water vessel disposed inside an indoor unit when the user detaches the water vessel from the indoor unit, thereby providing convenience to the user at the time when the water vessel is installed or attached and detached.

According to at least one of the embodiments, provided are an air conditioner and a control method thereof capable of preventing noise, an incorrect operation, and a safety accident.

According to at least one of the embodiments, air current may be controller in various and efficient ways.

According to at least one of the embodiments, various functions such as a voice recognition function, a humidification function, and the like may be provided.

According to at least one of the embodiments, inner modules may be stored and managed in a clean and safe manner when not in use.

According to at least one of the embodiments, operations may be performed based on position information of a sensed user, thereby ensuring improvement in safety and usability.

Other various effects may be directly or implicitly presented in the following detailed description.

BRIEF DESCRIPTION OF DRAWINGS

FIG. 1 is a view illustrating an exterior of an exemplary air conditioner.

FIG. 2 is a view illustrating a state in which a circulator door of the air conditioner in FIG. 1 is open.

FIG. 3 is a view illustrating a state in which a door panel of the air conditioner in FIG. 1 is open.

FIG. 4 is a view illustrating a water vessel for humidification of the air conditioner in FIG. 1.

FIG. 5 is a block diagram illustrating a control relationship among major components of an exemplary air conditioner.

FIG. 6 is a view illustrating an inner configuration of an exemplary control part.

FIG. 7 is a block diagram illustrating a control relationship among major components of an exemplary air conditioner.

FIG. 8 is a block diagram illustrating a control relationship among major components of an exemplary air conditioner.

FIG. 9 is a reference view for description of a change in rotational speeds while a motor operates.

FIGS. 10 to 14 are reference views for description of a control method of an exemplary air conditioner.

FIG. 15 is a flow chart illustrating a control method of an exemplary air conditioner.

FIG. 16 is a flow chart illustrating a control method of an exemplary air conditioner.

FIG. 17 is a flow chart illustrating a control method of an exemplary air conditioner.

FIG. 18 is a flow chart illustrating a control method of an exemplary air conditioner.

FIG. 19 is a flow chart illustrating a control method of an exemplary air conditioner.

FIG. 20 is a perspective view illustrating an indoor unit of an exemplary air conditioner.

FIG. 21 is a perspective view illustrating a state where a door assembly of an exemplary air conditioner moves.

FIG. 22 is a perspective view illustrating a tilted water vessel in a state where a door assembly of an exemplary air conditioner moves.

FIG. 23 is an explode view illustrating an exemplary door assembly.

FIG. 24 is a rear side view illustrating an exemplary door assembly.

FIG. 25 is a view for describing an exemplary middle rail and an exemplary door driver.

FIG. 26 is a perspective view illustrating an exemplary display module.

FIG. 27 is an exploded perspective view illustrating an exemplary display module.

FIG. 28 is a cross-sectional perspective view illustrating an exemplary display module.

FIG. 29 is a cross-sectional view cut along X2-X2' in FIG. 28.

FIG. 30 is a view illustrating a contact surface of a front glass and a rear cover of an exemplary display module.

FIG. 31 is a front side view illustrating a state where an exemplary front glass and an exemplary rear cover are coupled.

FIG. 32 is a cross-sectional view cut along Y-Y' in FIG. 31.

FIG. 33 is a view for describing a sensor disposing space of an exemplary base and components disposed in the sensor disposing space.

FIG. 34 is a cross-sectional view for describing disposition of an exemplary second proximity sensor.

FIG. 35 is a view for describing a range where an exemplary first proximity sensor senses a user.

FIG. 36 is a view for describing an area where an exemplary projection module displays a graphic object, and a sensing range of a second proximity sensor.

DETAILED DESCRIPTION

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

As used herein, various singular forms "a," "an" and "the" are intended to include various plural forms as well, unless context clearly indicates otherwise. For example, a term "a" or "an" shall mean "one or more," even though a phrase "one or more" is also used herein. Use of the optional plural "(s)," "(es)," or "(ies)" means that one or more of the indicated feature is present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, features described with respect to certain embodiments may be combined in or with various other embodiments in any permutational or combinatory manner. Different aspects or elements of example embodiments, as disclosed herein, may be combined in a similar manner.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present.

In describing components, terms "module" and "part" are used only to easily draw up the present disclosure and are not intended to give a meaning or a function to the components. Thus, the terms "module and "part" may be mixedly used.

Throughout the specification, terms "first", "second" and the like are used to distinguish one component from another component and do not relate to priority or importance and the like of the components. In the drawings, terms indicating a direction such as an upward direction (U), a downward direction (D), a leftward direction (Le), a rightward direction (Ri), a forward direction (F) and a rearward direction (R) are used for convenience of description and are not intended to limit the scope of the disclosure. Thus, if necessary, the directions may be set differently.

FIG. 1 is a view illustrating an exterior of an exemplary air conditioner and specifically, a view illustrating an indoor unit of an exemplary air conditioner.

FIG. 2 is a view illustrating a state in which a circulator door of the air conditioner in FIG. 1 is open, and FIG. 3 is a view illustrating a state in which a door panel of the air conditioner in FIG. 1 is open.

An air conditioner 1 may include an indoor unit that includes a heat exchanger and that is installed in an indoor space, and an outdoor unit (not illustrated) that includes a compressor, a heat exchanger and the like, and that supplies refrigerants to the indoor unit.

Referring to FIGS. 1 to 3, an indoor unit main body 10 may be provided in an indoor space and may connect to the outdoor unit (not illustrated) through a refrigerant pipe (not illustrated).

The exemplary air conditioner 1 may include a cabinet assembly (I) which forms an exterior of the air conditioner and a front surface of which is open, and a door assembly (II) which covers the open surface of the cabinet assembly (I). The door assembly (II) may include a door panel 21 that forms an exterior of the front surface part, and a circulator door 25 that is disposed on the door panel 21 and that moves upwards and downwards to be opened and closed.

The indoor unit main body 10 may include a base 12, a cabinet assembly (I) and a door panel 21. The door panel 21 may form an exterior of a front surface part of the indoor unit main body 10, and the cabinet assembly (I) may be disposed at an upper side of the base 12 and may be supported by the base 12.

The door panel 21 may be provided with a circulator door 25 thereon.

The air conditioner indoor unit 1 may include an air suction opening (not illustrated) and an air discharge opening (not illustrated), and may condition air suctioned through the air suction opening therein and then discharge the conditioned air out of the air discharge opening.

For example, the suction opening (not illustrated) may be formed on a rear surface of the indoor unit main body 10, and the discharge opening (not illustrated) may be formed at an upper portion of the front surface of the indoor unit main body 10.

The suction opening and the discharge opening may be formed at another position of the indoor unit main body 10. For example, the discharge opening may be formed on a lateral surface and the like of a lower portion of the indoor unit main body 10. A plurality of discharge openings may be formed at the upper portion of the front surface of the indoor unit main body 10, the lateral surface of the lower portion of the indoor unit main body 10 and the like.

The suction opening may be formed on one or more positions of a rear surface of the indoor unit main body 10, a front surface of a lower portion of the indoor unit main body 10 and a lateral surface of the indoor unit main body 10.

The suction opening may be provided with a filter module (not illustrated) that filters out foreign substances such as dust and the like included in suctioned air. Additionally, the indoor unit main body 10 may be provided with a cleaning module 400 that cleans the filter module.

The discharge opening may be opened and closed by the circulator door 25.

A circulator module 31 may be provided inside the discharge opening, i.e., at a rear of the circulator door 25 with the circulator door 25 being closed. The circulator module 31 may generate air blowing power such that air is suctioned through the suction opening and is discharge through the discharge opening.

The circulator module 31 may be installed in the indoor unit main body 10, and at the time of operation, may discharge air out of the discharge opening that is exposed as the circulator door 25 is opened.

Additionally, the circulator module 31 may move forwards towards the discharge opening, which is opened as the circulator door 25 is opened, to operate. For example, at least part of the circulator module 31 may move forwards to pass through a circular discharge opening that is opened as the circulator door 25 moves downwards, and then a circulator fan of the circulator module 31 may operate while making rotational movement.

The discharge opening, as described above, may denote an opening through which air passes or through which at least part of the circulator module 31—a discharge unit for discharging air—passes.

The circulator door 25 may open and close the discharge opening. The circulator door 25 may be provided to discharge air such as heat-exchanged air, purified air and the like, which are processed in the air conditioner, outwards, while opening and closing a main discharge opening.

When the main body operates, the circulator door 25 may be opened such that the circulator module 31 is exposed outwards and air is discharged from the discharge opening, and when the main body stops operating, the circulator door 25 may be closed to close the discharge opening. A space, in which the circulator door 25 is accommodated when the discharge opening is opened, may be provided inside the door panel 21 or on a rear surface of the door panel 21.

A moving means (not illustrated) for moving the circulator door 25 may be installed on one surface inside the door panel 21. For example, a circulator door motor, and a gear member, a rail member, and the like for moving the circulator door 25 upwards or downwards depending on rotation of the circulator door motor, may be installed on one surface inside the door panel 21.

A step motor that is inexpensive and easily controlled may be used as the circulator door motor. In this case, the circulator door motor may be referred to as a circulator door step motor.

The circulator door 25 may move upwards or downwards inside the indoor unit main body 10 to be opened. For example, the circulator door 25 may be configured to move downwards, to be opened, from a perspective of space usability as the circulator door 25 is disposed at an upper portion of the door panel 21 of the indoor unit main body 10.

Alternatively, the circulator door 25 may be configured to move backwards towards the inside of the indoor unit main body 10 and then to move upwards or downwards to be opened. In this case, the circulator door 25 may be configured to move backwards towards the inside the indoor unit main body 10 and then to move downwards, to be opened, from a perspective of space usability.

Below, an example, where the circulator door 25 moves upwards and downwards to be opened and closed, is described. However, the circulator door 25 may make a backward movement inwards and then may move downwards to be opened, and may move upwards and then may make a forward movement towards the front surface to be closed.

When the circulator door 25 is opened, the circulator module 31 may move forwards towards the door panel 21 to discharge air.

When operation finishes, the circulator module 31 may move backwards towards the inside of the indoor unit main body 10, and may close the discharge opening as the circulator door 25 moves.

In some cases, a blowing fan (not illustrated) for assisting with air blowing power may be further installed in the indoor unit main body 10.

The air conditioner may further include a plurality of blowing fans in addition to the circulator module 31 in the indoor unit main body 10. For example, a plurality of blowing fans may be disposed at a lower side of the circulator module 31.

An auxiliary discharge opening (not illustrated) may be further installed on a lateral surface of the cabinet assembly (I). The auxiliary discharge opening may be provided with a wind direction control means for adjusting a direction of discharged air.

An air conditioner of the related art has difficulty in discharging air to a far area (i.e., long distances) even at the maximum air flow rate. According to the present disclosure, the circulator module 31 is provided at an upper end of the air conditioner such that wind is sent to a far area.

Further, as the circulator module 31 is applied in a final stage of an air discharge process, the circulator module 31 may directly discharge heat-exchanged air and purified air to a far area.

The air conditioner of the related art generally controls air currents using a perpendicular vane or a horizontal vane. Accordingly, in order for the air conditioner to send wind to a desired place, a vane that makes a one-dimensional movement has to be used.

In the air conditioner of the related art, a one-dimensional vane may control air currents one-dimensionally. That is, as the one-dimensional vane controls air currents leftwards and rightwards or upwards and downwards, air currents may not be controlled two-dimensionally such as a lower end of the left side or an upper end of the right side and the like.

Referring to FIGS. 1 to 3, the circulator module 31, which is a discharge unit, may be configured to rotate two-dimensionally after the circulator door 25 is opened. For example, the circulator module 31 may include a rotating part having a two-shaft rotation structure using a double joint and a gear rack structure, to freely rotate in different directions.

Accordingly, the circulator module 31 may rotate and control air currents to send wind to a place desired by a user.

That is, in the air conditioner of the related art, air directly hits the vane to control air currents. However, according the present disclosure, the circulator module 31 may rotate as a whole to control air currents in various ways.

Additionally, the circulator module 31 may rotate entirely and then may send wind to a place desired by a user to perform intensive air conditioning, thereby enabling a user to feel more pleasant and satisfied.

The door panel 21 may be provided with a display module 29.

The display module 29 may display an operation state and setting information, and may include a touch screen to receive a user instruction input by a user. In some embodiments, the door panel 21 may be provided with an operation part (not illustrated) including at least one input means such as a switch, a button, or a touch pad.

Further, a proximity sensor (not illustrated) and a remote controller receiver (not illustrated) may be provided at any one side of the display module.

In some embodiments, the display module 29 may further include one or more lighting devices.

The base 12 may be provided with a proximity sensor 124. The proximity sensor 124 may sense a user approaching the indoor unit main body 10 and may generate a signal corresponding to an approach of the user and may output the signal.

In some embodiments, when the proximity sensor 124 inputs a proximity signal corresponding to an approach of a user, the display module 29 may be activated and may display operation information, and at least one lighting device provided at the indoor unit main body 10 may operate.

The proximity sensor 124 may also be disposed in a predetermined area at a lower portion of the door panel 21.

The exemplary air conditioner according to one embodiment of the present disclosure may further include a proximity sensor (not illustrated) that senses the human body in addition to the proximity sensor 124. In this case, a proximity sensor 124, which is disposed relatively downwards, may be referred to as a second proximity sensor, and a proximity sensor, which is disposed relatively upwards, may be referred to as a first proximity sensor.

A vision module 22 including at least one camera may be installed at the upper portion of the door panel 21. Additionally, the door panel 21 may be provided with an audio input part (not illustrated), and an audio output part (not illustrated).

The indoor unit main body 10 may be provided with a heat exchanger (not illustrated) that allows heat exchange between suctioned air and refrigerants, therein.

The door panel 21 may slide leftwards or rightwards. Accordingly, the door panel 21 may also be referred to as a sliding door.

The door panel 21 may be installed using a sliding means formed at the cabinet assembly (I) and may move leftwards and rightwards. A part of the inner panel 141 of the main body may be exposed outwards because of movement of the door panel 21.

For example, the cabinet assembly (I) may include a sliding door step motor, and a gear member, or a rail member and the like for moving the door panel 21 leftwards or rightwards depending on rotation of the sliding door step motor.

An inner panel 141 may accommodate the circulator module 31, and may be provided with a moving means (not illustrated) for moving the circulator module 31.

In some embodiments, the circulator module 31 may include a circulator fan (not illustrated), a circulator rotating part (not illustrated) capable of rotating the circulator fan to change at least a direction faced by the circulator fan (not illustrated), and a circulator moving part (not illustrated) capable of moving at least the circulator fan (not illustrated).

The inner panel 141 may be provided with a water vessel for humidification 51 of a humidification module, at a lower portion thereof. The water vessel 51 may be exposed outwards as the door panel 21 is moved and opened leftwards or rightwards.

FIG. 4 is a view illustrating a water vessel for humidification of the air conditioner in FIG. 1.

Referring to FIG. 4, the water vessel for humidification 51 may be exposed outwards as the sliding door 21 moves leftwards or rightwards.

The water vessel for humidification 51 may be provided with an inlet, through which water is supplied, in a predetermined area. In some embodiments, the inlet may be opened, or a cover, configured to open and close at least part of the inlet, may be disposed.

The water vessel 51 may be provided with a moving shaft at a lower portion thereof and may be connected to the cabinet assembly (I). An upper portion of the water vessel 51 may move to protrude forwards with respect to the moving shaft at the lower portion of the water vessel such that the inlet may be opened. A front surface of the water vessel 51 may tilt to form a predetermined angle (0) between the upper portion of the water vessel 51 and the inner panel 141.

The water vessel 51 may be detached from the indoor unit main body 10.

The indoor unit main body 10 may be provided with a sensor configured to sense whether the water vessel is mounted or not, therein.

When the proximity sensor 124 senses an approach of a user, the water vessel 51 may automatically move according to a proximity signal, and the inlet may be opened.

As a handle (not illustrated) is pulled forwards, the water vessel 51 may be moved, and the inlet may be opened.

As the water vessel 51 is pressed inwards, a fixation part (not illustrated) may be released, the water vessel 51 may be moved forwards, and the inlet may be opened.

As the sliding door 21 is slid and opened, the water vessel 51 may also rotate automatically, and the inlet may be opened.

The inner panel 141 or the water vessel 51 may be provided with a water level display part (not illustrated) configured to display a water level of the water vessel, at a portion thereof.

The water vessel 51 may be configured such that an amount of water in the water vessel may be checked. For example, for the water vessel 51, a front surface may be made of a transparent material. For the water vessel 51, any portion of the front surface may be made of a transparent material. Additionally, the water vessel 51 may be made of a transparent material as a whole.

FIG. 5 is a block diagram illustrating a control relationship among major components of an exemplary air conditioner.

Referring to FIG. 5, the exemplary air conditioner may include a sensor part 215 including one or more sensors configured to sense various types of data, a memory 256 configured to store various types of data, a communication part 270 configured to wirelessly communicate with another electronic device, a cleaning module 400, a humidification module 300, a control part 240 configured to control entire operations, and a driver 280 configured to control operations of a heat exchanger, a valve, a wind direction adjusting means and the like, which are provided in the indoor unit main body 10, under control of the control part 240.

For example, the sensor part 215 may be provided with one or more temperature sensors configured to sense a temperature in an indoor space and an outdoor space, a humidity sensor configured to sense humidity, a dust sensor configured to sense air quality, and the like.

The temperature sensor may be installed at the suction opening to measure a temperature in an indoor space, may be installed in the indoor unit main body 10 to measure a temperature of heat exchange, may be installed at any one side of the discharge opening to measure a temperature of discharged air, and may be installed at a refrigerant pipe to measure a temperature of refrigerants.

In some embodiments, the sensor part 215 may include one or more sensors for sensing the human body. For example, the sensor part 215 may include a proximity sensor 124.

The proximity sensor 124 may sense a human or an object that approaches within a predetermined distance.

The proximity sensor 124 may sense whether a user is present, and a distance from the user.

The proximity sensor 124 may be installed at a lower portion of the indoor unit main body 10, on a front surface part of the base 12, or on the door panel 21. The proximity sensor 124 may also be installed near the display module 29.

The proximity sensor 124 may input an approach signal to the control part 240 when a predetermined object or a person approaches within a predetermined distance. The proximity sensor 124 may sense a user approaching to the indoor unit main body 10, and may generate a signal corresponding to the approach of a user and may output the signal.

The sensor part 215 may include one or more position sensors that sense positions of units included in the air conditioner.

The control part 240 may control operations of the air conditioner on the basis of data sensed by the sensor part 215.

The memory 256, configured to record various types of information required for operations of the air conditioner, may store control data for controlling operations, data on an operation mode, data sensed by the sensor part 215, data transmitted and received through the communication part and the like.

The memory 256 may include a volatile or non-volatile recording medium. The recording medium, which stores microprocessor-readable data, may include a hard disk drive (HDD), a solid state disk (SSD), a silicon disk drive (SDD), ROM, RAM, CD-ROM, magnetic tape, a floppy disk, an optical data storage medium and the like.

The memory 256 may store data for voice recognition, and the control part 240 may process a user's voice input signal received through the audio input part 220 and may perform voice recognition.

The air conditioner may perform a simple processing of voice recognition, and a voice recognition server system may perform a high-level processing of voice recognition such as natural language processing and the like.

For example, when a wake-up voice signal including a predetermined call word is received, a state of the air conditioner may be changed into a state where the air conditioner is ready to receive a voice instruction. In this case, the air conditioner may perform voice recognition up to a step of determining whether the call word voice is input. Then a voice recognition server system may perform voice recognition of the user's voice input.

As system assets of the air conditioner are limited, the voice recognition server system may perform a complicated processing of natural language recognition and processing.

In some embodiments, the memory 256 may store a sound source file of a voice instruction input by a user, and the stored sound source file may be transmitted to the voice recognition server system through the communication part 270. Further, the stored sound source file may be deleted after a predetermined period of time or after a predetermined operation is performed.

The communication part 270 may be provided with one or more communication modules and may wirelessly communicate with another electronic device according to a predetermined communication method to transmit and receive various types of signals.

The predetermined communication method may be a Wi-Fi communication method. Against this backdrop, the air conditioner may be provided with a Wi-Fi communication module as a communication module. However, in this disclosure, the communication method is not limited.

Alternatively, the air conditioner may be provided with another type of communication module or may be provided with a plurality of communication modules. For example, the air conditioner may include an NFC module, a Zigbee communication module, a Bluetooth (Bluetooth™) communication module, and the like.

The air conditioner may be connected to a server included in the voice recognition server system or a predetermined external server, a mobile terminal of a user and the like through the Wi-Fi communication module and the like, and may assist with smart functions such as remote monitoring, remote control, and the like.

A user may check information on the air conditioner or may control the air conditioner through a mobile terminal.

Additionally, the communication part 270 may communicate with an access point (AP) and may access a wireless Internet network through the access point to communicate with other devices.

The control part 240 may transmit state information of the air conditioner, a user's voice instruction and the like to the voice recognition server system and the like through the communication part 270.

When receiving a control signal through the communication part 270, the control part 240 may control the air conditioner according to the received control signal such that the air conditioner operates.

The driver 280 may control rotation of a motor connected to indoor fans to control an amount of air discharged to an indoor space. For example, the driver 280 may control rotation of a motor connected to a circulator fan provided at the circulator module 31, a blowing fan at a lower end of the circulator fan, and the like.

Additionally, the driver 280 may control operations of the heat exchanger, such that the heat exchanger evaporates or condenses supplied refrigerants and allows heat exchange between the refrigerants and surrounding air.

The driver 280 may control operations of a valve, a wind direction adjusting means and the like provided in the indoor unit main body 10 on the basis of a control instruction of the control part 240.

In some embodiments, the control part 240 may directly control predetermined units in the air conditioner.

The driver 280 may include a motor driver and may include an inverter and the like to drive a motor.

In some embodiments, the driver 280 may supply a driving force to allow the circulator module 31 to make rotational movement. The driver 280 may also supply driving power to a circulator moving part (not illustrated) to allow the circulator module 31 to move. The driver 280 may also control opening and closing of a valve therein. In some cases, the driver 280 may supply a driving force such that the door panel 21 slides leftwards or rightwards. In some embodiments, the driver 280 may include a circulator driver and a door panel driver.

The cleaning module 400 may be installed at a filter module and may clean foreign substances of the filter module. The cleaning module 400 may include a cleaning robot (not illustrated). The cleaning robot may suction foreign substances of the filter module while moving along a surface of the filter module. The cleaning robot may also sterilize the filter module using a sterilizing lamp while cleaning the filter module. The cleaning module 400 may further include a position sensor configured to detect a position of the cleaning robot.

The humidification module 300 may be supplied with water of the water vessel 51, may perform humidification for supplying moisture, and may discharge humidified air outwards. The humidification module 300 may generate steam to humidify air, and may allow the humidified air to be discharge to an indoor space along with conditioned air through the discharge opening.

For the humidification module 300, a vibration-type one using vibration, a heating-type one, a spray-type one spraying water may be used, and various humidification methods may be used.

The control part 240 may process input and output data, may store data in the memory 256 and may control the communication part such that data are transmitted and received through the communication part 270.

The control part 240 may control the air conditioner such that the air conditioner operates on the basis of an input through the display module 29, and the operation part 230 and the like. And the control part 240 may communicate data with the outdoor unit, and may control the driver 280 in order to discharge cold-temperature air, conditioned by refrigerants supplied by the outdoor unit, to an indoor space.

The control part 240 may control the circulator module 31 such that the circulator module 31 discharges air outwards on the basis of a set operation mode or on the basis of data measured by the sensor part 215.

The control part 240 may also control the humidification module 300 such that the humidification module 300 operates to discharge humidified air, and may control the cleaning module 400 such that a filter is cleaned.

The control part 240 may sense an occupant through the sensor part 215 or the vision module 22, and may control air currents on the basis of information on a position of the sensed occupant.

The control part 240 may monitor an operation state of each module, and may control the display module 29 such that the operation state is output through the display module 29 on the basis of supplied data.

Referring to FIG. 5, the exemplary air conditioner may further include a power supply 299, a vision module 22, an audio input part 220 configured to receive a user's voice instruction, a display module 29 configured to display predetermined information as an image, an audio output part 126 configured to output predetermined information acoustically and the like.

The power supply 299 may supply operation power to each unit of the air conditioner. The power supply 299 may rectify and smooth power in use, and may generate and supply a voltage required by each unit. Additionally, the power supply 299 may prevent rush current and may generate a constant voltage. Further, the power supply 299 may supply the operation power to the outdoor unit (not illustrated).

The audio input part 220 may receive an external audio signal and a user's voice instruction. To this end, the audio input part 220 may be provided with one or more microphones (MIC). The audio input part 220 may be provided with a plurality of microphones to receive a user's voice instruction more accurately. The plurality of microphones may be disposed at different positions and spaced apart from each other, and may acquire an external audio signal and process the same as an electric signal.

The audio input part 220 may include a processing part that converts an analogue sound into digital data, or may be connected to a processing part and may convert a user's input voice instruction such that the control part 240 or a predetermined server recognizes the user's input voice instruction.

The audio input part 220 may use various types of algorithms for removing noise that is made while a user's voice instruction is input to the audio input part 220.

The audio input part 220 may include components for processing audio signals such as a filter that removes noise from an audio signal received by each microphone, an amplifier that amplifies and outputs a signal output from the filter, and the like.

The display module 29 may display information corresponding to a user's instruction input, processing results corresponding to a user's instruction input, an operation mode, an operation state, an error state and the like as an image.

In some embodiments, the display module 29 may have a structure where the display module 29 and a touch pad are mutually layered and may be implemented as a touch screen. In this case, the display module 29 may be used as an input device, which allows an input of information by a user's touch, in additional to an output device.

In some embodiments, the display module 29 may further include a lighting part that outputs an operation state based on whether the lighting part is turned on, a color of the lighting part, and whether the lighting part flickers.

In some embodiments, the air conditioner may further include an additional operation part 230. The operation part 230 may include at least one of a button, a switch, a touch input means, and may input a user's instruction or predetermined data to the air conditioner.

The audio output part 126 may acoustically output a notification message such as a notification sound, an operation mode, an operation state, an error state, and the like, information corresponding to a user's instruction input, processing results corresponding to a user's instruction input, and the like, under control of the control part 240.

The audio output part 126 may convert an electric signal from the control part 240 into an audio signal and may out the audio signal. To this end, the audio output part 126 may be provided with a speaker and the like.

The vision module 22 may include at least one camera to capture an image of an indoor environment. The camera may capture images of surroundings, an external environment, and the like of the air conditioner. A plurality of cameras may be installed at each portion to improve image capture efficiency.

For example, the camera may include at least one optical lens, an image sensor (e.g., a CMOS image sensor) including a plurality of photodiodes (e.g., pixels) where an image is formed by light passing through the optical lens, and a digital signal processor (DSP) that forms an image on the basis of signals output from the photodiodes. The digital signal processor may produce a moving image including frames comprised of still images as well as a still image.

The memory 256 may store an image captured and acquired by the camera.

In some embodiments, a position of a user may be detected based on an image acquired by the vision module 22.

The vision module 22 may be installed on the door panel 21, and in some cases, may be installed on an upper panel of the cabinet. Additionally, the vision module 22 may be accommodated in the indoor unit main body 10 at the time of non-operation, and may operate after the vision module moves upwards.

FIG. 6 is a view illustrating an inner configuration of an exemplary control part.

The control part 240 may include a single microprocessor or a plurality of microprocessors.

Referring to FIG. 6, the control part 240 may include a main control part 241, a vision module control part 242, a power supply control part 243, a lighting control part 244, a display module control part 245, a humidification module control part 246, a cleaning module control part 247 and the like, depending on their functions.

Each control part 241 to 247 may include a single microprocessor and may be installed in each module. For example, the vision module 22, the cleaning module 400, and the humidification module 300 may be controlled through a single microprocessor. Alternatively, each module may have its own microprocessor.

In some embodiments, the main control part 241 may supply a control instruction to the other control parts 242 to 247 and may receive data from each control part and may process the data. The main control part 241 and the other control parts 242 to 247 are connected according to a BUS system to transmit and receive data.

In some embodiments, a microprocessor is installed in each module to process operations of the module itself more rapidly. For example, the display module 29 may be provided with the display module control part 245, and the humidification module 300 may be provided with the humidification module control part 246, such that the control parts control operations of the modules.

The block diagram of the control part 240 in FIG. 6 is for description of an embodiment according to the present disclosure. The components illustrated in the block diagram may be integrated, added or omitted depending on specifications of units in an actually implemented control part 240 and air conditioner. When necessary, two or more components may be combined into a single component, or a single component may be divided into two or more components. Additionally, functions performed in each block are provided to describe embodiments according to the present disclosure, and specific operations and devices in each block are not intended to limit the scope of the right of the subject matter in the present disclosure.

FIG. 7 is a block diagram illustrating a control relationship among major components of an exemplary air conditioner.

Referring to FIG. 7, the air conditioner may include a vision module 22, a sensor part 215 configured to sense various types of data, an audio input part 220 configured to receive a user's voice instruction, an operation part 230, a memory 256 configured to store various types of data, a communication part 270 configured to wirelessly communicate with another electronic device, a driver 280 configured to perform operations implemented in the air conditioner, a display module 29 configured to display predetermined information as an image, an audio output part 126 configured to output predetermined information acoustically, a humidification module 300, a cleaning module 400, a control part 240 configured to control entire operations, and a processor 260.

An inner block diagram of the air conditioner in FIG. 7 is similar to that of the air conditioner in FIG. 5. However, the air conditioner in FIG. 7 differs from the air conditioner in FIG. 5, in that the processor 260 is further provided and that the audio input part 220, the audio output part 126, the communication part 270 and the processor 260 are provided in a voice recognition module 205 that is a single module.

In some embodiments, the voice recognition module 205 may include the communication part 270 and the processor 260, and the audio input part 220 and the audio output part 126 may be implemented as an additional integrated module.

The processor 260 may control the audio input part 220, the audio output part 126, the communication part 270 and the like.

Below, differences between the air conditioner in FIG. 7 and the air conditioner in FIG. 5 are described.

The processor 260 may process a user's voice input signal received through the audio input part 220 and may perform voice recognition.

For example, when the processor 260 receives a wake-up voice signal including a predetermined call word, a state of the processor 260 may be changed into a state where the processor 260 is ready to receive a voice instruction. In this case, the processor 260 may perform voice recognition up to a step of determining whether the call word voice is input. Then a voice recognition server system may perform voice recognition of the user's voice input.

The processor 260 may control the communication part 270 such that the communication part 270 transmits the user's voice instruction, input after recognition of the wake-up voice signal, to the voice recognition server system.

The processor 260 may also transmit state information of the air conditioner, a user's voice instruction, and the like to the voice recognition server system and the like through the communication part 270.

When receiving a control signal through the communication part 270, the processor 260 may transmit the control signal to the control part 240, and the control part 240 may control the air conditioner such that the air conditioner operates according to the received control signal.

Thus, the voice recognition module 205 may acquire voice data, communicate with the server system, and output a corresponding sound.

The voice recognition module 205 may be attached to various types of electronic devices in addition to the air conditioner. Alternatively, the voice recognition module 205 may be used as an additional device without being attached to another electronic device.

The exemplary air conditioner may receive a user's voice input, and the voice recognition server system may recognize and analyze the user's voice input to control the air conditioner.

Accordingly, the user may control the air conditioner without operating a mobile terminal and a remote controller.

FIG. 8 is a block diagram illustrating a control relationship among major components of an exemplary air conditioner.

Referring to FIGS. 1 to 8, the exemplary air conditioner may include a sliding door 21 configured to form an exterior of a front surface part of the air conditioner and to move leftwards and rightwards to be opened and closed, a sliding door motor 810 configured to supply power to the sliding door 21 such that the sliding door 21 moves leftwards and rightwards, a sliding door position sensor 820 including a first position sensor and a second position sensor configured to detect a position of the sliding door 21, and a control part 240 configured to control opening and closing operations of the sliding door 21 on the basis of sensing data of the sliding door position sensor 820 and rotational speed of the sliding door motor 810.

Additionally, the exemplary air conditioner may include a first proximity sensor 2961, and a second proximity sensor 124 that is disposed further downwards than the first proximity sensor 2961, and the first proximity sensor 2961 and the second proximity sensor 124 may be configured to sense whether a user approaches. Further, the air conditioner may include a control part 240 that controls the sliding door motor 810 such that the sliding door 21 is opened when the first proximity sensor 2961 and the second proximity sensor 124 sense a user.

That is, when the first proximity sensor 2961 and the second proximity sensor 124 all sense a user, the control part 240 may recognize it as a sliding door-on input for opening the sliding door 21.

In some embodiments, when the first proximity sensor 2961 and the second proximity sensor 124 sense a user at the same time, or when the second proximity sensor 124 senses a user within a predetermined period of time after the first proximity sensor 2961 senses the user, the control part 240 may recognize it as a sliding door-on input.

The exemplary air conditioner may be provided with a moving means (not illustrated) for moving the sliding door 21. For example, the cabinet assembly (I) may include a sliding door motor 810, and a gear member, a rail member and the like for moving the sliding door 21 leftwards or rightwards depending on rotation of the sliding door motor 810.

The exemplary air conditioner may move some elements using a step motor. The step motor may rotate in proportion to the number of pulses and its rotational speed may change in proportion to an input frequency. Accordingly, as a shift of the elements is proportional to the number of pulses, control may be easily ensured.

A step motor may be used as the sliding door motor 810. In this case, the sliding door motor 810 may also be referred to as a sliding door step motor 810.

The control part 240 may rotate the sliding door motor 810 to open or close the sliding door 21.

For example, the control part 240 may control the sliding door 21 such that the sliding door 21 is moved leftwards and opened on the basis of a sliding door-on instruction, and may control the sliding door 21 such that the sliding door 21 is moved rightwards and closed on the basis of a sliding door-off instruction.

When the sliding door 21 slides leftwards and rightwards to be opened and closed, noise may be made by the over swing of the sliding door 21. This noise causes a user discomfort and potentially a negative impression of the product.

Additionally, a body part may be stuck in a space that is formed when the sliding door 21 is opened and closed.

In the present disclosure, presented are methods for easily detecting a position of the sliding door 21 at the time when the sliding door 21 slides leftwards and rightwards and for accurately controlling the sliding door 21.

To this end, the exemplary air conditioner may include a sliding door position sensor 820 for detecting a position of the sliding door 21.

The sliding door position sensor 820 may be disposed at a base 12.

Alternatively, the sliding door position sensor 820 may be disposed on an inner panel 141. The position of the sliding door position sensor 820 may vary depending on a sensing method and a structure of an air conditioner model.

The sliding door position sensor 820 may include a plurality of sensors. For example, the sliding door position sensor 820 may include a first position sensor (see 820*a* in FIG. 14) and a second position sensor (see 820*b* in FIG. 14).

For example, the first position sensor 820*a* and the second position sensor 820*b* may be spaced apart from each other, and a distance between the first position sensor 820*a* and the second position sensor 820*b* may be set to correspond to a distance moved by the sliding door 21.

The first position sensor 820*a* may sense a state where the sliding door 21 is closed, and the second position sensor 820*b* may sense a state where the sliding door 21 is open. To this end, the first position sensor 820*a* may be disposed at a position corresponding to a start point of movement of the sliding door 21 to sense the state where the sliding door is closed, and the second position sensor 820*b* may be disposed at a position corresponding to an end point of movement of the sliding door 21 to sense the state where the sliding door 21 is open.

As described herein, the start point of movement of the sliding door 21 may denote a rightmost point of the sliding door 21 in the state of being closed before the sliding door 21 performs an opening operation.

As described herein, the end point of movement of the sliding door 21 may denote a rightmost point of the sliding door 21 in the state of being open after the sliding door 21 finishes the opening operation.

The present disclosure is not intended to limit a sensing method of the sliding door position sensor 820. Rather, various types of sensors may be used.

For example, the first position sensor 820*a* and the second position sensor 820*b* may be infrared (IR) sensors. The first position sensor 820*a* and the second position sensor 820*b* may be respectively disposed at the start point of movement of the sliding door 21 and the end point of movement of the sliding door 21 to detect a position of the sliding door 21. Additionally, the control part 240 may control the sliding door motor 810 on the basis of information on a sensed position.

Alternatively, the sliding door position sensor 820 may sense whether the sliding door 21 is opened and closed and/or may detect a position of the sliding door 21, using a Hall IC, a trigger switch, a rotary switch, and the like.

A sensor part 215 may include a sliding door position sensor 820, and the control part 240 may control the air conditioner on the basis of sensing data of the sliding door position sensor 820.

In the present disclosure, a method for preventing noise, an incorrect operation, and a safety accident, at the time when the sliding door 21 slides leftwards and rightwards, is presented.

According to one embodiment, when the first proximity sensor 2961 and the second proximity sensor 124 all sense a user, the control part 240 may recognize it as a sliding door-on input.

In some embodiments, when the first proximity sensor 2961 and the second proximity sensor 124 sense a user at the same time, or when the second proximity sensor 124 senses a user within a predetermined period of time after the first proximity sensor 2961 senses the user, the control part 240 may recognize it as a sliding door-on input.

If sensing of a user performed by any one of the first proximity sensor 2961 and the second proximity sensor 124 is set to a sliding door-on input, an incorrect operation is highly likely to occur.

For example, the second proximity sensor 124 may sense a child or a pet. However, it is undesirable to open the sliding door 21 whenever only the second proximity sensor 124 senses a user.

If a user operates the display module 29 on a front surface of the sliding door 21 or a user approaches to the air conditioner because the user feels hot with no intention of taking out or placing a water vessel for humidification 51, the first proximity sensor 2961 may sense the user. However, it is undesirable to open the sliding door 21 whenever only the first proximity sensor 2961 senses a user.

According to the present disclosure, when the first proximity sensor 2961 and the second proximity sensor 124 all sense a user, the sliding door 21 may automatically open, thereby ensuring improvement in convenience and safety.

The exemplary air conditioner may further include a projection module (not illustrated) that projects a predetermined image when the first proximity sensor 2961 senses a user.

The projection module may project a predetermined image in a forward direction of the second proximity sensor 124 when the first proximity sensor 2961 senses a user.

In this case, the projection module may project characters such as "open door" and the like and a graphic object in a forward direction of the second proximity sensor 124 such that the user desiring to open the sliding door 21 is induced to move to the forward direction of the second proximity sensor 124.

When a foot of the user approaches to an area, where the projection module projects a predetermined image or predetermined light, in the forward direction of the second proximity sensor 124, the sliding door motor 810 may start operating.

The exemplary air conditioner according to an aspect of an embodiment may further include a display module 29 configured to receive a touch input.

In some embodiments, when the first proximity sensor 2961 senses a user and a touch input is received, the control part 240 may control the sliding door motor 810 such that the sliding door 21 is opened.

That is, the second proximity sensor 124 may not be requested to additionally sense the user. The sliding door 21 may be opened only with the user's touch input.

In this case, when the first proximity sensor 2961 senses the user, characters such as "open door" and the like and a graphic object may be displayed on the display module 29, and the user may be asked to input a touch corresponding to a sliding door-on input.

When the user inputs a touch in response, the control part 240 may control the sliding door motor 810 such that the sliding door 21 is opened.

The control part 240 may control the air conditioner on the basis of sensing data of the sliding door position sensor 820.

When the second position sensor 820*b* senses the sliding door 21 at a first distance while the sliding door 21 performs an opening operation, the control part 240 may control the sliding door motor 810 such that rotational speed of the sliding door motor 810 is reduced.

When the second position sensor 820*b* senses the sliding door 21 at a second distance shorter than the first distance, the control part 240 may control the sliding door motor 810 such that the sliding door motor 810 stops rotating.

That is, the control part 240 may reduce speed of the sliding door 21 at the first distance before the sliding door 21 arrives at the end point of its movement, and may stop rotation of the sliding door motor 810 at the second distance right before the sliding door 21 arrives at the end point of its movement.

Accordingly, even when the sliding door 21 is over swung, the over swing makes no noise. Accordingly, the control part 240 may control the sliding door 21 such that the sliding door 21 is opened smoothly to an exact position.

Further, the control part 240 may prevent interference with the water vessel for humidification 51, which may be caused while the sliding door 21 performs an opening operation.

In the same way, the control part 240 may control the sliding door motor 810 such that rotational speed of the sliding door motor 810 is reduced when the first position sensor 820*a* senses the sliding door 21 at a third distance while the sliding door 21 performs a closing operation.

When the first position sensor 820*a* senses the sliding door 21 at a fourth distance shorter than the third distance, the control part 240 may control the sliding door motor 810 such that the sliding door motor 810 stops rotating.

Therefore, even when the sliding door is over swung, the over swing makes no noise. Accordingly, the control part 240 may control the sliding door 21 such that the sliding door 21 is closed smoothly to an exact position.

The exemplary air conditioner may further include a sensor 830 configured to sense whether the water vessel for humidification 51 is mounted. For example, the air conditioner may be provided with a Hall sensor 830 to sense whether the water vessel for humidification 51 is mounted.

When a sliding door-off instruction is input, the control part 240 may confirm whether the water vessel for humidification 51 is mounted.

If the water vessel for humidification 51 is mounted onto an exact position, the control part 240 may control the sliding door motor 810 such that the sliding door is closed.

If the water vessel for humidification 51 of the humidification module 300 is not mounted onto an exact position or is tilted, the control part 240 may output a notification asking for placement of the water vessel for humidification 51 by controlling other elements.

For example, the display module 29 may display an image asking for placement of the water vessel for humidification 51, and the audio output part 291 may output a sound asking for placement of the water vessel for humidification 126.

Accordingly, the sliding door 21 may be prevented from being closed in a state where the water vessel for humidification 51 is not installed.

In some embodiments, the control part 240 may include a first control part 246 configured to control movement of the sliding door position sensor 820 and the sliding door 21, and a second control part 245 configured to control movement of the first proximity sensor 2961 and a circulator door 25.

In some embodiments, the first control part 246 may be a humidification module control part 246 configured to control the humidification module 300.

The sliding door 21 may be opened to readily take out the water vessel for humidification 51 configured to supply water used in the humidification module 300 or for plumbing and the like. In some embodiments, the first position sensor 820*a* and the second position sensor 820*b* may be disposed respectively on the left and the right of the water vessel for humidification 51.

Thus, the humidification module control part 246 configured to control the humidification module 300 may control movement of the sliding door 21, thereby ensuring a simpler connection structure and a higher speed of processing.

The exemplary air conditioner may further include a first proximity sensor 2961 disposed at the sliding door 21 and configured to sense whether a user approaches.

In this case, the control part 240 may control opening and closing operations of the circulator door 25 on the basis of data sensed by the first proximity sensor 2961.

For example, the first proximity sensor 2961 may sense whether a user is present within a predetermined range and a distance from the user. The control part 240 may control the air conditioner on the basis of the distance information between the air conditioner and the user.

To prevent a user's hand from being struck, the first proximity sensor 2961 may be disposed further upwards then a second proximity sensor 124.

For example, the first proximity sensor 2961 may be disposed at the display module 29. The display module 29 may offer information to a user, and may receive a user's touch input. Accordingly, the user may be positioned in front of the display module 29 in various input processes and in a large number of cases. When the first proximity sensor 2961 is disposed at the display module 29, the first proximity sensor 2961 may rapidly and exactly confirm a situation where a user does not withdraw after the user inputs a product-off instruction, and the like.

Additionally, as a circuit element and the like for the first proximity sensor 2961 may be mounted onto a board with which the display module 29 is provided, a circuit and a connection wire may be configured more simply.

In this case, the second control part 245 may be a display module control part 245 configured to control the display module 29.

The display module control part 245 may deliver sensing data, received from the first proximity sensor 2961, to the humidification module control part 246 and the like.

The second proximity sensor 124 may be provided at the base 12. The second proximity sensor 124 may sense an approach of a user to an indoor unit main body 10 and may generate and output a signal corresponding to the approach of the user.

Referring to FIG. 8, the display module control part 245 may receive sensing data from the second proximity sensor 124 and may process the same. Accordingly, the display module control part 245 may determine a position of a user on the basis of the sensing data of the first proximity sensor 2961 and the second proximity sensor 124.

In another case, the humidification module control part 246 may receive sensing data from the second proximity sensor 124 and may process the same. The second proximity sensor 124 may be disposed at a lower end of the sliding door 21 or at the base 12. Accordingly, the second proximity sensor 124 and the humidification module control part 246 may be readily connected.

Additionally, data sensed by the second proximity sensor 124 may be effectively used when the sliding door 21 performs opening and closing operations. Accordingly, the humidification module control part 246, configured to control movement of the sliding door 21, may control the second proximity sensor 124.

The control part 240 may include a third control part 241 configured to control a circulator module 31 and the like. The third control part 241 may be a main control part 241 that may control entire operations of the control part 240.

The main control part 241 may control driving, movement and rotation of a fan of the circulator module 31. In some embodiments, a driver 280 may control at least one of driving, movement and rotation of the fan of the circulator module 31 under control of the main control part 241.

The main control part 241 may control the humidification module control part 246 and the display module control part 245 and may deliver predetermined data. For example, the main control part 241 may transmit sensing data of the first proximity sensor 2961, received from the display module control part 245, to the humidification module control part 246.

The main control part 241 may control the humidification module control part 246 such that the humidification module control part 246 operates in response to a control operation of the display module control part 245.

The humidification module 300 may be provided with a Hall sensor 830 configured to sense whether the water vessel for humidification 51 is mounted. Alternatively, the humidification module 300 may be provided with another type of sensor configured to sense whether the water vessel for humidification 51 is mounted.

When a collision or a squeeze occurs while the sliding door 21 slides leftwards or rightwards, rotational speed of the sliding door motor 810 may change rapidly.

FIG. 9 is a reference view for description of a change in rotational speeds while a motor operates.

FIG. 9(*a*) is a view illustrating a reduction in rotational speeds (RPM) of the sliding door motor 810 at the time of a temporary collision.

Referring to FIG. 9(*a*), rotational speed (RPM) of the sliding door motor 810 rapidly decreases for a predetermined period of time from a moment when a collision starts and then increases at its normal speed.

FIG. 9(*b*) is a view illustrating rotational speed (RPM) of the sliding door motor 810 when a squeeze occurs while the sliding door 21 is closing.

Referring to FIG. 9(*b*), rotational speed (RPM) of the sliding door motor 810 decreases rapidly from a moment when a squeeze starts.

According to the present disclosure, the control part 240 may control opening and closing operations of the sliding door 21 on the basis of rotational speed of the sliding door motor 810 as well as sensing data of the sliding door position sensor 820.

That is, as rotational speed (RPM) of the sliding door motor 810 may be used as feedback data, the control part 240 may effectively confirm a squeeze or a collision and the like of the sliding door 21.

Thus, safety accidents caused by opening and closing operations of the sliding door 21 may be prevented.

The humidification module control part 246 may control the sliding door 21 such that the sliding door 21 slides to be closed according a sliding door-off instruction.

The humidification module control part 246 may stop moving of the sliding door 21 and may finish a closing operation of the sliding door 21 when the first position sensor 820*a* senses the sliding door 21 while the sliding door 21 performs the closing operation.

The first position sensor 820*a* may be disposed at a position corresponding to a start point of movement of the sliding door 21 and may sense a state where the sliding door 21 is closed.

That is, when the first position sensor 820*a* senses that the sliding door 21 moves to the start point of movement and arrives at a closing position, the humidification module control part 246 may stop rotation of the sliding door motor 810 and may finish the closing operation.

The humidification module control part 246 may stop movement of the sliding door 21, when the first position sensor 820*a* does not sense the sliding door 21 and rotational speed of the sliding door motor 810 is reduced while the sliding door 21 performs a closing operation.

That is, when rotational speed of the sliding door motor 810 decreases in a state where the sliding door 21 moves to the start point of movement and does not yet arrive at the closing position, the control part 240 may determine that a collision or a squeeze has occurred.

Accordingly, the control part 240 may stop the sliding door motor 810 such that the sliding door 21 stops moving.

Additionally, a body part may continue to be stuck in a space between the sliding door 21 and the cabinet assembly (I) in a squeeze, the control part 240 needs to open the sliding door 21.

The humidification module control part 246 may stop the sliding door motor 810 to stop movement of the sliding door 21 when rotational speed of the sliding door motor 810 decreases in a state where the sliding door 21 does not finish a closing operation.

For example, the humidification module control part 246 may control the sliding door 21 such that the sliding door 21 stops and then performs an opening operation, thereby preventing a safety accident.

According to the present disclosure, a squeeze of a body part, which may occur while the sliding door 21 is closed, may be sensed, and action may be taken.

The humidification module control part 246 may control the sliding door 21 such that the sliding door 21 slides to be opened according to a sliding door-on instruction.

The humidification module control part 246 may stop movement of the sliding door and may finish an opening operation of the sliding door when the second position sensor 820*b* senses the sliding door 21 while the sliding door 21 performs the opening operation.

The second position sensor 820*b* may be disposed at a position corresponding to an end point of movement of the sliding door 21 and may sense a state where the sliding door 21 is open.

That is, when the second position sensor 820*b* senses that the sliding door 21 moves to the end point of movement and arrives at an opening position, the humidification module control part 246 may stop rotation of the sliding door motor 810 and may finish the opening operation.

The humidification module control part 246 may stop movement of the sliding door 21, when the second position sensor 820*b* does not sense the sliding door 21 and rotational speed of the sliding door motor is reduced while the sliding door 21 performs an opening operation.

That is, when rotational speed of the sliding door motor 810 decreases in a state where the sliding door 21 moves to the end point of movement and does not yet arrive at the opening position, the control part 240 may determine that a collision or a squeeze has occurred.

Accordingly, the control part 240 may stop the sliding door motor 810 such that the sliding door 21 stops moving.

In this case, the control part 240 may output a notification of abnormality.

For example, the humidification module control part 246 may stop the sliding door motor 810, and the display module control part 245 may control the display module 29 such that the display module 29 displays a message of abnormality.

Further, the main control part 241 may control the audio output part 126 such that the audio output part 126 outputs a message of abnormality.

According to the present disclosure, a squeeze of a body part is unlikely to occur while the sliding door 21 is opened, but a momentary collision is likely to occur.

The control part 240 may stop movement of the sliding door 21 and then may inform a user about an abnormality allowing the user to react to the abnormality.

The exemplary air conditioner may include proximity sensors 2961, 124 configured to sense whether a user approaches. A photosensor, a PIR sensor, a Doppler sensor and the like capable of sensing a human body may be applied to the first proximity sensor 2961.

The first proximity sensor 2961 configured to sense whether a user approaches may be provided. For example, the first proximity sensor 2961 may be disposed at the display module 29.

The display module control part 245 may receive a signal from the first proximity sensor 2961 and may deliver the signal to the humidification module control part 246 and/or the main control part 241.

When the first proximity sensor 2961 senses a user approaching, the display module control part 245 may control the display module 29 such that the display module 29 outputs a notification that encourages the user to withdraw.

The humidification module control part 246 may reduce speed of movement of the sliding door 21 if the first proximity sensor 2961 senses a user approaching while the sliding door 21 performs a closing operation.

That is, the humidification module control part 246 may reduce rotational speed of the sliding door motor 810 and may reduce speed of movement of the sliding door 21 in response to a user being in proximity to the air conditioner.

Accordingly, the user may be prevented from being stuck while the sliding door 21 is closed.

Additionally, the humidification module control part 246 may stop movement of the sliding door 21 for a predetermined period of time and then may restart an opening operation of the sliding door 21 when the first proximity sensor 2961 senses a user approaching while the sliding door 21 performs the opening operation.

As a squeeze of a body part is less likely to occur when the sliding door performs an opening operation than when the sliding door performs a closing operation, the humidification module control part 246 may control the sliding door such that the sliding door stops the opening operation temporarily and then may continue to perform the opening operation again, in response to a user close to the air conditioner, thereby ensuring improvement in safety and efficiency.

Additionally, the control part 240 may control the display module 29 and/or the audio output part 126 such that the display module 29 and/or the audio output part 126 outputs a notification that encourages a user to withdraw, when the opening operation is temporarily stopped.

According to the present disclosure, presence of a user in a forward direction may be sensed using the first proximity sensor 2961, a warning notification may be output, and speed of a closing operation of the door may be reduced, thereby preventing a squeeze or a collision.

According to the present disclosure, a collision and a squeeze, which may occur while the sliding door 21 is opened and closed, may be sensed, and action may be taken.

Thus, damage caused by a squeeze in the sliding door 21 or a collision with the sliding door 21 may be minimized.

The circulator module 31 may move backwards according to a product-off instruction and may move forwards according to a product-on instruction.

As described herein, the product-off instruction may be a power-off input for turning off the air conditioner. Alternatively, the product-off instruction may be an instruction corresponding to a specific mode in which the circulator module 31 does not operate and the circulator door 25 is closed.

As described herein, the product-on instruction may be a power-on input for supplying power to the air conditioner. Alternatively, the product-on instruction may be an instruction corresponding to a specific mode in which the circulator door 25 is opened and the circulator module 31 operates.

The circulator module 31 may operate under control of the main control part 241. The main control part 241 may control the circulator module 31 in a smart way depending on a user's position sensed by the first proximity sensor and/or a vision module 22.

For example, when a user is sensed from far away, the circulator module 31 may rotate to face an upper side, and then a circulator fan may operate such that air is sent closer to a user at the time of cooling and air purification.

The control part 240 may control the circulator door 25 such that the circulator door 25 moves downwards and is opened according to the product-on instruction, and may control the circulator door 25 such that the circulator door 25 moves upwards and is closed according the product-off instruction.

The display module control part 245 may control the circulator door 25 such that the circulator door 25 moves downwards and is opened according to the product-on instruction, and may control the circulator door 25 such that the circulator door 25 moves upwards and is closed according the product-off instruction.

Additionally, the display module control part 245 may control a circulator door step motor 850 on the basis of data sensed by the first proximity sensor 2961.

When the product-off instruction is received and the first proximity sensor 2961 does not sense a user within a predetermined distance, the display module control part 245 may control the circulator door 25 such that the circulator door 25 moves upwards and is closed.

The display module 29 may output various types of warning information under the control of the display module control part 245.

When the first proximity sensor 2961 senses a user within a predetermined distance, the display module control part 245 may control the display module 29 such that the display module 29 displays warning information.

Further, the display module 29 may output a notification that encourages a user to withdraw prior to a sliding operation of the sliding door 21.

The audio output part 126 may also output a notification that encourages a user to withdraw.

FIGS. 10 to 14 are reference views for description of a control method of an exemplary air conditioner.

FIG. 10 is a view illustrating a state where a circulator door 25 of the exemplary air conditioner is closed up to a final closing position (a position at which the circulator door is completely closed), FIG. 11 is a view illustrating a state where the circulator door 25 of the exemplary air conditioner is opened up to a final opening position (a position at which the circulator door is completely opened), and FIG. 12 is a view illustrating a door panel 21 seen in a direction of an inner surface in a state where the circulator door 25 is opened.

FIG. 13 is a view illustrating an example where a first proximity sensor 2961 senses a user 1300 within a reference distance (R).

FIG. 14 is a view specifically illustrating a lower end when a sliding door 21 of the exemplary air conditioner is opened, and illustrating a first position sensor 820*a* and a second position sensor 820*b* included in a sliding door position sensor 820.

Referring to FIGS. 10 to 14, the first proximity sensor 2961 and/or a vision module 22 may sense whether a user approaches.

In some embodiments, the vision module 22 may be configured to move upwards and operate while the air conditioner operates. In some cases, the vision module 22 may move downwards and may be accommodated in an indoor unit main body 10 according to an instruction for a product-off operation. In this case, the first proximity sensor 2961 may sense a human body to prevent a safety accident such as a squeeze of a finger and the like, for example.

The first proximity sensor 2961 may be disposed at a display module 29. When the first proximity sensor 2961 is disposed at the display module 29, the first proximity sensor 2961 may sense that a user does not withdraw after the user inputs a product-off instruction and the like, accurately and rapidly.

A circuit element and the like for the first proximity sensor 2961 may be mounted onto a board with which the display module 29 is provided, thereby ensuring a simpler configuration of a circuit and a connection wire.

Referring to FIGS. 10 to 14, the circulator door 25 may open and close a discharge opening 211*a*, and may be configured to discharge air outwards, processed by the air conditioner, such as heat-exchanged air, purified air and the like.

When the main body operates, the circulator door 25 may be opened and a circulator module 31 may be exposed outwards such that air is discharge out of the discharge opening 211*a*, or the circulator module 31 may move forwards through the discharge opening 211*a*, and when the main body stops operating, the circulator door 25 may be closed such that the discharge opening 211*a* is blocked. The door panel 21 may be provided with a space, in which the circulator door 25 is accommodated when the discharge opening 211 a is opened, at an inside thereof or on a lateral surface thereof.

The door panel 21 may be provided with moving means 850, 855 for moving the circulator door 25, on one surface of the inside thereof. For example, the door panel 21 may be provided with a circulator door step motor 850, and a gear member, a rail member 855 and the like for moving the circulator door 25 upwards or downwards depending on rotation of the circulator door step motor 850, on one surface inside the door panel 21.

The circulator door 25 may be configured to move upwards or downwards inside the indoor unit main body 10 to be opened. As the circulator door 25 may be disposed at an upper side of the door panel 21 of the indoor unit main body 10, the circulator door 25 may be configured to move downwards to be opened from a perspective of space usability.

Alternatively, the circulator door 25 may be configured to move backwards towards the inside of the indoor unit main body 10 and then to move upwards or downwards to be opened. In this case, the circulator door 25 may be configured to move backwards towards the inside of the indoor unit main body 10 and then to move downwards to be opened from a perspective of space usability.

When the circulator door 25 is opened, the circulator module 31 may make a forward movement in a forward direction facing the door panel 21 to discharge air. At least part of the circulator module 31 may pass through the discharge opening 211*a* and may be exposed outwards.

When the air conditioner stops operating, the circulator module 31 may move backwards towards the inside of the indoor unit main body 10 and the discharge opening may be blocked because of movement of the circulator door 25.

The moving means 850, 855 for moving the circulator door 25, for example, may include a circulator door step motor 850, a pinion provided with rotational force from the circulator door step motor 850, a shaft which is provided with a pair of pinions at both ends thereof, a guide rail 855 and the like.

An angle of rotation of the circulator door step motor 850 may be determined based on the number of input pulses. In the case of a step motor where the number of input pulses is 360 and which makes one rotation, an angle of rotation may be one degree each time one pulse is input.

The step motor is often inexpensive and is useful for accurate control of an angle (a position).

Driving methods of the step motor may be classified as a unipolar one and a bipolor one with respect to a direction of current. Driving methods of the step motor may also be classified as a constant voltage one, a voltage conversion one, and a constant current one with respect to a control method of excitation current.

The present disclosure is not intended to limit a driving method of the step motor. Additionally, the moving means for moving the circulator door 25 may have a structure different from the above-described structure.

The circulator door step motor 850 may be disposed at both ends or one end of the shaft and may supply rotational force.

When the circulator door step motor 850 rotates, the circulator door 25 may move along a guide rail 855.

When an instruction for a product-off operation is input, a control part 240 may confirm sensing data of the first proximity sensor 2961.

The control part 240 may determine whether a user approaches within a range of distances at which the user reaches out to touch the circulator door 25 and/or the discharge opening 211*a*.

If a user is within a predetermined reference distance, the control part 240 may control a sliding step motor such that the sliding step motor does not start operating or stops operating.

The control part 240 may also control an audio output part 126 such that the audio output part 126 outputs a vocal warning.

The control part 240 may control the display module 29 such that the display module 29 displays a warning.

Then, if the user is not within the reference distance, the control part 240 may control the circulator door 25 such that the circulator door 25 is moved and closed.

Sensing data of the first proximity sensor 2961 may be used in the processes of opening and closing the sliding door 21.

For example, when the first proximity sensor 2961 senses a user within a predetermined distance prior to a sliding movement of the sliding door 21, a display module control part 245 may control the display module 29 such that the display module 29 displays a notification that encourages the user to withdraw.

The audio output part 126 may output a notification that encourages the user to withdraw.

A humidification module control part 246 may reduce speed of movement of the sliding door 21 when the first proximity sensor 2961 senses a user within a predetermined distance.

The humidification module control part 246 may control opening and closing operations of the sliding door 21 on the basis of sensing data of a sliding door position sensor 820 and rotational speed of a sliding door motor 810.

Referring to FIGS. 10 to 14, the first position sensor 820*a* and the second position sensor 820*b* configured to detect a position of the sliding door 21 may be disposed at a base 12.

For example, the first position sensor 820*a* and the second position sensor 820*b* may be spaced apart from each other, and a distance between the first position sensor 820*a* and the second position sensor 820*b* may be set to correspond to a distance moved by the sliding door 21.

The sliding door 21 may be opened to readily take out the water vessel for humidification 51 configured to supply water used by a humidification module 300. In some implementations, a range of movements of the sliding door 21 may be determined so that a space for the water vessel for humidification 51 to be taken out may be ensured. The first position sensor 820*a* and the second position sensor 820*b* may be disposed respectively on the left and the right of the water vessel for humidification 51.

The first position sensor 820*a* may sense a state where the sliding door 21 is closed, and the second position sensor 820*b* may sense a state where the sliding door is open. To this end, the first position sensor 820*a* may be disposed at a position corresponding to a start point of movement of the sliding door 21 and sense the state where the sliding door 21 is closed, and the second position sensor 820*b* may be disposed at a position corresponding to an end point of movement of the sliding door and may sense the state where the sliding door 21 is open.

The control part 240 may monitor rotational speed (RPM) of the sliding door motor 810 depending on an opening operation or a closing operation of the sliding door 21.

To this end, the control part 240 may be provided with a sensor for sensing rotational speed (RPM) of the sliding door motor 810. For example, the control part 240 may be provided with a Hall sensor that senses rotational speed (RPM) of the sliding door motor 810.

Alternatively, a sensor part 215 may be provided with a Hall sensor and the like, and the control part 240 may control the sliding door motor 810 on the basis of sensing data received from the sensor part 215.

Alternatively, according to one embodiment, rotational speed of the sliding door motor 810 may be calculated based on any one of publicly-known senseless methods.

The control part 240 may monitor whether rotational speed (RPM) of the sliding door motor 810 reaches and maintain a normal level.

When the first position sensor 820*a* or the second position sensor 820*b* correctly senses the sliding door 21 at an exact position, the control part 240 may stop the sliding door motor 810 and may finish an opening operation or a closing operation of the sliding door 21.

In the processing of monitoring whether rotational speed (RPM) of the sliding door motor 810 reaches and maintains a normal level, a change in rotational speeds (RPM), caused by to a squeeze or a collision, may be sensed.

When the rotational speed (RPM) changes rapidly while the sliding door 21 performs an opening operation, the control part 240 may control the sliding door 21 such that the sliding door 21 stops the opening operation.

When the rotational speed (RPM) changes rapidly while the sliding door 21 performs a closing operation, the control part 240 may control the sliding door 21 such that the sliding door 21 is opened.

Referring to FIGS. 10 to 14, when the first proximity sensor 2961 senses a user, a projection module 123 may project characters such as "open door" and the like, and a graphic object in a forward direction of the second proximity sensor 124.

Accordingly, the user ready to open the sliding door 21 may be induced to move in the forward direction of the second proximity sensor 124.

The projection module 123 may include one or more light sources for displaying characters or a graphic object or for outputting light of a predetermined pattern, and a driver. For example, the projection module 123 may include a light emitting diode (LED), a laser diode (LD), and the like as a light source.

In some embodiments, the projection module 123 may project light of a predetermined color in the forward direction of the second proximity sensor 124 without projecting characters or a graphic object.

In some embodiments, when the first proximity sensor 2961 senses the user, the display module 29 may display characters such as "open door" and the like, and a graphic object and may ask the user a touch input corresponding to a sliding door-on input.

FIG. 15 is a flow chart illustrating a control method of an exemplary air conditioner and shows a process of closing a sliding door.

Referring to FIG. 15, a humidification module control part 246 may control the sliding door 21 such that the sliding door 21 starts a closing operation according to a sliding door-off instruction (S1510).

A user may input a sliding door-off instruction using a voice input or a touch input through a display module 29 or an operation of a remote controller and the like. In some embodiments, the control part may confirm a sliding door-off instruction on the basis of data sensed by a second proximity sensor 124 and the like.

The humidification module control part 246 may monitor whether rotational speed (RPM) of a sliding door motor 810 reaches and maintains a normal level during a closing operation of the sliding door 21 (S1520).

When a first position sensor 820*a* senses the sliding door 21 (S1530), the humidification module control part 246 may stop movement of the sliding door 21 (S1560), and may control the sliding door 21 such that the sliding door 21 finishes the closing operation (S1570).

When the first position sensor 820*a* senses the sliding door 21 moving to a start point of movement and reaching a closing position (S1530), the humidification module control part 246 may stop rotation of the sliding door motor 810 (S1560), and may finish the closing operation (S1570).

When during a closing operation of the sliding door 21, the first position sensor 820*a* does not sense the sliding door 21 (S1530) and rotational speed of the sliding door motor 810 decreases (S1540), the humidification module control part 246 may control the sliding door 21 such that the sliding door 21 is opened after the sliding door 21 stops moving (S1550).

In a state where the sliding door 21 moves to the start point of movement and does not reach the closing position, a decrease in the rotational speed of the sliding door motor 810 may denote a collision or a squeeze.

When the humidification module control part 246 controls the sliding door 21 such that the sliding door 21 is opened after the sliding door 21 stops, a safety accident such as a squeeze of a body part may be prevented from happening.

FIG. 16 is a flow chart illustrating a control method of an exemplary air conditioner and shows a process of opening a sliding door.

Referring to FIG. 16, a humidification module control part 246 may control the sliding door 21 such that the sliding door 21 starts an opening operation according to a sliding door-on instruction (S1610).

A user may input a sliding door-on instruction using a voice input or a touch input through a display module 29 or an operation of a remote controller and the like. In some embodiments, the control part may confirm a sliding door-on instruction on the basis of data sensed by a second proximity sensor 124 and the like.

The humidification module control part 246 may monitor whether rotational speed (RPM) of a sliding door motor 810 reaches and maintains a normal level during an opening operation of the sliding door 21 (S1620).

When a second position sensor 820*b* senses the sliding door 21 (S1630) during the opening operation of the sliding door 21, the humidification module control part 246 may stop movement of the sliding door 21 (S1660), and may control the sliding door 21 such that the sliding door 21 finishes the closing operation (S1670).

When the second position sensor 820*b* senses the sliding door 21 moving to an end point of movement and reaching an opening position (S1630), the humidification module control part 246 may stop rotation of the sliding door motor 810 (S1660), and may finish the opening operation (S1670).

When during an opening operation of the sliding door 21, the second position sensor 820*b* does not sense the sliding door 21 (S1630) and rotational speed of the sliding door motor 810 decreases (S1640), the humidification module control part 246 may control the sliding door 21 such that the sliding door 21 stops moving (S1650).

Further, the control part 240 may control an output of a notification of abnormality (S1650).

For example, the humidification module control part 246 may stop the sliding door motor 810, and a display module control part 245 may control a display module 29 such that the display module 29 displays a message of abnormality.

A main control part 241 may control an audio output part 126 such that the audio output part 126 outputs a message of abnormality.

According to the present disclosure, a collision and a squeeze that may occur while the sliding door 21 is opened and closed, may be sensed, and action may be taken.

Thus, damage caused by a squeeze or a collision of the sliding door 21 may be minimized.

FIG. 17 is a flow chart illustrating a control method of an exemplary air conditioner, and shows a process where a sliding door moves based on whether to sense a user.

Referring to FIG. 17, a first proximity sensor 2961 may sense whether a user is present within a predetermined range in front of the air conditioner (S1710).

When a user is sensed before or during an opening operation or a closing operation of the sliding door 21, a control part 240 may control at least one of a display module 29 and an audio output part 126 such that at least one of the display module 29 and the audio output part 126 outputs a notification encouraging a withdrawal (S1720).

The control part 240 may control operations of the sliding door 21 depending on a current state of an opening operation or a closing operation of the sliding door 21.

When the sliding door 21 is performing an opening operation (S1730), the control part 240 may restart the opening operation of the sliding door 21 after stopping movement of the sliding door 21 for a predetermined period of time (S1740).

As a squeeze is less likely to occur when the sliding door performs an opening operation than when the sliding door performs a closing operation, a humidification module control part 246 may control the sliding door such that the sliding door stops the opening operation temporarily and then may continue to perform the opening operation again, in response to a user in proximity to the air conditioner, thereby ensuring improvement in safety and efficiency.

When the sliding door 21 is performing a closing operation (S1730), the control part 240 may reduce rotational speed of a sliding door motor 810 to reduce speed of movement of the sliding door 21 (S1750).

The sliding door 21 may move at low speed to safely finish the closing operation (S1760).

According to the present disclosure, the air conditioner may sense whether a user is in front of the air conditioner using a first proximity sensor 2961, may output a warning notification, and may adjust speed at which the door is closed, thereby preventing a squeeze or a collision.

FIG. 18 is a flow chart illustrating a control method of an exemplary air conditioner, and shows a process of opening a sliding door.

Referring to FIG. 18, when a first proximity sensor 2961 senses a user (S1810), and a touch is input through a display module 29 or a second proximity sensor 124 senses the user (S1820), a control part 240 may determine it as a sliding door-on input.

Accordingly, the control part 240 may control a sliding door motor 810 such that the sliding door motor 810 rotates (S1830).

For example, when the first proximity sensor 2961 senses a user (S1810), a projection module 123 may project characters such as "open door" and the like and a graphic object in a forward direction of the second proximity sensor 124.

Accordingly, the user who is ready to open the sliding door 21 may be induced to move to the forward direction of the second proximity sensor 124.

Further, when the first proximity sensor 2961 senses the user (S1810), the display module 29 may display characters such as "open door" and the like, and a graphic object and may ask the user for a touch input corresponding to the sliding door-on input.

When the first proximity sensor 2961 senses the user (S1810), and a touch is input through the display module 29 or the second proximity sensor 124 senses the user (S1820), the control part 240 may control the sliding door motor 810 such that the sliding door 21 is opened (S1830).

Thus, the sliding door 21 may be opened without an incorrect operation to meet the user's intention.

The control part 240 may reduce speed of the sliding door 21 at a first distance before the sliding door 21 reaches an end point of movement (S1840), and may control the sliding door motor 810 such that the sliding door motor 810 stops rotating at a second distance right before the sliding door reaches the end point of movement (S1850).

For example, when the sliding door 21 is sensed at a point that is 3 cm before the second position sensor 820*b*, the control part 240 may decrease rotational speed (RPM) of the sliding door motor 810. Accordingly, speed of the sliding door 21 may decrease (S1840).

Additionally, when the sliding door 21 is sensed at a point that is 1 cm before the second position sensor 820*b*, the control part 240 may control the sliding door motor 810 such that the sliding door motor 810 stops rotating (S1850).

Thus, noise that is made due to an over swing may be prevented, and the sliding door 21 may be smoothly opened to an exact position.

FIG. 19 is a flow chart illustrating a control method of an exemplary air conditioner, and shows a process of closing a sliding door.

Referring to FIG. 19, when a touch input or a voice input and the like is received as a sliding door-off input (S1910), a control part 240 may confirm whether a water vessel for humidification 51 is mounted through a Hall sensor 830 (S1920).

When the water vessel for humidification 51 is mounted onto an exact position (S1920), the control part 240 may control a sliding door motor 810 such that the sliding door 21 is closed (S1940).

When the water vessel for humidification 51 of a humidification module 300 is not mounted onto an exact position or is tilted (S1920), the control part 240 may control an output of a notification asking for placement of the water vessel for humidification 51 (S1925).

Accordingly, the sliding door 21 may be prevented from being closed in a state where the water vessel for humidification 51 is not mounted.

When the first position sensor 820*a* senses the sliding door 21 at a third distance, the control part 240 may control the sliding door motor 810 such that rotational speed of the sliding door motor 810 is reduced (S1940).

For example, when the sliding door 21 is sensed at a point that is 3 cm before the first position sensor 820*a*, the control part 240 may reduce rotational speed (RPM) of the sliding door motor 810. Accordingly, speed of the sliding door 21 may be reduced (S1940).

When the first position sensor 820*a* senses the sliding door 21 at a fourth distance shorter than the third distance, the control part 240 may control the sliding door motor 810 such that the sliding door motor 810 stops rotating (S1950).

For example, the sliding door 21 is sensed at a point that is 1 cm before the first position sensor 820*a*, the control part 240 may control the sliding door motor 810 such that the sliding door motor 810 stops rotating (S1950).

Thus, noise that is made due to an over swing may be prevented, and the sliding door 21 may be smoothly closed to an exact position.

According to at least one embodiment, provided are an air conditioner and a control method thereof that may prevent noise, an incorrect operation, and a safety accident.

According to at least one embodiment, air current may be controlled in efficient and various ways.

According to at least one embodiment, various functions such as a voice recognition function, a humidification function, and the like may be provided.

According to at least one embodiment, inner modules may be stored and managed cleanly and safely when not in use.

According to at least one embodiment, operations may be performed based on position information of a sensed user, thereby ensuring improvement in safety and user convenience.

Below, a configuration and sliding movement of an air conditioner are described with reference to FIGS. 20 to 36.

Below, an entire configuration of an indoor unit of an air conditioner according to an embodiment is described with reference to FIGS. 20 to 22.

An indoor unit of an exemplary air conditioner may include a cabinet assembly (I) forming an exterior and a front surface of which is open, a door assembly (II) configured to cover the open front surface of the cabinet assembly (I), a blowing fan assembly (III) disposed inside the cabinet assembly (I) and forming an air flow, a heat exchange assembly (not illustrated) allowing heat exchanger between refrigerants and air allowed to flow by the blowing fan assembly (not illustrated), a filter assembly (VI) configured to filter air induced into the cabinet assembly (I), a filter cleaning assembly (VII) configured to remove foreign substances on one surface of the filter assembly (VI), and a humidification assembly (V) configured to discharge humidified air out of the cabinet assembly (I).

The cabinet assembly (I) according to an aspect of the embodiment may include an upper cabinet 11 provided with a suction opening at a rear thereof and forming a space, where a heat exchanger (not illustrated) is disposed, therein, a base 12 disposed at a lower side of the upper cabinet 11 and forming a space where some components of the humidification assembly (V) are disposed, a lower cabinet 13 configured to cover a rear and sides of the base 12, and a lateral surface discharge member 14*a* disposed between the upper cabinet 11 and the door assembly (II) and forming a lateral surface discharge opening 14 from which air is discharged.

The cabinet assembly (I) according to an embodiment may include an inner cover 15 configured to cover a front surface of the upper cabinet 11 and a part of a front surface of the base 12 when the door assembly (II) is partially opened. The inner cover 15 may be disposed to cover the front surface of the upper cabinet 11 and a part of the front surface of the base 12, which are exposed when the door assembly (II) moves in any one of a leftward direction or a rightward direction such that a water vessel 51 of the humidification assembly (V) is exposed.

The base 12 may have a box shape a front surface of which is open. The lower cabinet 13 and a part of the lateral discharge member 14*a* may be disposed at an outer edge of the base 12.

In a state where the base 12 and the upper cabinet 11, which are disposed in an up-down direction, are coupled, the door assembly (II) may be disposed on the front surface of the base 12 and the upper cabinet 11.

The lower cabinet 13 may cover a lateral surface and a rear of the base 12.

The door assembly (II) may include a door panel 21 configured to cover the front surface of the indoor unit and provided with a front discharge opening 211*a* on one side thereof, a door moving module 28 configured to move the door panel 21 in a left-right direction, a circulator door 25 configured to open and close the front discharge opening 211*a* formed on the door panel 21, a circulator door moving module 26 configured to move the circulator module 25 in the up-down direction, a display module 29 configured to display an operation state of the indoor unit or to receive a user's instruction, and a vision module 22 configured to sense conditions of an indoor space.

Conditions of an indoor space may include a size of the indoor space, the number of occupants in the indoor space, positions of occupants and the like. A configuration of the door assembly (II) may be specifically described hereunder.

The blowing fan assembly (III) may include a circulator module 31 configured to discharge air in a forward direction of the indoor unit, a lateral blowing module (not illustrated) configured to discharge air in both lateral directions of the indoor unit. The blowing fan assembly (III) according to one embodiment may include a single circulator module 31 and three lateral blowing modules. The circulator module 31 and lateral blowing modules may be disposed at a front of the heat exchange assembly (IV).

The circulator module 31 may be disposed at an upper side of the lateral blowing module. The circulator module 31 may discharge air from the circulator door 25 formed on the door panel 21.

The circulator module 31 according to an aspect of the embodiment may have a rotational configuration where the circulator module 31 move forwards when the circulator door 25 is opened and where directions faced by the discharge opening are an upward direction, a downward direction, a leftward direction, a rightward direction, or a diagonal direction.

The lateral blowing module may be disposed at a lower side of the circulator module 31. According to an embodiment, a plurality of lateral blowing modules may be disposed in the up-down direction. Each of the lateral blowing modules may discharge air through the lateral discharge opening 14*a*.

The heat exchange assembly (not illustrated) allows heat exchange between indoor air, suctioned into the upper cabinet 11, and refrigerants. The heat exchange assembly may include a heat exchanger (not illustrated) to which the refrigerants, exchanging heat with the indoor air, flow, and a refrigerant pipe (not illustrated) that forms a refrigerant flow path to suction the refrigerants into the heat exchanger or discharge the refrigerants out of the heat exchanger.

The heat exchanger may be disposed at a rear of the blowing fan assembly (III). The heat exchanger may be disposed between a suction opening and a discharge opening to allow heat exchange of air flowing in the indoor unit. The heat exchanger may be disposed between the filter assembly (VI) and the blowing fan assembly (III). The heat exchanger may have a length corresponding to a height at which the plurality of lateral blowing modules and the circulator module 31 are disposed in the up-down direction.

The humidification assembly (V) may discharge humidified air out of the indoor unit. The humidification assembly (V) may include a water vessel 51 configured to store water, a heating part (not illustrated) supplied with water of the water vessel 51 and configured to heat the water, a humidification discharge nozzle (not illustrated) provided with a humidification discharge opening configured to discharge the heated humidified air, and a humidification flow pipe (not illustrated) configured to guide the humidified air, heated by the heating part, to the humidification discharge nozzle. The humidification assembly (V) may include a tilting member (not illustrated) configured to adjust an angle at which the water vessel 51 is disposed. The water vessel 51 may be tilted forwards by the tilting member.

The water vessel 51 and the heating part may be disposed in an inner space of the base 12. The humidification discharge nozzle, formed at an end of the humidification flow pipe, may be disposed at a portion where the lateral discharge opening 14*a* is formed. Accordingly, the humidified air, discharged from the humidification discharge nozzle, may be discharged out of the indoor unit along with air flowing to the lateral discharge opening 14*a* by the lateral blowing module.

The water vessel 51 may be tilted forwards at a predetermined angle when the door assembly (II) exposes a front surface of the water vessel 51 entirely. It may be determined that the door panel 21 moves to expose the front surface of the water vessel 51 entirely on the basis of a position of the door panel 21, which is sensed by a below-described first position sensor 127*a* and a second position sensor 127*b*.

The filter assembly (VI) may remove foreign substances from air suctioned into the suction opening. The filter assembly (VI) may be movably disposed at a rear of the upper cabinet 11. The filter assembly (VI) may be disposed at the suction opening formed at the rear of the upper cabinet 11 and may filter indoor air suctioned into the suction opening 11. The filter assembly (VI) may be movably disposed at the upper cabinet 11.

The filter assembly (VI) according to an embodiment may include a filter module 61 configured to remove foreign substances from air suctioned into/through the suction opening. In the filter assembly (VI), the filter module 61 may be disposed at the suction opening or outside a lateral surface of the upper cabinet 11. A plurality of filter modules 61 may be disposed at the rear of the upper cabinet 11 where the suction opening is formed.

The filter assembly (VI) according to one embodiment may include a filter module 61 configured to remove foreign substances from flowing air, a filter mounting member (not illustrated) onto which the filter module 61 is mounted, and a moving member (not illustrated) configured to change a position of the filter mounting member.

A position of the filter module 61 according to an embodiment may be changed by the filter mounting member and the moving member. That is, the filter module 61 may be disposed at the suction opening formed at the rear of the upper cabinet 11 or outside the lateral surface of the upper cabinet 11 by the filter mounting member and the moving member.

The filter cleaning assembly (VII) may be movably disposed at a rear of the filter assembly (VI) and may remove foreign substances outside the filter assembly (VI). The filter cleaning assembly (VII) may move upwards and downwards along a guide rail (not illustrated) disposed at the rear of the upper cabinet 11.

The filter cleaning assembly (VII) may remove and suction foreign substances outside the filter assembly (VI) to remove foreign substances at the filter module 61 while moving upwards and downwards along the guide rail.

The filter cleaning assembly (VII) may include a filter cleaner 71 that removes foreign substances at the filter module 61 while moving along the guide rail, and a power supply device (not illustrated) connected to the filter cleaner 71 by a power supply cable (not illustrated) and configured to supply power to the filter cleaner 71.

Below, a door assembly according to an embodiment is described with reference to FIGS. 23 to 32 and FIG. 35.

The door assembly (II) may include a door panel 21 where a front discharge opening 211*a* may be formed, a circulator door 25 configured to open and close the front discharge opening 211*a*, a door moving module 28 configured to move the door panel 21 in a left-right direction of a cabinet assembly (I), a circulator door moving module 26 configured to move the circulator door 25 in an up-down direction, and a display module 29 configured to visually supply information of an indoor unit to the door panel 21.

The door assembly (II) according to one embodiment may further include an upper panel 23 which is coupled to a rear surface of the door panel 21, which is configured to support a structure of the door panel 21 and where a panel discharge opening 23*a* is formed, a lower panel 24 which is coupled to the rear surface of the door panel 21, which supports the structure of the door panel 21 and which is disposed at a lower side of the upper panel 23, and a vision module 22 which is disposed at an upper side of the upper panel 23 and which is configured to capture an image of an indoor space, and a cable guide 27, an upper end of which is assembled to the circulator door 25 in a relatively rotatable manner, a lower end of which is assembled to the upper panel 23 in a relatively rotatable manner and which stores a cable connected to the circulator door 25.

The door panel 21 may be disposed on a front surface of the indoor unit. The door panel 21 may include a front surface part 211, a first lateral surface part 212*a* disposed on the left of the front surface part 211 and configured to cover left lateral surfaces of the upper panel 23 and the lower panel 24, and a second lateral surface part 212*b* disposed on the right of the front surface part 211 and configured to cover right surfaces of the upper panel 23 and the lower panel 24.

A front discharge opening 211*a* open in a front-rear direction, and a display hole 211*b* open in a front-rear direction of the front surface part 211 may be formed at the front surface part 211.

The front discharge opening 211*a* and the display hole 211*b* may be arranged in the up-down direction. The display hole 211*b* may be disposed at a lower side of the front discharge opening 211*a*. In another embodiment, the display hole 211*b* may also be disposed at an upper side of the front discharge opening 211*a*.

The front discharge opening 211*a* may have a circular shape. The shape of the front discharge opening 211*a* may correspond to a shape of a front surface of a discharge grille 311. Through the front discharge opening 211*a*, the discharge grille 311 hidden in the cabinet assembly (I) may be exposed outwards.

When the front discharge opening 211*a* is opened, a circulator module 31 may move towards the front discharge opening 211*a*, and the discharge grille 311 may pass through the front discharge opening 211*a* and protrude further forwards than the door panel 21.

The first lateral surface part 212*a* may protrude backwards from a left edge of the front surface part 211, and may cover left surfaces of the upper panel 23 and the lower panel 24 that are fixed to a rear surface of the front surface part 211.

The second lateral surface part 212*b* may protrude backwards from a right edge of the front surface part 211 and may cover right surfaces of the upper panel 23 and the lower panel 24 that are fixed to the rear surface of the front surface part 211. The first lateral surface part 212*a* and the second lateral surface part 212*b* may block lateral surfaces of the upper panel 23 and the lower panel 24 from being exposed outwards.

In one embodiment, the front surface part 211, the first lateral surface part 212*a*, and the second lateral surface part 212*b*, which constitute the door panel 21, may be integrally manufactured. In another embodiment, the door panel 21 may be made of a metallic material entirely. Specifically, the door panel 21 may be made of aluminum entirely.

A first bent part 212*a*1 and a second bent part 212*b*1, perpendicularly bent in a direction of a center of the door panel, may be formed at an end of each of the first lateral surface part 212*a* and the second lateral surface part 212*b*. The upper panel 23 and the lower panel 24 may be disposed inside the first bent part 212*al*, the second bent part 212*b*1 and the front surface part 211.

Accordingly, the front surface part 211, the first lateral surface part 212*a*, the second lateral surface part 212*b*, the first bent part 212*al* and the second bent part 212*b*1 may form an insertion space 213 in a rear direction of the front surface part 211, and the upper panel 23, and the lower panel 24 may be inserted into the insertion space 213. The upper panel 23 and the lower panel 24 may be fitted, fixed and disposed in the insertion space 213 formed at a rear of the front surface part 211.

The upper panel 23 and the lower panel 24 may be respectively manufactured, and the upper panel 23 may be inserted into the door panel 21 through an upper side of the door panel 21 while the lower panel 24 may be inserted into the door panel 21 through a lower side of the door panel 21.

The upper panel 23 and the lower panel 24 may be inserted and fixed into the insertion space 213 of the door panel 21, may support the door panel 21 and may prevent the door panel 21 from being deformed and bent.

In one embodiment, the upper panel 23 and the lower panel 24 may support the front surface part 211, the first lateral surface part 212*a* and the second lateral surface part 212*b* that are frequently affected by an external impact.

The upper panel 23 may have a plate shape, and may be disposed on a rear surface of the door panel 21. The upper panel 23 may have a panel discharge opening 23*a* that passes through the upper panel 23 in the front-rear direction of the upper panel 23 and that is disposed at a rear of the front discharge opening 211*a* to communicate with the front discharge opening 211*a*.

The panel discharge opening 23*a* may correspond to the front discharge opening 211*a*. The front discharge opening 211*a* may be disposed further forwards than the panel discharge opening 23*a*. In one embodiment, the panel discharge opening 23*a* and the front discharge opening 211*a* all may have a circular shape. To prevent discharged air from leaking, a gasket (not illustrated) may be disposed between the panel discharge opening 23*a* and the front discharge opening 211*a*.

The panel discharge opening 23*a* may have a surface area the same as or larger than that of the front discharge opening 211*a*. In another embodiment, considering installation of the gasket, the panel discharge opening 23*a* may have a larger diameter than the front discharge opening 211*a*.

The discharge grille 311 of the circulator module 31 may consecutively pass through the panel discharge opening 23*a* and the front discharge opening 211*a*, and may protrude further forwards than a front surface of the door panel 21.

In the embodiment, the circulator door 25 and the display module 29 may be installed on the upper panel 23.

The circulator door 25 and the display module 29 may all be mounted onto the door panel 21 in a state where they are assembled to the upper panel 23.

The upper panel 23 may include a display module mounting part 232 onto which the display module 29 is mounted. A display case 291 of the below-described display module 29 may be mounted onto the display module mounting part 232. The display module mounting part 232 formed on the upper panel 23 may be formed into a hole corresponding to the display case 291. The display module mounting part 232 may include a coupling part (not illustrated) that is coupled to the display case 291 using an additional coupling member (nor illustrated).

The display module 29 may be fixed to the display module mounting part 232 of the upper panel 23 by the display case 291. A degree to which the display module 29 protrudes forwards from the upper panel 23 may be minimized by the display case 291.

The display case 291 may be disposed to pass through the upper panel 23 in the front-rear direction.

The display module 29 may be partially exposed outwards through the display hole 211*b* of the door panel 21 in a state where the display module 29 is assembled to the upper panel 23. In the state where the display module 29 is exposed outwards through display hole 211*b*, the display module 29 may form a surface that continues from the front surface of the door panel 21.

That is, a front surface of a front glass 292 disposed at a front of the display module 29 may not protrude further forwards than the door panel 21, and may form a flat surface that continues from the front surface of the door panel 21.

The display module 29 may transmit and receive power and electric signals through a cable that passes through the upper panel 23.

The circulator door 25 may be disposed on a rear surface of the upper panel 23 and may move in the up-down direction along the rear surface of the upper panel 23.

When the circulator door 25 moves downwards after opening the front discharge opening 211*a*, the circulator door 25 may be placed at the same height as the display module 29.

The circulator door 25 may be disposed to move in the up-down direction with respect to the upper panel 23.

In the embodiment, the upper panel 23 and the lower panel 24 may be stacked in the up-down direction. As the upper panel 23 and the lower panel 24 may be mutually assembled in the door panel 21, vibration or other noise made at the time of operation may be minimized when the door assembly (II) makes a sliding movement.

To this end, the upper panel 23 and the lower panel 24 may be assembled in a shrink-fitted form. Any one of the upper panel 23 and the lower panel 24 may have a panel projection protruding towards the other, and the other may have a panel fitting part 24*a* in which the panel projection is accommodated.

In one embodiment, the panel projection 233 may be formed at the upper panel 23. The panel projection 233 may protrude downwards from a lower end of the upper panel 23.

The lower panel 24 may be disposed on the rear surface of the door panel 21. The lower panel 24 may be installed in the insertion space 213 of the door panel 21. The lower panel 24 may be disposed at a lower side of the upper panel 23, may support the upper panel 21, and may be assembled to the upper panel 21.

The lower panel 24 may be installed in the door panel 21 to prevent the door panel 21 from being deformed. The lower panel 24 may be shrink-fitted to the upper panel 23 and may support the upper panel 23 from a lower side.

The panel fitting part 24*a*, which is insertion-coupled to the panel projection 233 of the upper panel 23, may be formed at an upper side of the lower panel 24. The panel fitting part 24*a* may concave downwards.

The lower panel 24 may be provided with a door driver 282.

The circulator door 25 may be a component for opening and closing the front discharge opening 211*a* disposed at the door assembly (II).

The circulator door 25 may open the front discharge opening 211*a* to extend a moving path of the circulator module 31. The circulator module 31 may protrude outside of the door assembly (II) through the opened front discharge opening 211*a*.

The circulator door 25 may be disposed on the moving path of the circulator module 31. When opening the front discharge opening 211*a*, the circulator door 25 may move outside the moving path of the circulator module 31.

The circulator door 25 may include a door cover 251 disposed at the front discharge opening 211*a* and configured to move in the front-rear direction of the front discharge opening 211*a* to open and close the front discharge opening 211*a*, a door cover housing 253 forming a space, where at least part of the door cover 251 is accommodated, and configured to adjust an upper position and a lower position of the door cover 251, and a door cover moving module (not illustrated) disposed between the door cover housing 253 and the door cover 251 and configured to move the door cover 251 in the front-rear direction from the door cover housing 253.

The door cover 251 may be inserted into the front discharge opening 211*a* and may offer a surface that continues from the front surface part 211 of the door panel 21. The door cover 251 may move backwards based on an operation of the door cover moving module 252. When the circulator door moving module 26 operates after the door cover 251 is separated from the front discharge opening 211*a*, the circulator door 25 may move downwards entirely.

When the door cover 251 is moved downwards by the circulator door moving module 26, the front discharge opening 211*a* may be opened in the front-rear direction.

The circulator door moving module 26*a*, 26*b* may be a component that moves the circulator door 25 perpendicularly and that opens the front discharge opening 211*a* disposed at the door panel 21.

In one embodiment, the circulator door moving module 26*a*, 26*b* may be disposed respectively on the left and right of the door cover housing 253. In another embodiment, an air conditioner may include only one of the circulator door moving modules 26*a*, 26*b* being disposed on the left or right of the door cover housing 253.

In yet another embodiment, as the circulator door moving module 26*a*, 26*b* fixes an upper position and a lower position of the circulator door 25, the circulator door moving module 26*a*, 26*b* may be disposed respectively on the left and on the right to disperse support load of the circulator door 25.

The circulator door moving module 26*a*, 26*b* may move the circulator door 25 along the door panel 21 in the up-down direction. The circulator door moving module 26*a*, 26*b* may move the door cover housing 253, to which the door cover 251 may be coupled, entirely in the up-down direction.

The circulator door 25 may move along the insertion space 213 of the door panel 21. As the circulator door moving module 26*a*, 26*b* is disposed in the door panel 21, a space where the circulator door moving module 26*a*, 26*b* is installed may be disposed under the insertion space 213.

In an embodiment, a structure where the circulator door moving module 26*a*, 26*b* is installed in thickness less than thickness of the door panel 21 is provided. In another embodiment, a thickness of the circulator door moving module 26*a*, 26*b* in the front-rear direction may be less than a thickness of the door panel 21.

The door cover 251 on the moving path of the circulator module 31 facing the front discharge opening 211*a* may move to a lower side of the front discharge opening 211*a* on the basis of an operation of the circulator door moving module 26*a*, 26*b*.

When the door cover 251 moves downwards in a perpendicular direction, no portion of the door cover 251 may overlap the front discharge opening 211*a*. The circulator door moving module 26*a*, 26*b* may move the door cover housing 253 outside the moving path of the circulator module 31.

The circulator door moving module 26*a*, 26*b* may include a first circulator door moving module 26*a* disposed on the left of the door cover housing 253, and a second circulator door moving module 26*b* disposed on the right of the door cover housing 253.

The first circulator door moving module 26*a* and the second circulator door moving module 26*b* may be the same component and may be symmetrical.

The circulator door moving module 26*a*, 26*b* may include a rack 234*a*, 234*b* disposed at the door panel 21 or the upper panel 23 and extending in the up-down direction, a gear assembly 261*a*, 261*b* disposed at the circulator door 25, engaged with the rack 234*a*, 234*b* and configured to move along the rack 234*a*, 234*b* at the time of rotation, and a gear driving motor 262*a*, 262*b* disposed at the circulator door 25 and configured to supply driving force to the gear assembly 261*a*, 261*b*.

The circulator door moving module 26*a*, 26*b* may further include a gear housing (not illustrated) where the gear assembly 261*a*, 261*b* and the gear driving motor 262*a*, 262*b* are installed. For ease of assembly and repairs, the gear assembly 261*a*, 261*b* and the gear driving motor 262*a*, 262*b* may be assembled to the gear housing and then the gear housing may be assembled to the door cover housing 253.

The gear assembly 261*a*, 261*b* may include a first gear 2611*a*, 2611*b* disposed at the circulator door 25 and engaged with the rack 234*a*, 234*b*, a second gear 2612*a*, 2612*b* disposed at the circulator door 25 and engaged with the first gear 2611*a*, 2611*b*, a third gear 2613*a*, 2613*b* disposed at the circulator door 25 and engaged with the second gear 2612*a*, 2612*b*, and a worm gear 2614*a*, 2614*b* disposed at the circulator door 25, engaged with the third gear 2613*a*, 2613*b*, connected to the gear driving motor262*a*, 262*b* to rotate, and disposed in the up-down direction.

A motor shaft of the gear driving motor 262*a*, 262*b* may be disposed in the up-down direction.

As the circulator door moving module 26*a*, 26*b* moves in the up-down direction, a cable connected to the circulator door moving module 26*a*, 26*b* has no option but to move in the up-down direction.

As the thickness of the door assembly (II) in the front-rear direction is much smaller than a width, the cable may be tangled when the circulator door moving module 26*a*, 26*b* moves upwards and downwards.

Additionally, as the cable is fitted between the circulator door moving module 26*a*, 26*b* moving in the up-down direction and the upper panel 23, an operation of the circulator door moving module 26*a*, 26*b* may be limited. To resolve the problem, a cable guide 27 may be provided.

For the cable guide 27, an upper end may be assembled to the circulator door 25 and a lower end may be assembled to the upper panel 23.

The cable guide 27 may include a first cable guide 271 assembled to the circulator door 25 in a relatively rotatable manner, a second cable guide 272 assembled to the upper panel 23 in a relatively rotatable manner, and a connection cable guide 273 assembled respectively to the first cable guide 271 and the second cable guide 272 in a relatively rotatable manner.

An angle between the first cable guide 271 and the connection cable guide 273 is within 180 degrees, and when the circulator door 25 moves downwards, the angle between the first cable guide 271 and the connection cable guide 273 becomes small.

An angle between the second cable guide 272 and the connection cable guide 273 is within 180 degrees, and when the circulator door 25 moves downwards, the angle between the second cable guide 272 and the connection cable guide 273 becomes small.

The indoor unit according to an aspect of the embodiment may include a door moving module 28 configured to move the door panel 21 in a left-right direction of the cabinet assembly (I).

The door moving module 28 may include a guide rail 281 mounted onto the door panel 21 and configured to guide leftward and rightward movements of the door panel 21, and a door driver 282 configured to move the door assembly (II) in the left-right direction.

The guide rail 281 may include a top rail 2811 disposed at an upper side of the door assembly (II), a middle rail 2812 disposed in a middle of the door assembly (II), a bottom rail 2813 disposed at a lower side of the door assembly (II), a top supporter 2814 assembled to the door assembly (II), disposed at the upper side of the door assembly (II), and held at an upper side of the cabinet assembly (I), and a bottom supporter 2815 which is assembled to the cabinet assembly (I), which is disposed at a lower side of the cabinet assembly (I) and at which a lower end of the door assembly (II) is held.

The top rail 2811, the middle rail 2812, and the bottom rail 2813 may all be disposed in the left-right direction. The top rail 2811, the middle rail 2812, and the bottom rail 2813 may be disposed between the door assembly (II) and the cabinet assembly (I).

The top rail 2811 may include a first top rail 28111 disposed on a rear surface of the door assembly (II), and a second top rail 28112 assembled to a front surface of the cabinet assembly (I) and configured to make relative movements in the left-right direction with respect to the first top rail 28111.

In one embodiment, the second top rail 28112 may be coupled to the top supporter 2814, and the top supporter 2814 may be fixed to the cabinet assembly (I). The first top rail 28111 and the second top rail 28112 may be assembled in a relatively movable manner.

The middle rail 2812 may include a first middle rail 28121 disposed on the rear surface of the door assembly (II), and a second middle rail 28122 assembled to the front surface of the cabinet assembly (I) and configured to make relative movements with respect to the first middle rail 28121 in the left-right direction.

The bottom rail 2813 may include a first bottom rail 28131 disposed on the rear surface of the door assembly (II), and a second bottom rail 28132 assembled to a structure disposed on the front surface of the cabinet assembly (I) and configured to make relative movements with respect to the first bottom rail 28131 in the left-right direction. The second bottom rail 28132 may be coupled to the bottom supporter 2815, and the bottom supporter 2815 may be fixed to the cabinet assembly (I).

The door driver 282 may be disposed at any one of the door assembly (II) or the cabinet assembly (I), and may implement a sliding movement through interference with the other.

The door driver 282 may include a rack 2821 disposed at the door assembly (II) and extending in the left-right direction, a gear assembly 2822 disposed at a structure near the cabinet assembly (I), engaged with the rack 2821 and configured to move along the rack 2821 at the time of rotation, a gear driving motor 2823 disposed at a structure near the cabinet assembly (I) and configured to supply driving force to the gear assembly 2822.

The rack 2821 may be long in the left-right direction and disposed at a lower side of the middle rail 2812, and may be disposed at a lower side of the rack 2821 such that the gear assembly 2822 connected to the gear driving motor 2823 is engaged with the rack 2821. When the door driver 282 operates, the guide rail 281 may guide sliding movements of the door assembly (II). Sliding movements of the door assembly (II) may be implemented only by operating the rack 2821 of the door driver 282 and the gear assembly 2822. However, it is not easy for the door assembly (II) to make sliding movements smoothly. The guide rail 281 may help the door assembly (II) to slide smoothly.

The vision module 22 may be disposed at an upper portion of the door assembly (II) and may optionally operate. The vision module 22 may be exposed outside the door assembly (II) when operating while being hidden in the door assembly (II) when not operating.

The vision module 22 may include a vision module housing 221 disposed at the door assembly (II) and provided with a camera opening 221*a* that may be open towards an upper side, and a camera 222 disposed at the vision module housing 221, configured to move in the up-down direction with respect to the vision module housing 221 and optionally exposed through the camera opening 221*a*.

The vision module 22 may further comprise a camera control part (not illustrated) electrically connected with the camera 222 and configured to control the camera 222, and a camera moving module (not illustrated) disposed at the vision module housing 221 and configured to move the camera 222 in the up-down direction.

In the embodiment, the vision module housing 221 and an upper panel module 1110 may be individually manufactured, and the vision module housing 221 may be disposed at an upper side of the upper panel 23. The vision module housing 221 may cover an upper side of the insertion space 213 formed in a rear direction the door panel 21.

Below, a display module 29 according to an embodiment is described with reference to FIGS. 26 to 32.

The display module 29 may be disposed at a door panel 21, and may supply visual information to a user through the door panel 21.

The display module 29 may be partially exposed by passing through the door panel 21 and may supply visual information to the user through an exposed display. In one embodiment, information of the display module 29 may be delivered to the user through a display hole 211*b* formed at the door panel 21.

The display module 29 according to another embodiment may be provided with a touch panel 294 and may supply information on an operation state of the indoor unit and the like to a user at the same time as the display module 29 receives the user's instruction.

The display module 29 according to one embodiment may include a display 295 configured to supply visual information to a user, a display case 291 onto which the display 295 may be mounted and which fixes a position of the display 295 disposed at a rear of the door panel 21, a touch panel 294 disposed at a front of the display 295 and configured to sense an input by a touch of a user, a front glass 292 disposed at the front of the display 295 and configured to cover the front of the display module 29, a proximity sensor module 296 disposed at a rear of the front glass 292 and configured to measure a distance from the user, and a rear cover 293 configured to maintain a position of a first proximity sensor 2961 between the front glass 292 and the display 295.

The display module 29 according to another embodiment may further include a remote control receiving module 297 configured to receive a signal from an external remote control transmitter (not illustrated).

The display 295 may be implemented as a liquid crystal display (LCD) module where an image is output. The display 295 according to one embodiment may have a rectangular plate shape, and may have a circular display part, a size of which is the same as a size of the front glass 292 therein.

The display 295 may be disposed at one side of the display case 291. The display 295 may be mounted onto a display mounting part 2911 formed in the display case 291. The display 295 may be attached to the display case 291 using an additional adhesive member. The display mounting part 2911 may form a groove that is concave rearwards from one side of the display case 291. The groove formed by the display mounting part 2911 may have a structure into which an outer edge of the display 295 may be fitted such that the display 295 is mounted and fixed.

The display case 291 may fix components of the display 295 and the touch panel 294 and may be fixed to the door panel 21. The display case 291 may be mounted onto one side of the upper panel 23. The display case 291 may be mounted onto and coupled to the display module mounting part 2911 of the upper panel 23. The display case 291 may include a plurality of coupling parts 2915 coupled to the upper panel 23. The display case 291 may be coupled to the upper panel 23 through an additional coupling member (not illustrated).

The display case 291 may have a rectangular plate shape. The display case 291 may have a rectangular plate shape that is longer in the up-down direction rather than in the left-right direction. The display case 291 may be divided into a case upper portion 291*a* onto which the display 295 is mounted, a case lower portion 291*b* onto which a below-described touch panel circuit substrate 2941 is mounted, and a connection case 291*c* which is configured to connect the case upper portion 291*a* and the case lower portion 291*b* and onto which a touch cable 2942, connecting the touch panel 294 and the touch panel circuit substrate 2941, is mounted.

The display 295, the first proximity sensor 2961, the touch panel 294, the front glass 292, and the rear cover 293 may be mounted onto the case upper portion 291*a*.

The displace case 291 may be provide with a display mounting part 2911 onto which the display 295 may be mounted. The display mounting part 2911 may be formed at the case upper portion 291*a*. The display mounting part 2911 may form a groove which is concave and rectangular and into which the display 295 may be inserted in a rear direction of the plate-shaped display case 291. The groove formed by the display mounting part 2911 may be a space into which the rectangular plate-shaped display 295 is inserted.

Additionally, the display case 291 may be provided with a touch panel mounting part 2912 into which a part of the touch panel 294 is inserted. The touch panel mounting part 2912 may be formed at a front of the display mounting part 2911, and considering a size of the touch panel 294, may have a larger surface area than the display mounting part 2911.

The touch panel mounting part 2912 may be provided with a touch panel fixing part 2913 protruding downwards at an upper side of the touch panel mounting part 2912. The touch panel fixing part 2913 may be inserted into a portion of the touch panel 294, where a first hole 2943 may be formed, when the touch panel 294 is mounted onto the touch panel mounting part 2912. The touch panel fixing part 2913 may contact surfaces formed on the left and right of the first hole 2943.

The display case 291 may be provided with a touch cable mounting part 2916 onto which a touch cable 2942 is mounted, and a touch panel circuit substrate mounting part 2914 onto which a touch panel circuit substrate 2941 is mounted, at a lower side of the touch panel mounting part 2912.

The touch cable mounting part 2916 may be disposed at the connection case 291*c*, and the touch panel circuit substrate mounting part 2914 may be disposed at the case lower portion 291*b*.

The touch panel 294 may be disposed at a front of the display 295. The touch panel 294 may adhere to the display 295 using an adhesive or a tape. The touch panel 294 may be configured to sense a user's touch manipulation of the front glass 292. Various methods, by which an input is done by a touch of the front glass 292, such as a printing method or a film adhesion method and the like may be applied to the touch panel 294.

The touch panel 294 according to one embodiment may form a rectangular plate shape, and may be provided with a first hole 2943 for disposing a first proximity sensor 2961 at an upper side thereof and a second hole 2944 for disposing a remote control receiving sensor 2971 at a lower side thereof.

A part of the touch panel fixing part 2913 disposed at a rear of the first proximity sensor 2961 may be disposed at the first hole 2943. For the touch panel 294, a touch function may also be activated only in an area exposed to the front glass 292.

A part of the remote control receiving sensor 2971 may be inserted into the second hole 2944.

The touch panel 294 may be connected with the touch panel circuit substrate 2941 through the touch cable 2942. Accordingly, an input signal supplied to the touch panel 294 may be transmitted to the touch panel circuit substrate 2941 through the touch cable 2942.

A lower cover 293 and the front glass 292 may be disposed in a forward direction of the touch panel 294.

The front glass 292 may cover the display hole 211*b* formed at the door panel 21. The front glass 292 may be disposed at a front of the display module 29 seen by a user. When the user makes use of a function of the touch panel 294, the user may contact the front glass 292 and manipulate the touch panel 294.

The front glass 292 may be made of glass. The front glass 292 may have a circular plate shape. The front glass 292 may be disposed to protrude further forwards than the front surface part 211 of the door panel 21. In another example, the front glass 292 may form a surface that continues from the front surface part 211.

The front glass 292 may include a front surface 2921 exposed outside the indoor unit, and a rear surface 2922 facing the rear cover 293.

The front glass 292 may include a first printed part 2923 formed on a rear surface 2922 of the front glass 292 and printed along an edge of the front glass 292, a second printed part 2924 formed on the rear surface 2922 of the front glass 292, printed inwards and spaced a predetermined distance apart from the first printed part 2923 in a radial direction, and a sensor exposing part 2925 not printed between the first printed part 2923 and the second printed part 2924. A distance (D1) between the first printed part 2923 and the second printed part 2924 may be formed considering a length (L1) of the first proximity sensor 2961 in the up-down direction. That is, the distance (D1) between the first printed part 2923 and the second printed part 2924 may be larger than the length (L1) of the first proximity sensor 2961 in the up-down direction.

When the front glass 292, the rear cover 293, the first proximity sensor 2961, and the remote control receiving sensor 2971 are mounted onto the display case 291, the first proximity sensor 2961 and the remote control receiving sensor 2971 may be disposed in a rear of the sensor exposing part 2925.

The rear cover 293 may be disposed at a rear of the front glass 292. The rear cover 293 may have a circular plate shape and may be disposed at the rear of the front glass 292. The rear cover 293 may have a circular plate shape a diameter of which is the same as the front glass 292. However, the diameter of the rear cover 293 is provided only as an example, and the rear cover 293 and the front glass 292 may have different diameters.

The rear cover 293 may be made of glass that is the same material as the front glass 292. The rear cover 293 may also be made of an acrylic material.

The rear cover 293 may be provided with a proximity sensor hole 2934 where a part of the first proximity sensor 2961 may be disposed, at an upper side thereof, and a remote control receiving sensor hole 2935 where a part of the remote control receiving sensor 2971 is disposed, at a lower side thereof.

The rear cover 293 and the front glass 292 may be attached using an adhesive. The rear cover 293 may be disposed at a front of the touch panel 294.

The rear cover 293 may include a front surface 2931 facing the front glass 292, and a rear surface 2932 facing the touch panel 294. The rear cover 293 may include a rear cover printed part 2933 printed along an edge of the rear cover 293 on the front surface 2931 of the rear cover 293. The rear cover printed part 2933, an outer circumference of the rear cover 293 except a portion, where the proximity sensor hole 2934 is formed, may be printed. An inner end 29331 of the rear cover printed part 2933 may have a diameter the same as an inner end 29241 of the second printed part 2924 of the front glass 292.

Accordingly, the rear cover 293 and the front glass 292 may be attached such that the inner end 29331 of the rear cover printed part 2933 and the inner end 29241 of the second printed part 2924 of the front glass 292 form the same concentric circle.

When the rear cover 293 and the front glass 292 are attached, the front of the proximity sensor hole 2934 may be exposed through the sensor exposing part 2925. When the rear cover 293 and the front glass 292 are attached, the front of the remote control receiving sensor hole 2935 may be exposed trough the sensor exposing part 2925.

The proximity sensor module 296 may include a first proximity sensor 2961 configured to measure a distance from an object, a proximity sensor circuit substrate 2962 configured to receive a signal recognized by the first proximity sensor 2961, and a reflector 2963 disposed around the first proximity sensor 2961 and configured to ensure a space for the first proximity sensor 2961 disposed between the front glass 292 and the proximity sensor circuit substrate 2962.

The first proximity sensor 2961 may denote a sensor that may measure a position of an object, i.e., a distance from an object. The first proximity sensor 2961 may be implemented according to various methods.

For example, the first proximity sensor 2961 may be implemented as a transmission-type photosensor, a direct reflection-type photosensor, a mirror reflection-type photosensor, a high-frequency oscillation-type proximity sensor, a capacitive proximity sensor, a magnetic proximity sensor, an infrared proximity sensor and the like.

In addition, the first proximity sensor 2961 may be implemented according to various methods known to one having ordinary skill in the art, and not limited to the above-described embodiment.

An infrared proximity sensor may be used as the first proximity sensor 2961 according to one embodiment. The first proximity sensor 2961 may measure a distance between a front surface of the indoor unit and a user. When a user is within a predetermined distance, the first proximity sensor 2961 may send a signal to the proximity sensor circuit substrate 2962.

Referring to FIG. 34, the first proximity sensor 2961 may sense an object within a first predetermined distance range (R1) from the door panel 21. The first predetermined distance range (R1) may include all sections within a predetermined distance range from the door panel 21. The first predetermined distance range (R1) may include a distance farther than a below-described second predetermined distance range (R2) sensed by a second proximity sensor 124.

However, as the first proximity sensor 2961 may be disposed at the display module 29, the first proximity sensor may be disposed at an upper side such that the first proximity sensor is easily seen by a user and readily manipulated. Accordingly, the first proximity sensor 2961 may sense an object within the first predetermined distance range (R1) in a range of heights higher than a predetermined height.

The first proximity sensor 2961 may be disposed at a front of the proximity sensor circuit substrate 2962. The first proximity sensor 2961 may be disposed at a lower portion of the proximity sensor circuit substrate 2962. The first proximity sensor 2961 may be disposed at a rear of the front glass 292. The first proximity sensor 2961 may be disposed at a rear of the sensor exposing part 2925 formed between the first printed part 2923 and the second printed part 2924 of the front glass 292. The first proximity sensor 2961 may be disposed at the proximity sensor hole 2934 of the rear cover 293.

The proximity sensor circuit substrate 2962 may be provided with the first proximity sensor 2961 on a front surface thereof, and may receive a signal transmitted by the first proximity sensor 2961. The proximity sensor circuit substrate 2962 may be disposed at a front of the touch panel fixing part 2913. The proximity sensor circuit substrate 2962 may be coupled to the display case 291 using an additional coupling means 2964 and may fix a position of the first proximity sensor 2961.

For the proximity sensor circuit substrate 2962, the reflector 2963 may be disposed around the first proximity sensor 2961. The reflector 2963 may ensure a space for disposing the first proximity sensor 2961 disposed at the rear of the front glass 292. The reflector 2963 may have a rectangular ring shape and may be provided with the first proximity sensor 2961 therein. The reflector 2963 may have a thickness greater than a thickness of the first proximity sensor 2961 in the front-rear direction.

The remote control receiving module 297 may include a remote control receiving sensor 2971 configured to receive a signal from a remote controller (not illustrated) placed outside the indoor unit, and a remote control receiving sensor circuit substrate 2972 configured to receive the signal transmitted by the remote controller and delivered to the remote control receiving sensor 2971.

When a circulator door 25 opens a front discharge opening 211*a* entirely, the circulator door 25 may be disposed at a rear of the display module 29. When the circulator door 25 opens the front discharge opening 211*a* entirely, the circulator door 25 may be disposed between the display module 29 and an inner panel 15.

Components disposed in a sensor disposing space at a lower end of a base according to an aspect of the embodiment are described hereunder with reference to FIG. 21, FIGS. 33 to 34, and FIG. 36.

The base 12 may be provided with a sensor disposing space 12*a* which is open forwards and in which various sensors are disposed, at a lower end thereof. The sensor disposing space 12*a* may be formed in the base 12, and its front surface is open. The base 12 may include a base lower end cover 121 configured to cover the opened front surface of the sensor disposing space 12*a*.

The second proximity sensor 124 configured to sense a user approaching the indoor unit and to generate and output a signal corresponding to the user's approach, a projection module 123 configured to display an area sensed by the second proximity sensor 124 in a forward direction of the indoor unit, and a sensor housing 122 onto which the second proximity sensor 124 and the projection module 123 are mounted, may be installed in the sensor disposing space 12*a*.

A second proximity sensor hole 121*a*, which is open in a direction faced by the second proximity sensor 124, and a projection hole 121*b*, which is open in a direction faced by the projection module 123, may be formed at the base lower end cover 121. Additionally, a speaker hole 121*d*, which is opened forwards at a portion onto which a below-described speaker 125 is mounted, and a microphone hole 121*c*, which is open forwards at a portion onto which a microphone 126*a*, 126*b* is mounted, may be formed at the base lower end cover 121.

The second proximity sensor 124 and the projection module 123 may be disposed at a rear of the base lower end cover 121. The speaker 125 and the microphone 126*a*, 126*b* may be disposed at the rear of the base lower end cover 121. The base lower end cover 121 may be mounted onto an opened lower end of the base 12 disposed at a lower side of a door assembly (II).

The second proximity sensor 124 may be disposed at the lower side of the door assembly (II). Accordingly, the door assembly (II) moving leftwards and rightwards may not interfere with operations of the second proximity sensor 124. The second proximity sensor 124 according to an aspect of the embodiment may sense a specific area in a forward direction of the door assembly (II). The second proximity sensor 124 may sense a user's body approaching an area where the projection module 123 displays a graphic object.

Referring to FIG. 34, the second proximity sensor 124 according to an embodiment may be spaced a predetermined height (H1) apart from a bottom surface. The second proximity sensor 124 according to an aspect of the embodiment may be disposed at a height lower than a height (H2) at which the sensor disposing space 12*a* is formed. The height (H1) at which the second proximity sensor 124 according to an aspect of the embodiment is spaced apart from the bottom surface may be 0.4 to 0.6 times as high as the height at which the sensor disposing space 12*a* is formed. The height (H1) at which the second proximity sensor 124 according to one embodiment is spaced apart from the bottom surface may be a height of a user's instep.

Referring to FIG. 34, the second proximity sensor 124 according to another embodiment may be disposed to sense a direction in parallel with the ground. That is, the second proximity sensor 124 may sense an upper side of the bottom portion where the projection module 123 displays a graphic object.

However, the above-described position of the second proximity sensor 124 is provided only as an example. The second proximity sensor 124 may be disposed to face an area displayed by the projection module 123. That is, the second proximity sensor 124 may be disposed to incline forwards and downwards to face the bottom portion displayed by the projection module 123.

The second proximity sensor 124 may sense a user in an area closer than an area sensed by the first proximity sensor 2961. The second proximity sensor 124 may sense a user within a second predetermined distance range (R2). Referring to FIG. 16, the second predetermined distance range (R2) may include an area where the projection module 123 projects a graphic object. The second predetermined distance range (R2) may sense an area lower and narrower than the area sensed by the first proximity sensor 2961.

The second proximity sensor 124 according to one embodiment may operate in association with the first proximity sensor 2961. That is, when the first proximity sensor 2961 senses a user within a predetermined area in a forward direction of the door assembly (II), the second proximity sensor 124 may operate.

The second proximity sensor 124 according to another embodiment may operate in association with a touch panel 294 of a display module 29. That is, when the touch panel 294 recognizes a touch of a user, the second proximity sensor 124 may operate.

The projection module 123 may be disposed near the second proximity sensor 124, may display the area sensed by the second proximity sensor 124 and may induce the user's body part to be placed in the area sensed by the second proximity senor 124. The projection module 123 may be disposed on the left or on the right of the second proximity sensor 124.

The projection module 123 may include a lamp 1231 configured to emit light, a film 1232 where a shape displayed on a bottom is printed, and a lens 1233 configured to amplify light emitted from the lamp 1231 and passing through the film 1232.

An LED lamp capable of emitting light having high brightness may be used as the lamp 1231. A shape or characters and the like, which may be recognized by a user, may be printed on the film 1232.

The projection module 123 may be disposed at a slant to face a bottom of a position spaced a predetermined distance apart from a front surface of the door assembly (II). The projection module 123 and a bottom surface may form an inclination angle (θ) of 20 degrees to 30 degrees such that the projection module 123 projects a graphic object towards a bottom surface of a portion that is not far away from a door panel 21. The projection module 123 may be disposed to incline forwards and downwards such that light reflects to an area where the second proximity sensor 124 may sense a distance from a user.

The sensor housing 122 may form a space where the second proximity sensor 124 and the projection module 123 are installed, therein. The sensor housing 122 may be provided with a second proximity sensor mounting part 1221 where the second proximity sensor 124 is disposed, and a projection mounting part 1222 where the projection module 123 is disposed, therein. The second proximity sensor mounting part 1221 may be formed such that the second proximity sensor 124 is disposed at a slant. The projection mounting part 1222 may be formed such that the projection module 123 is disposed at a slant. The sensor hosing 122 may be fixed in the sensor disposing space 12*a* formed at a lower side of the base 12. The sensor housing 122 may allow the second proximity sensor 124 and the projection module 123 to be fixed in the sensor disposing space 12*a*.

When the second proximity sensor 124 and the projection module 123 are installed in the sensor housing 122, the second proximity sensor 124 and the projection module 123 may be disposed to incline forwards and downwards. That is, an inside of the sensor housing 122, where the second proximity sensor 124 and the projection module 123 are installed, may have a structure in which the second proximity sensor 124 and the projection module 123 are disposed to incline forwards and downwards.

The sensor housing 122 may include a housing upper cover 122*a* configured to cover upper sides of the second proximity sensor 124 and the projection module 123, a housing lower cover 122*b* configured to cover lower sides of the second proximity sensor 124 and the projection module 123, and a housing front cover 122*c* configured to cover fronts of the second proximity sensor 124 and the projection module 123.

When the housing upper cover 122*a* and the housing lower cover 122*b* are coupled, a space, where the second proximity sensor 124 and the projection module 123 are disposed at a slant, may be formed. The housing front cover 122*c* may be made of a transparent material. Accordingly, the second proximity sensor 124 may sense a forward direction of the door assembly (II) through the front cover 122*c*. Further, the projection module 123 may project a graphic object forwards through the front cover 122*c*.

The front cover 122*c* may include a first projection 122*cl*, which protrudes forwards to be inserted into the second proximity sensor hole 121*a* formed at the base lower end cover 121, and a second projection 122*c*2 which protrude forwards to be inserted into the projection hole 121*b*.

In the sensor disposing space 12*a*, disposed are a microphone 126*a*, 126*b* disposed at a rear of the base lower end cover 121 and configured to receive a user's voice, and a speaker 125 configured to inform the user about an operation state of the indoor unit and processed information or to output a voice corresponding to a result of recognition of the voice.

A plurality of microphones s 126*a*, 126*b* may be provided to receive a user's voice instruction more accurately, and may be disposed at different positions.

The microphone 126*a*, 126*b* according to one embodiment may include two microphones 126*a*, 126*b* to ensure voice recognition performance. The two microphones 126*a*, 126*b* may be spaced a predetermined distance apart from each other. A voice input from the two microphones 126*a*, 126*b*, spaced a predetermined distance apart from each other, may be compared to remove noise.

The microphone 126*a*, 126*b* according to an aspect of the embodiment may be disposed on a rear surface of the base lower end cover 121, hereunder. A microphone hole 121*c* may be formed at a portion of the base lower end cover 121 according to one embodiment, where the microphone 126*a*, 126*b* is disposed. That is, two microphone holes 121*c* may be formed at the portions of the base lower end cover 121 according to the embodiment, where the two microphones 126*a*, 126*b* are disposed.

The microphone 126*a*, 126*b* may be mounted onto the base lower end cover 121 through an addition adhesive member (not illustrated). The microphone 126*a*, 126*b* according to another embodiment may be mounted onto a microphone mounting member 1261 and may be mounted onto the base lower end cover 121. The microphone mounting member 1261 may include a microphone mounting part 1261*a*, 1261*b* onto which the microphone 126*a*, 126*b* is mounted, and a coupling part 1261*c* configured to couple the microphone mounting member 1261 to the base lower end cover 121.

The speaker 125 according to an embodiment may be disposed on the rear surface of the base lower end cover 121. Accordingly, a speaker hole 121*d* may be formed at the base lower end cover 121, where the speaker 125 may be disposed, to deliver a sound from the speaker 125 outside the base 12.

The speaker 125 according to another embodiment may include a speaker body 1251, which forms an exterior and which may be provided with a speaker opening 125*a* open to output a sound at one side thereof, an output part (not illustrated) configured to output a sound to the speaker opening 125*a* formed at one side of the speaker body 1251, and a speaker coupling part 1252 configured to couple the speaker body 1251 to the base lower end cover 121.

An indoor unit of the exemplary air conditioner may further include a sliding door position sensor 127*a*, 127*b* including a first position sensor 127*a* and a second position sensor 127*b* that are configured to detect a position of a door panel 21.

Referring to FIG. 21, the sliding door position sensor 127*a*, 127*b* according to one embodiment may be disposed at the base 12. Alternatively, the sliding door position sensor 127*a*, 127*b* may be disposed at an inner panel 15. A position of the sliding door position sensor 127*a*, 127*b* may vary depending on a sensing method and a model structure of an air conditioner.

The sliding door position sensor 127*a*, 127*b* may include a plurality of sensors. For example, the sliding door position sensor 127*a*, 127*b* may include a first position sensor 127*a* and a second position sensor 127*b*.

For example, the first position sensor 127*a* and the second position sensor 127*b* may be spaced apart from each other, and a distance between the first position sensor 127*a* and the second position sensor 127*b* may correspond to a distance moved by a door panel 21.

The first position sensor 127*a* may sense a state where the door panel 21 is closed, and the second position sensor 127*b* may sense a state where the door panel 21 is open. To this end, the first position sensor 127*a* may be disposed at a position corresponding to a start point of movement of the door panel 21 and may sense the state where the door panel 21 is closed, and the second position sensor 127*b* may be disposed at an end point of movement of the door panel 21 and sense the state where the door panel 21 is open. The second position sensor 127*b* may sense the state where the door panel 21 is open when the door panel 21 moves to expose a front surface of a water vessel 51.

As described herein, the start point of movement of the door panel 21 may denote a rightmost point (seen from a front) of the door panel 21 which is closed before the door panel 21 starts an opening operation.

As described herein, the end point of movement of the door panel 21 may denote a rightmost point of the door panel 21 which is open after the door panel 21 finishes the opening operation.

In some embodiments, the end point of movement of the door panel 21 may denote a leftmost point (seen from the front) of the door panel 21 which is closed before the door panel 21 starts an opening operation.

The present disclosure is not intended to limit a sensing method of the sliding door position sensor 127*a*, 127*b*, and various types of sensors may be used.

For example, the first position sensor 127*a* and the second position sensor 127*b* may an infrared (IR) sensor. The first position sensor 127*a* and the second position sensor 127*b* may be disposed respectively at a start point of movement of a sliding door 21 and at an end point of movement of the sliding door 21 to sense a position of the door panel 21. Additionally, a control part 800 may control a door driver 282 on the basis of the sensed position information.

Alternatively, the sliding door position sensor 127*a*, 127*b* may sense whether the door panel 21 is open and closed and/or may sense a position of the door panel 21 using a Hall IC, a trigger switch, a rotary switch and the like.

A first proximity sensor 2961 may be disposed at an upper side of a second proximity sensor 124. The first proximity sensor 2961 may be disposed at an upper end of a display module 29, and the second proximity sensor 124 may be disposed at a lower side of a door assembly (II). The first proximity sensor 2961 may be disposed at a height higher than a predetermined height. Accordingly, when an infant, a child, or a pet is sensed, the door panel 21 may be prevented from moving.

Unlike the second proximity sensor 124, the first proximity sensor 2961 may recognize an object far from the door panel 21. The first proximity sensor 2961 may sense an object within a first predetermined distance range (R1) farther than a second predetermined distance range (R2) where the second proximity sensor 124 senses an object.

Configurations and methods of the above-described embodiments should not be construed as being limitedly applied to the exemplary air conditioner. Rather, modifications may be made to the embodiments and all or part of each embodiment may be optionally combined and implemented.

A control method of the air conditioner according to one or more embodiments may be implemented in the form of a code that is readable by a processor in processor-readable recording media. The processor-readable recording media may comprise all types of recording media where processor-readable data are stored. The examples of processor-readable recording media include Read Only Memory (ROM), Random Access Memory (RAM), CD-ROMs, magnetic tapes, floppy disks, optical data storage devices and the like. Additionally, the processor-readable recording media may be implemented in the form of a carrier wave such as transmission through the Internet. Further, the processor-readable recording media may be distributed in a computer system connected on a network such that a code readable by a processor is stored and executed according to a distribution method.

The embodiments have been described with reference to a number of illustrative embodiments thereof. However, it should be understood that the present disclosure is not intended to limit the embodiments and numerous other modifications and embodiments can be devised by those skilled in the art that will fall within the spirit and scope of the principles of this disclosure. Additionally, numerous variations and modifications should be construed as being included within the scope of the technical spirit or prospects of the disclosure.

The invention claimed is:

1. An air conditioner comprising:

a main body including a sliding door configured to move leftwards and rightwards to be opened and closed, and a cabinet to which the sliding door is movably coupled;

a water vessel for humidification configured to be exposed outwards as the sliding door moves;

an upper end proximity sensor disposed at the main body and configured to sense whether a user approaches;

a lower end proximity sensor disposed further downwards than the upper end proximity sensor and configured to sense whether the user approaches;

a sliding door motor configured to supply power to the sliding door; and a controller configured to control the sliding door motor such that the sliding door is opened allowing the water vessel for humidification to be exposed outwards, based on the upper end proximity sensor sensing the user, and then, the lower end proximity sensor sensing the user or a control input by the user being received.

2. The air conditioner of claim 1, further comprising:

a display module configured to receive a touch input, wherein the control input is the touch input.

3. The air conditioner of claim 1, further comprising:

a sliding door position sensor including a first position sensor and a second position sensor, which are configured to detect a position of the sliding door.

4. The air conditioner of claim 3, wherein the first position sensor is configured to sense a state where the sliding door is closed, and the second position sensor is configured to sense a state where the sliding door is open.

5. The air conditioner of claim 3, wherein, based on the second position sensor sensing the sliding door at a first distance while the sliding door performs an opening operation, the controller is configured to control the sliding door motor such that rotational speed of the sliding door motor is reduced.

6. The air conditioner of claim 5, wherein, based on the second position sensor sensing the sliding door at a second distance shorter than the first distance, the controller is configured to control the sliding door motor such that the sliding door motor stops rotating.

7. The air conditioner of claim 3, wherein, based on the first position sensor sensing the sliding door at a third distance while the sliding door performs a closing operation, the controller is configured to control the sliding door motor such that rotational speed of the sliding door motor is reduced.

8. The air conditioner of claim 7, wherein, based on the first position sensor sensing the sliding door at a fourth distance shorter than the third distance, the controller is configured to control the sliding door motor such that the sliding door motor stops rotating.

9. The air conditioner of claim 1, further comprising:

a projection module configured to project a predetermined image based on the upper end proximity sensor sensing the user.

10. The air conditioner of claim 9, wherein the projection module is configured to project the predetermined image in a forward direction of the lower end proximity sensor.

11. The air conditioner of claim 1, further comprising:

a sensor configured to sense whether a water vessel for humidification is mounted, and wherein, based on a sliding door-off instruction being input and the water vessel for humidification being mounted, the controller is configured to control the sliding door motor such that sliding door is closed.

12. The air conditioner of claim 11, wherein the controller is configured to output a notification asking for placement of the water vessel for humidification based on the water vessel for humidification being not mounted.

* * * * *